US010105615B2

(12) United States Patent
Rogozinski

(10) Patent No.: US 10,105,615 B2
(45) Date of Patent: Oct. 23, 2018

(54) SYSTEM AND METHOD FLUID TRANSFER BETWEEN INFLATABLE OBJECTS

(71) Applicant: Joseph Rogozinski, Ramat Gan (IL)

(72) Inventor: Joseph Rogozinski, Ramat Gan (IL)

(73) Assignee: Joseph Rogozinski, Ramat Gan (IL)

( * ) Notice: Subject to any disclaimer, the term of this patent is extended or adjusted under 35 U.S.C. 154(b) by 268 days.

(21) Appl. No.: 14/422,006

(22) PCT Filed: Aug. 22, 2013

(86) PCT No.: PCT/IB2013/056817
§ 371 (c)(1),
(2) Date: Feb. 17, 2015

(87) PCT Pub. No.: WO2014/030140
PCT Pub. Date: Feb. 27, 2014

(65) Prior Publication Data

US 2015/0231518 A1 Aug. 20, 2015

Related U.S. Application Data

(60) Provisional application No. 61/692,325, filed on Aug. 23, 2012.

(51) Int. Cl.

| | |
|---|---|
| ***A63H 3/06*** | (2006.01) |
| ***A63H 27/10*** | (2006.01) |
| ***A63H 33/38*** | (2006.01) |
| ***B42D 15/00*** | (2006.01) |

(52) U.S. Cl.
CPC ..... *A63H 27/10* (2013.01); *A63H 33/38* (2013.01); *B42D 15/00* (2013.01); *A63H 2027/1033* (2013.01)

(58) Field of Classification Search
CPC ..... A63H 27/10; A63H 3/06; A63H 33/38; B42D 1/003; B42D 1/006; B42D 1/008; B42D 15/00
USPC ..... 446/148, 149, 150, 151, 220
See application file for complete search history.

(56) References Cited

U.S. PATENT DOCUMENTS

| | | | | |
|---|---|---|---|---|
| 3,289,333 A * | 12/1966 | Watrous, Jr. | ..... | G09B 17/00 40/1 |
| 3,451,882 A | 6/1969 | Propoggio | | |
| 4,208,123 A * | 6/1980 | Stevenson | ..... | G03B 27/62 355/25 |

(Continued)

FOREIGN PATENT DOCUMENTS

FR 2636008 A1 3/1990

*Primary Examiner* — Vishu Mendiratta
(74) *Attorney, Agent, or Firm* — Mark M. Friedman

(57) ABSTRACT

A fluid transference system, including: (a) at least two inflatable objects; (b) at least one variable-state fluid transfer conduit, interposed between a first and a second inflatable objects, the variable state conduit configured to allow fluid flow there-through in an open state and to disallow the flow in a closed state. A fluid transfer system, including: (a) an entry port; (b) an exit port; (c) a unidirectional main conduit defined between the entry port and the exit port; (d) an intermediate port; and (e) an intermediate conduit defined between the intermediate port and the main conduit, intersecting the main conduit between a first unidirectional valve and a second unidirectional valve, the main conduit defining a unidirectional fluid flow.

19 Claims, 37 Drawing Sheets

(56) References Cited

U.S. PATENT DOCUMENTS

| | | | | | |
|---|---|---|---|---|---|
| 4,521,166 | A * | 6/1985 | Phillips | A47C 27/081 | 417/478 |
| 4,978,141 | A * | 12/1990 | Wu | A63H 33/38 | 281/15.1 |
| 5,150,767 | A * | 9/1992 | Miller | A62B 1/22 | 182/137 |
| 5,769,232 | A * | 6/1998 | Cash | B65D 81/052 | 206/522 |
| 2005/0227208 | A1* | 10/2005 | Beascoa | G09B 27/08 | 434/131 |
| 2006/0240740 | A1* | 10/2006 | Rouse | A63H 27/10 | 446/220 |
| 2007/0293117 | A1* | 12/2007 | Beascoa Amat | G09B 27/08 | 446/148 |
| 2011/0171875 | A1* | 7/2011 | Shams | A63H 27/10 | 446/220 |
| 2012/0167270 | A1 | 7/2012 | Strong | | |
| 2012/0187689 | A1 | 7/2012 | Crowley | | |

* cited by examiner 336
332
334
337
342
343
346
347
350
352
367
366
374
384
386

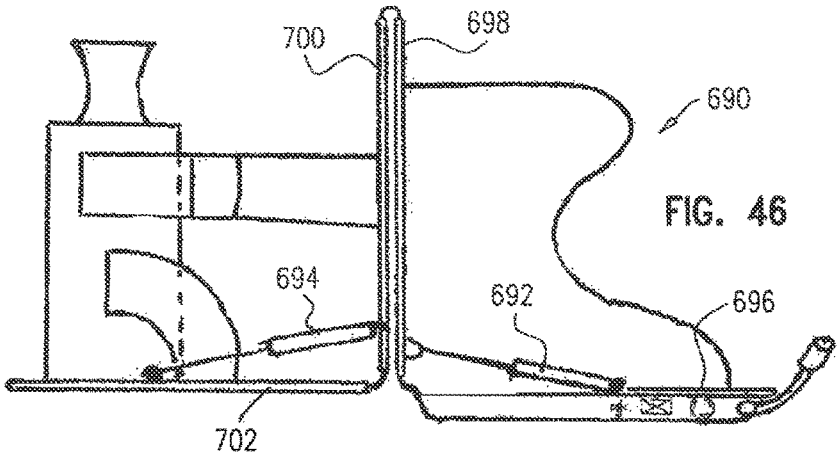
FIG. 46
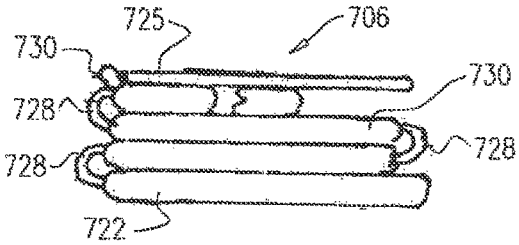
FIG. 47
FIG. 48
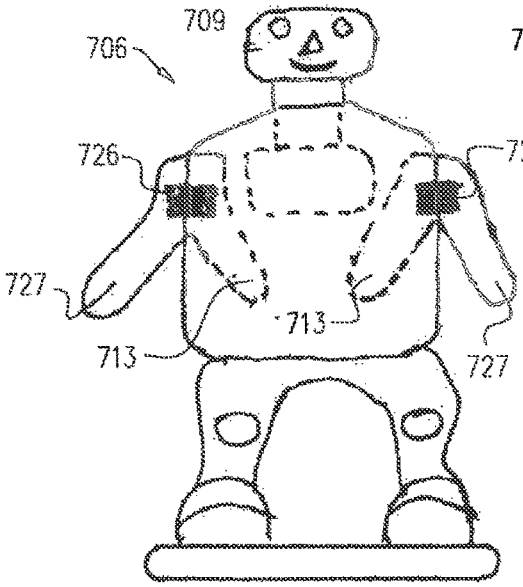
FIG. 49
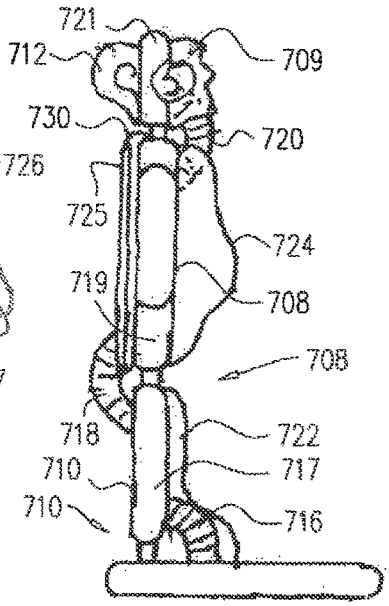

FIG. 52A
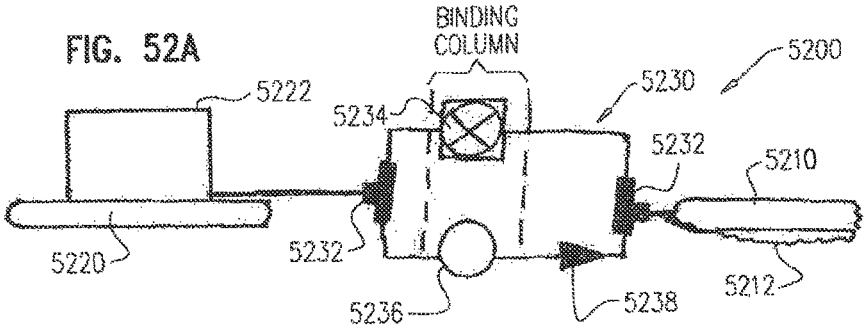
FIG. 52B
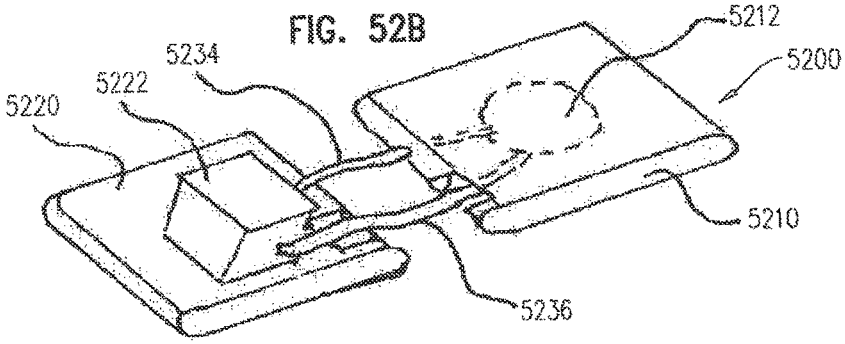
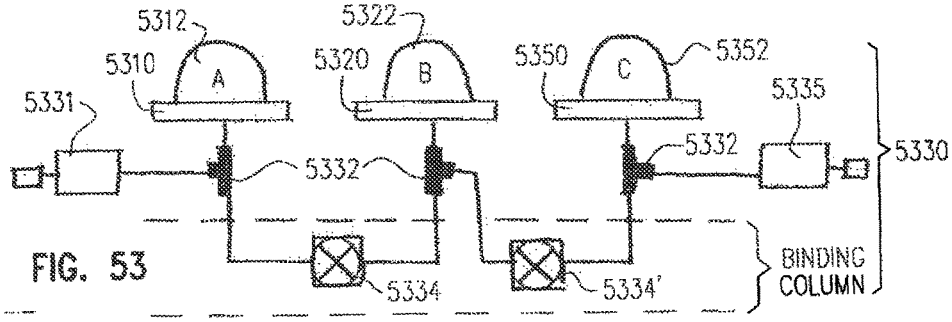
FIG. 53
FIG. 53A
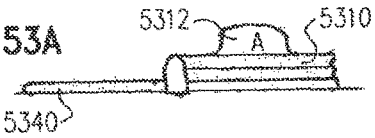
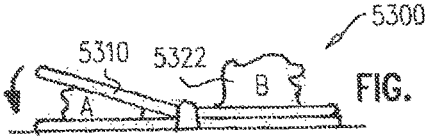
FIG. 53B
FIG. 53C
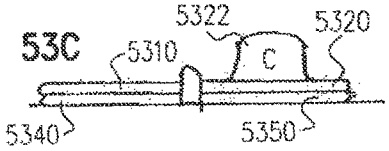
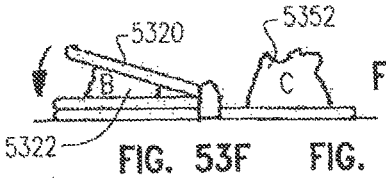
FIG. 53D
FIG. 53E
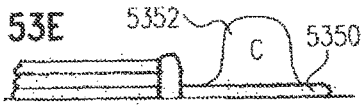
FIG. 53F
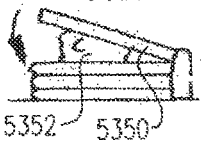
FIG. 53G
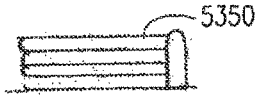

FIG. 59A
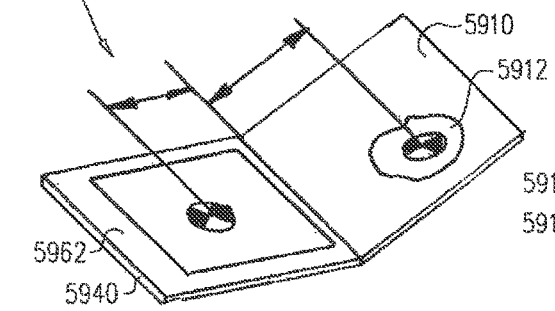
FIG. 59B
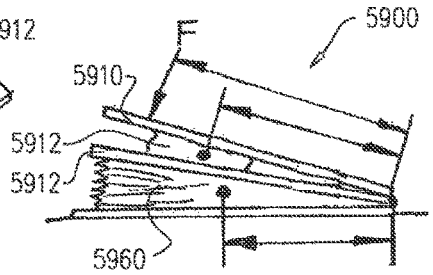
FIG. 59C
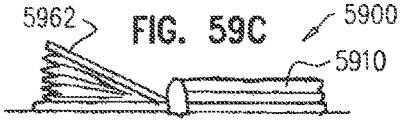
FIG. 59D
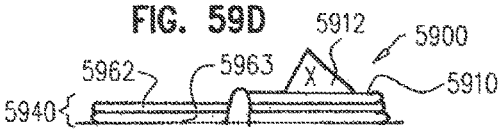
FIG. 59E
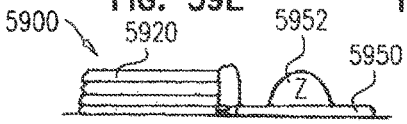
FIG. 59F
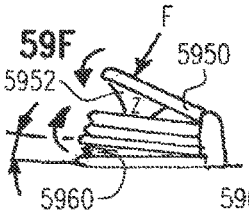
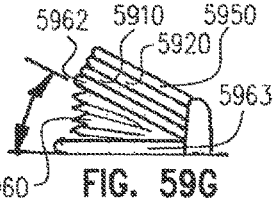
FIG. 59G
FIG. 59H
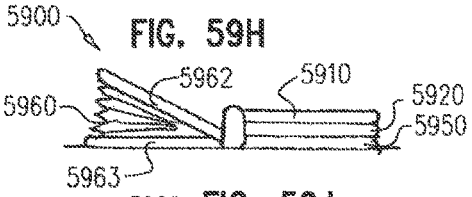
FIG. 59I
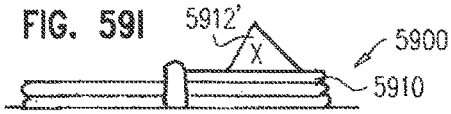
FIG. 59J
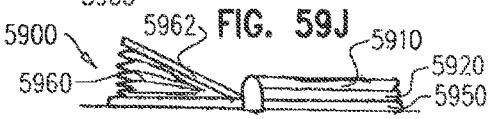
FIG. 59K
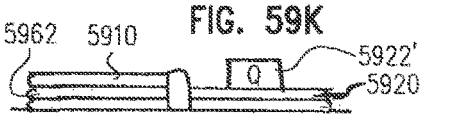
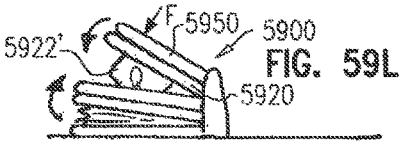
FIG. 59L
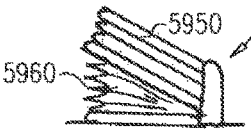
FIG. 59M
FIG. 59N
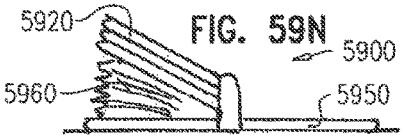
FIG. 59O
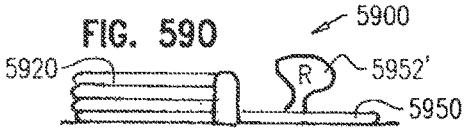

FIG. 63
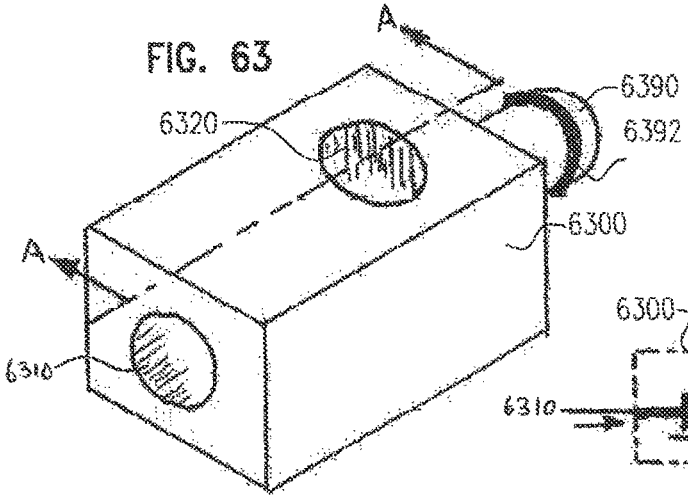
FIG. 63A
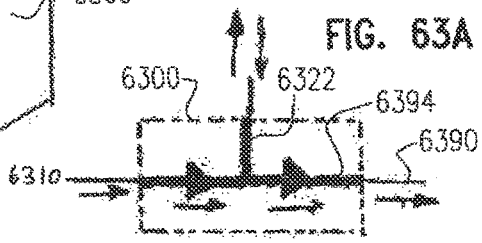
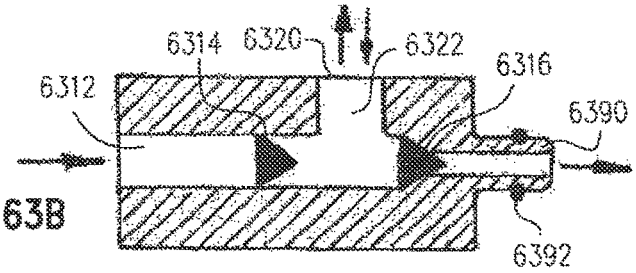
FIG. 63B
FIG. 63C
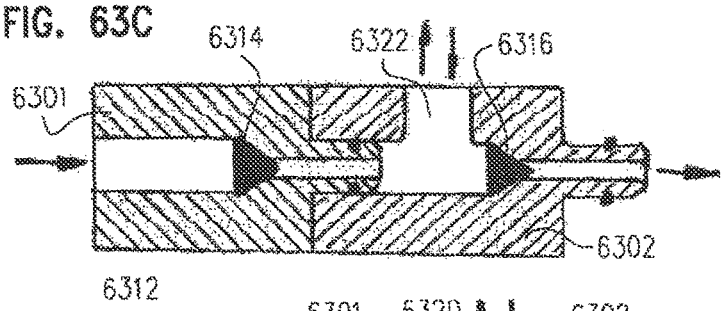
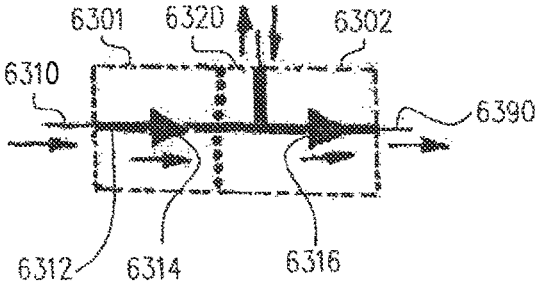
FIG. 63D FIG. 76A
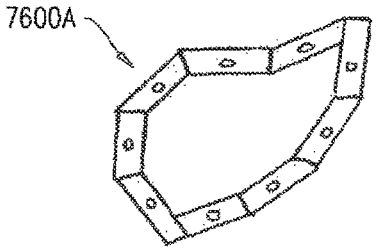
FIG. 76B
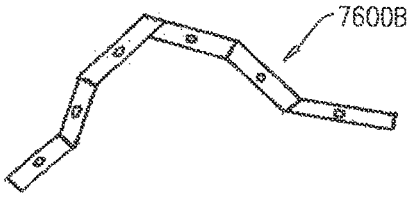
FIG. 77A
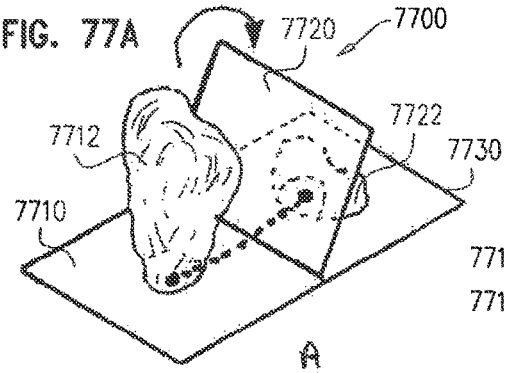
FIG. 77B
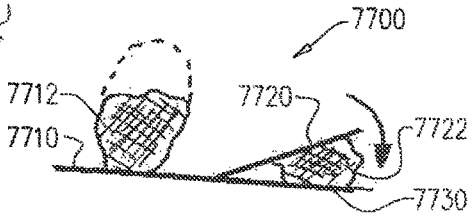
FIG. 78
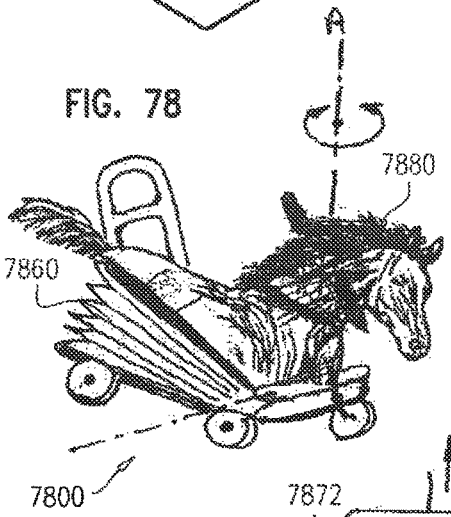
FIG. 78A
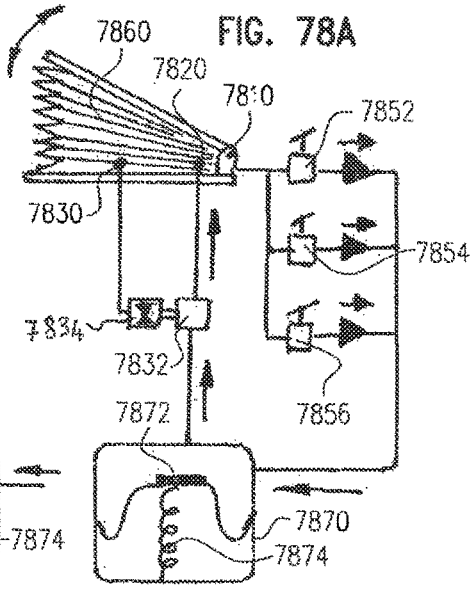
FIG. 78B

SYSTEM AND METHOD FLUID TRANSFER BETWEEN INFLATABLE OBJECTS

FIELD AND BACKGROUND OF THE INVENTION

The invention, the subject matter of this application, is found in the field of safe toys for babies and toddlers in general, and in particular the field of (safe) toys with inflatable elements and the mechanism and system for facilitating fluid transfer to the same. Toys and book pages contain inflatable objects that become three dimensional when filled with air. The surprising inflatable objects present flora and fauna, art objects and geometrical forms and entities in a modular, easily accessible fashion.

Definitions

When the conduit of the immediate invention is a tube, the inner lumen of the tube either has an open state or a closed state. In the closed or occluded state the inner surfaces of the conduit come into contact with each other occluding the passageway of the conduit. For example, when the tube is pinched (e.g. by an external member) or kinked (e.g. by folding the tithe upon itself), the inner surfaces of the tube can into contact with each other in a manner which disallows fluid flow through the occluded portion of the tube.

The terms 'kink', 'kinked', 'kinking' and the like are used herein to refer to the state of a tube which is bent in a manner that causes the inner surfaces of the tube, at the point of the bend, to come into contact with each other in a manner that disallows the flow of fluid beyond the kinked or bent portion of the tube.

An open-state conduit is a conduit that is always open to fluid flow. The open-state conduit may allow bi-directional flow or only unidirectional flow. In the latter case, the open-state conduit usually includes a unidirectional valve.

A variable-state conduit is a conduit that has both open and closed states. An example of a variable-state conduit is a flexible tube discussed above. The tube is either in an open state which allow fluid to flow through the lumen of the tube or in a closed state, as discussed above. In the open state, the tube may be fully or only partially open. The volume of fluid flow admitted through the tube is dictated by the degree to which the tube is flexed. When the tube is non-flexed, then the full volume of fluid can pass through the tube. When the tube is flexed defining a wide angle between a first end and a second end of the tube, then the volume of flow is between high and low. When the ends of the tube define a smaller angle, such as 45° and less, then the volume of fluid flow within the tube is between low and non-existent. Once the tube is flexed to form a kink, the internal surfaces of the tube come together and the fluid flow is disallowed.

A conduit is understood to be a tube, lumen, pathway according to the context.

An inflatable object mentioned herein may be made of stiff material such as, but not limited to polyethylene or flexible material such as balloon rubber and the like.

SUMMARY OF THE INVENTION

One embodiment of the invention includes a safe game for toddlers, made preferably of an inflatable, book that comprises at least one cover and one page in it, wherein to the page there are preferably connected inflatable objects that are filled by air from an air reservoir that is preferably a page located between the cover and the first page with inflatable objects on it. After being filled by air from the reservoir, the inflatable object "stands" erect, and the child can play with, fondle it, push it at will. Pressing on the object passes the air from the first page to the following page, inflating the objects that are connected to the second page and so on. Pressing on the object on the last page or closing the book brings the back cover flush with the front cover, evacuating the air from the last page to the surrounding environment or passed back to the air reservoir page.

Several objects that are spread on the various pages enhance play and can serve as actuators to pass air from objects on one page to objects on following pages, allowing a child to continue playing by advancing along the pages of the inflatable book. Play continues, as the child learns to press on objects and unveil new pages with more objects on them.

Pressing the last object (found on the last page) drives the air from the object back into the air reservoir preparing the system for a new cycle of play.

An inflatable book as cited hereto fore, can accept added properties. For example, replacing the air of the air reservoir or adding to it a gas with a pleasant smell that gives a faint perfumed air to the environment when emptying air from objects as mentioned above.

Additional properties include, by are not limited to electrical actuators that have a power source added. (battery, cell or line source with a transformer to lower the AC voltage); music triggered by the playing child, intentionally or by a lucky chance; a whistle at positioned in air passages, can also increase the experience obtained when playing with the inflatable book which is the subject matter of this patent application.

A further embodiment includes a modular inflatable book wherein the system is a modular system of an inflatable book that enables exchanging of at least one different page on which there are inflatable objects. The exchange is actuated by air or any other suitable materials and sticking Hook and loop fastener strips on two edges of the pages of the book.

When the book comprises more than three pages in series, connected to each other in a cyclic manner, the last object passes residual air to the first object in order to enable a renewed playing cycle without refilling air from external sources.

According to the present invention there is provided a fluid transference system, including: (a) at least two inflatable objects; (b) at least one variable-state fluid transfer conduit, interposed between a first and a second inflatable objects, the variable state conduit configured to allow fluid flow there-through in an open state and to disallow the flow in a closed state.

According to another configuration there is provided a fluid transfer system, including: (a) an entry port; (b) an exit port; (c) a unidirectional main conduit defined between the entry port and. the exit port; (d) an intermediate port; and (e) an intermediate conduit defined between the intermediate port and the main conduit, intersecting the main conduit between a first unidirectional valve and a second unidirectional valve, the main conduit defining a unidirectional fluid flow. According to further features the system further includes (f) a first inflatable object coupled to the intermediate port, the inflatable object configured to receive fluid transferred through the main conduit.

BRIEF DESCRIPTION OF THE DRAWINGS

Exemplary illustrative embodiments of the invention are described below with reference to the accompanying drawings. In the figures, identical structures, elements or parts that appear in more than one figure are generally labeled with a same numeral in all figures in which they appear. Dimensions of components and features shown in the figures are generally chosen for convenience and clarity of presentation and are not necessarily shown to scale. Various embodiments are herein described, by way of example only, wherein:

FIG. 38-9 are views of exemplary embodiments of quick exchange mechanisms;

FIG. 46 is a system wherein the opening is executed by electrical actuators;

FIG. 47 is a side view of an embodiment of the invention in a folded state;

FIG. 48-49 are views of an embodiment of the invention including a tri-dimensional object of standing robot;

FIG. 51A-52B are additional embodiments of the book system of FIG. 50A;

FIG. 53 is a book system with three inflatable objects;

FIG. 53A-55, 57-57G are additional embodiments of book system of FIG. 53;

FIG. 58-61B are further embodiments of the invention;

FIG. 63 is an isometric view of fluid transfer mechanism usable for example in toys;

FIG. 72-78 are various embodiments of play systems employing units of FIG. 68-71.

DESCRIPTION OF THE PREFERRED EMBODIMENTS

Reference is made to FIGS. 1 to 7-AB, which illustrate an inflatable book in various states, constructed and operative in accordance with a preferred embodiment of the present invention.

Purpose of the "system" (namely the inflatable book) is to, preferably, attract babies and toddlers—aged one to two years, to play with it while inflating the object and turning the pages to a next page with different objects in it.

Figure 1:
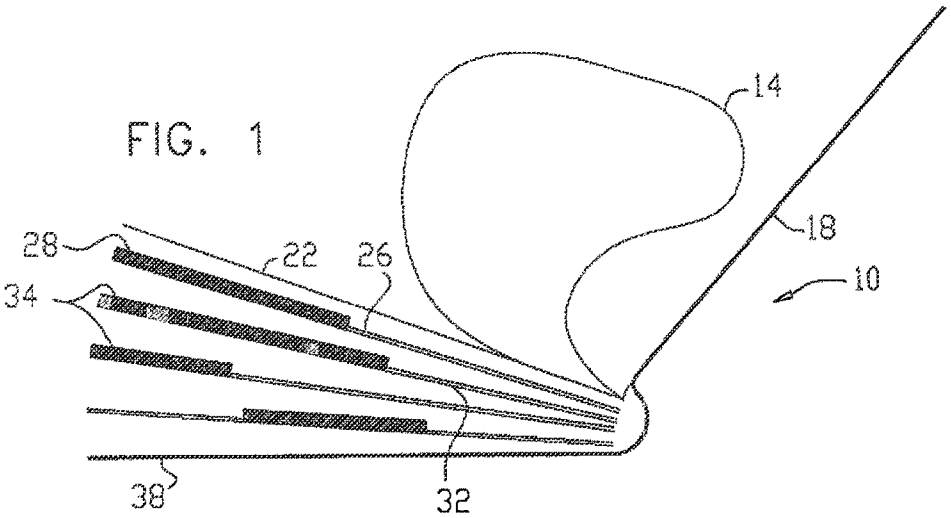
FIG. 1 is an open inflatable book wherein an inflated air reservoir is found between the front cover page and the adjacent page (the first page)

Reference is made to FIG. 1. The figure presents an opened inflatable book 10 after filling air reservoir 14—located between the upper cover component 18 and the air reservoir page 22. A first object 28 is connected to the first page 26. On a second page 32 an object 34 presents another image, as does an object 34 on a third page, and so on with following pages. The book terminates on the other side which is the lower cover component 38.

Figure 2:
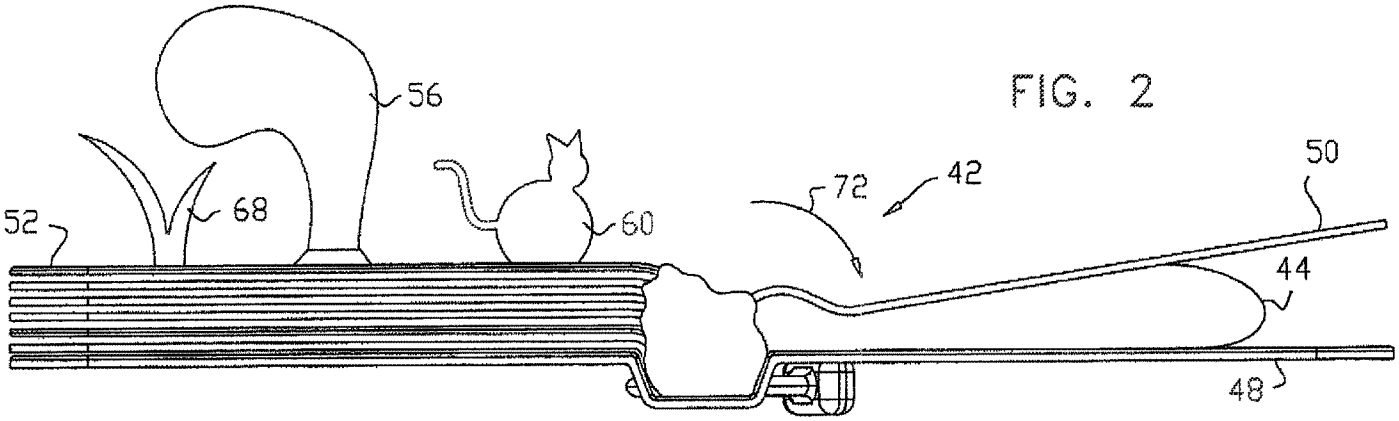
FIG. 2 is a schematic drawing of the inflatable book comprising an air reservoir which has partially inflated a first figurative object on the opposite side of the reservoir.

Reference is made to FIG. 2. This presents a different opened inflatable book 42 after filling an air reservoir 44 (located between a top cover component 48 and an air reservoir cover 50) by using an inflating tube (not seen the Figure but similar to an inflating tube 164 shown in FIG. 9). A first object 56 is connected to a first page 52. Connected to the same page there is a bi-dimensional image 60 and a second bi-dimensional image 68, that are not filled with air. The bi-dimensional images are raised from page 52 when cover 50 is opened. Turning the air reservoir page 50 in the direction of arrow 72 causes air reservoir 44 to be pressed between upper cover component 48 and air reservoir page 50, thereby driving air to flow from air reservoir 44 to first object 56 through a tube (that is not illustrated). More details can be seen in FIGS. 27, 28 and 30.

Figure 3:
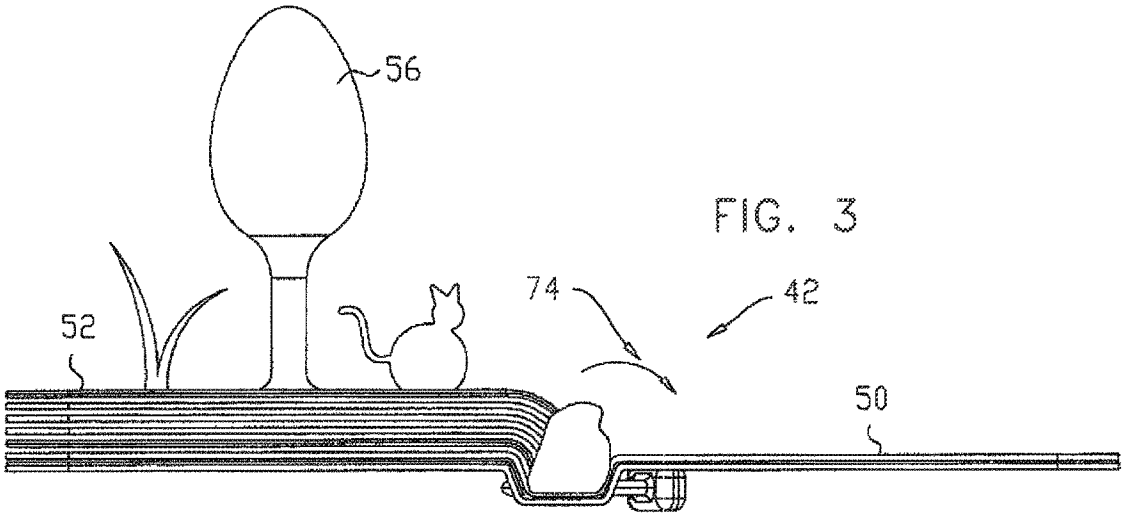
FIG. 3 is an illustrative view of the inflatable book with its air reservoir that completed the inflating run of the object located on the opposite side of the reservoir.

Reference is made to FIG. 3. From the state of the system that is described in FIG. 2, the turning of air reservoir page 50 is continued in the direction of arrow 74, completing the fluid transfer of air or gas between air reservoir 44 and first object 56. First object 56 now presents a tri-dimensional object in a fully inflated state.

Figure 4:
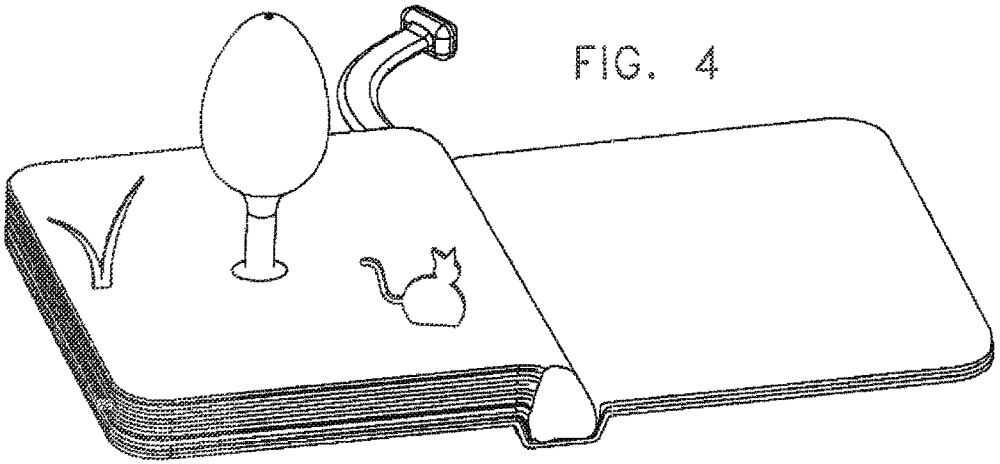
FIG. 4 is an isometric illustration of the inflatable book in the stage defined by FIG. 3.

Reference is made to FIG. 4. The Figure illustrates an isometric view of the inflatable book 42 in the state which is defined in relation to FIG. 3.

Figure 5:
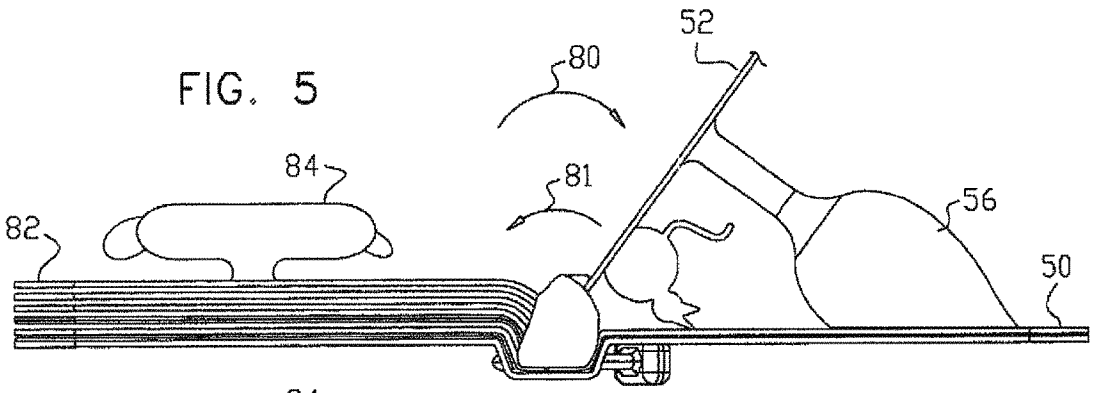
FIG. 5 is a view of the inflatable book after turning the page with the figurative object on the first page in a state of partial deflation where the air pressed out of the first object partially inflates the second object on the opposite side of the page (i.e. the second page)

Reference is made to FIG. 5. This figure shows the inflatable book 42 at the stage in which a second object 84 is being inflated. Second object 84 is connected to a second page 82 and is also connected to a tube (no shown) whose second end is connected to first object 56 and makes fluid transfer in the direction of arrow 81. By turning first page 52 in the direction of arrow 80 first object 56 is forced flush against air reservoir page 50, forcing the air out of first object 56 and into second object 84, partially inflating the second object.

Figure 6:
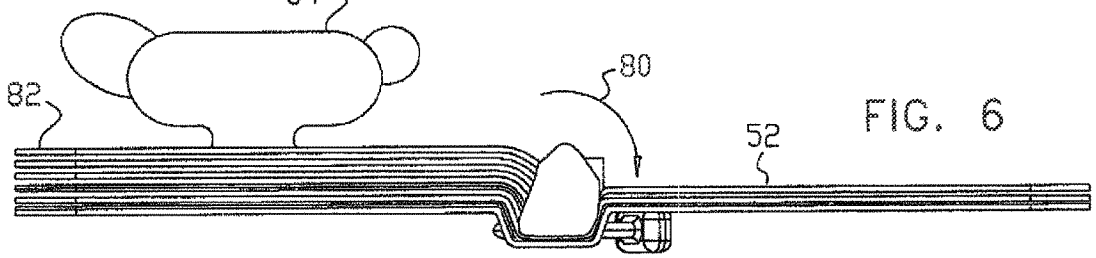
FIG. 6 is a completion to the procedure shown in FIG. 5.

Reference is now made to FIG. 6. Continuing to rotate first page 52 in the direction of arrow 80 causes first object 56 to deflate and thereby complete the fluid transfer of air to second object 84. Second object 84 is caused to become fully inflated by the aforementioned fluid to transfer.

Figure 7B:
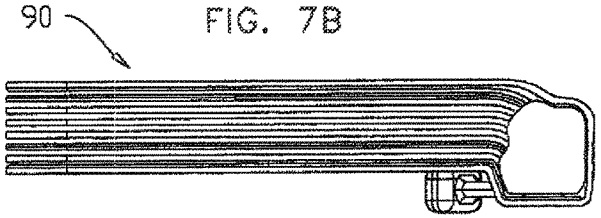
FIG. 7A-B are views of the inflatable book (in closed state) having pages running left to right and right to left.
Figure 7A:
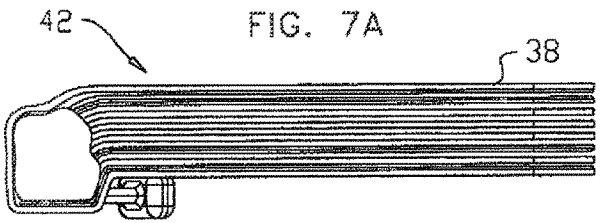

Reference is made to FIG. 7A. Inflated book 42 is presented in its closed state. Turning its pages is done from left to right. This direction is common for books in Hebrew.

After inflating the last object (not seen in the figure) the cycle of fillings is terminated by closing the lower cover part 38. In some embodiments of the invention, a bi-state valve (not seen in the figure) is connected to the last inflatable object in the book (not seen in the figures). The bi-state valve has a first condition, allowing the flow of air from the last object to evacuate to the outside environment (FIG. 7A). The bi-state valve has a second condition, closing off flow of air to the outside environment. The valve opens the flow of air from the last object to the air reservoir 14. The valve enables two modes of operation of the inflatable book.

First Operational Option—

In the first operational option the valve closes the passage of air between the last object the air reservoir 14 and opens the flow to the open (free) environment. The first option is the one which was illustrated in the preceding figures and terminated in FIG. 7A—the air is emptied from the last object (that is not seen in the illustration) that is adjacent to the lower cover part 38 by closing the last cover. This option is characterized by a single cycle that is expressed by inflating the air reservoir 44 and the continuation of the process through inflating objects one after the other, namely passing from one page to the next one until closing the cover part 38 that causes the air to exit from the last object to the free surrounding air.

Second Operational Option—

In the second operational option the valve is open to air passage (flow) from the last object to the air reservoir 14 and closes the passage of air to the surrounding free environment. This option is characterized by enabling the performance of consecutive cycles. The first cycle ends with the last object staying inflated. More details can be seen in FIGS. 27, 28 and 30. Exerting forces between the last page near lower cover 38 (containing the last object) and the lower cover part 38 causes pressure on the last object. The pressure terminates when air from the last object is transferred to the air reservoir, and thus enables a new cycle of the images/objects to be activated (cycle of inflating from one object to the next one. Similar cycles can be performed in the same way—or closing the run by evacuating the air from the last object to the surrounding free air (controlled by the valve). More details can be seen in FIGS. 27, 28 and 30.

Reference is made to FIG. 7B. An inflatable book 90 is presented in its closed state. Turning its pages in this case is done from right to left. This direction is common for books in Latin, English and all other similar languages. All following operations are similar (mutatis mutandis) to those explained for FIG. 7A.

Figure 8:
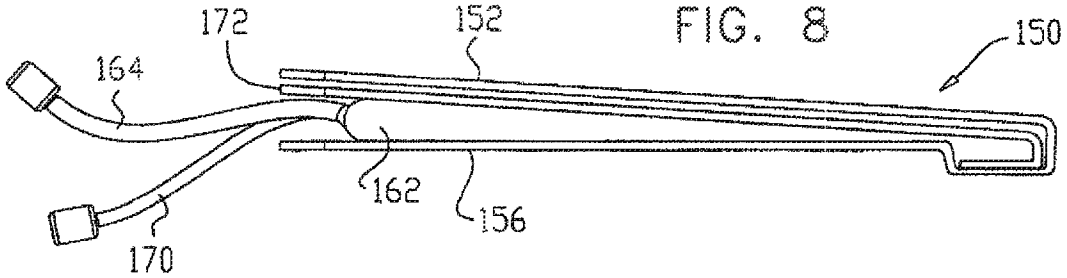
FIG. 8-15 are various stages of actuating air reservoirs and inflating and deflating objects of an embodiment of the immediate invention.

Reference is now made to FIGS. 8 to 15. FIG. 8 presents an illustration of an inflatable book 42 that is made up from two covers—upper cover 152 and lower cover 156, wherein the book is shown in a closed state. Between the covers there are two inflating reservoirs. First inflating reservoir 162 with an inflation tube 164 connected thereto, and a second inflating reservoir 168 (better seen in FIG. 9) with a second inflation tube 170 connected thereto.

A first intermediate page 172 is connected to the upper part of first inflating reservoir 162. Second intermediate page 176 is connected to the upper part of second inflating reservoir 168 which is alongside, the first inflating reservoir 162. Operations of the two inflating reservoirs are independent one from the other and enables activating each one of them with no dependence on the other one.

Figure 9:
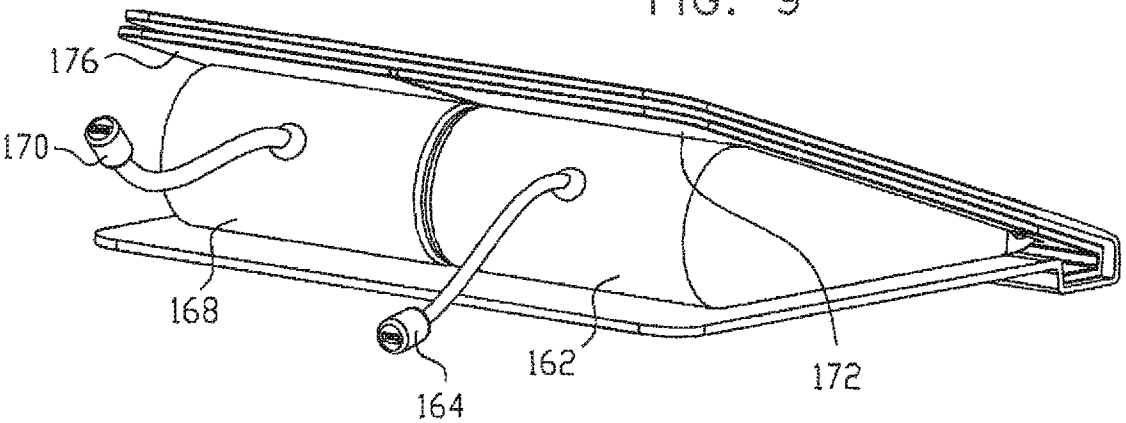

FIG. 9 presents an illustration of inflatable book 150 after reservoirs are filled with air. Reservoir 162 is inflated using inflating tube 164 and second reservoir 168 is inflated using second inflating tube 170. At this stage, the hook is ready to undergo the following stages.

Figure 10:
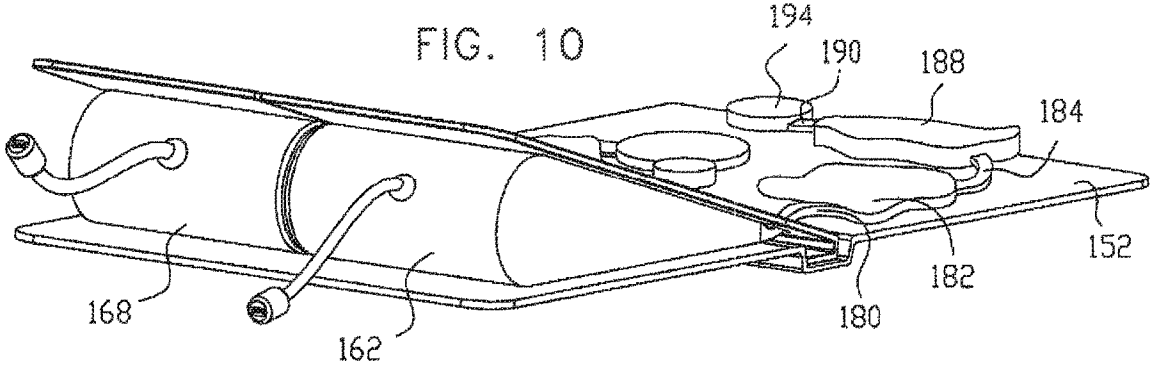

FIG. 10 presents an illustration of the inflatable book 150 with upper cover 152 opened flat, exposing six objects each in a deflated state. A tube 180 connects first inflating reservoir 162 to object 182. A tube 184 connects object 188 to object 182. A tube 190 connects an object 194 to an object 188. Actually, by using those tubes, all three objects 182, 188 and 194 are connected to first inflating reservoir 162.

Between first inflating reservoir 162 and object 182 there is located a unit of non-return valves (not seen in the figure) and the enabled direction of the air flow is from first inflating reservoir 162 to three objects, 182, 188 and 194. In the path of tube 180 from reservoir 162 and after the non-return valve, an emptying valve is installed for the air that is found in the three objects (182,188 and 194) and also for emptying first inflating reservoir 162. The procedure of emptying the air from the system is detailed further below.

A similar arrangement exists for three objects 198, 197 and 199, that are connected by specific piping to second inflating reservoir 168. A second non-return valve and first valve are positioned between reservoir 168 to object 199.

Figure 11:
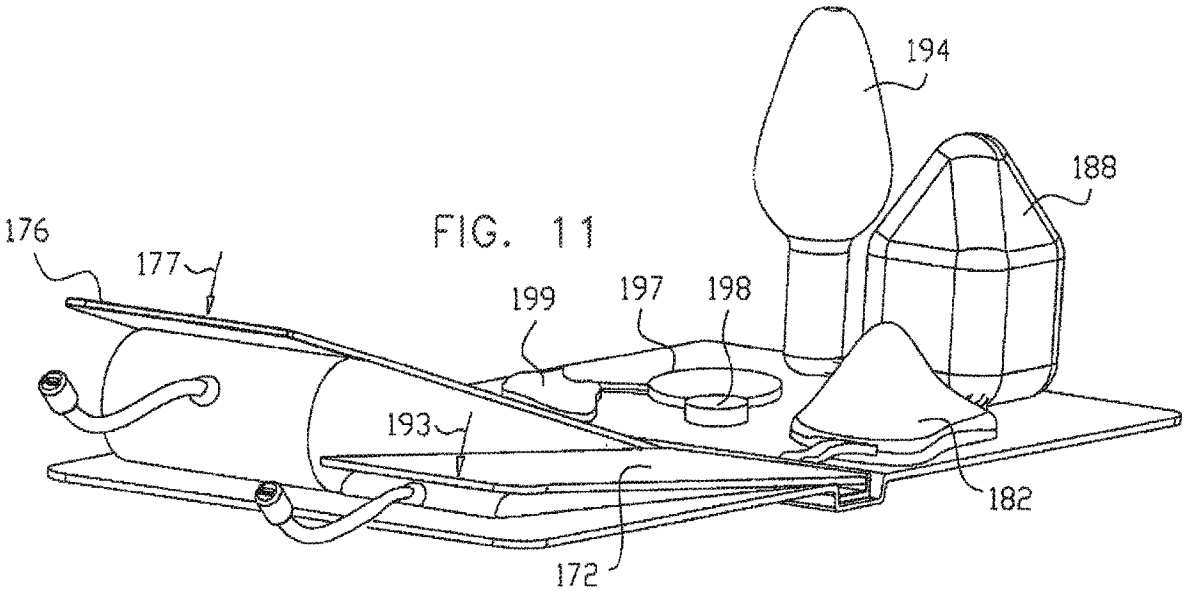
Figure 12:
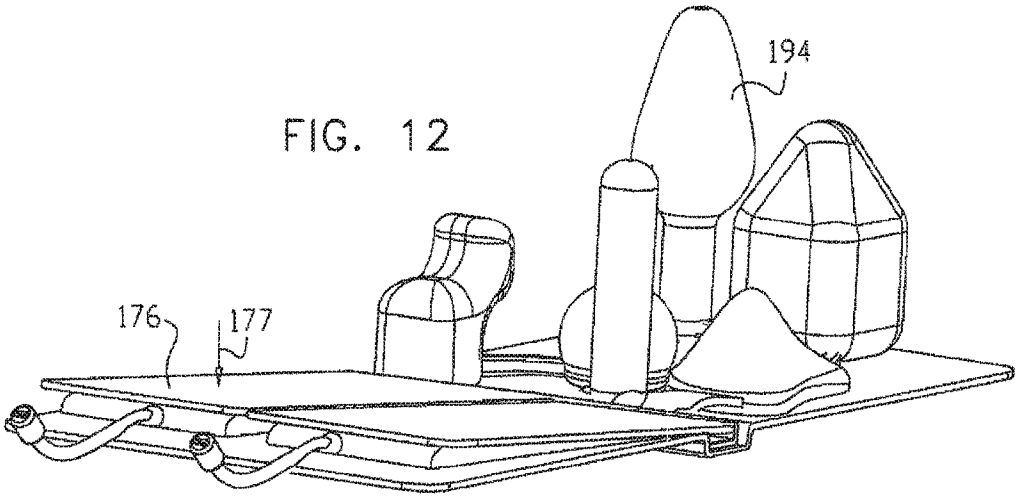

In passing from the condition defined in FIG. 10 to the condition defined in FIG. 11, in a first stage, the three objects 182, 188 and 194 are inflated by the air transferred to them from first inflating reservoir 162. In a second stage force is exerted on first intermediate page 172. Exerting this force transfers the air to objects 182, 188 and 194, and causes their inflation as depicted in the figure. A valve in the non-return valve prevents the flowing of air outwards from them in FIG. 12, a similar arrangement exists for three objects 182, 188 and 194, the inflation of the three objects 198, 199 and 197 would be the same, except that now the pressing would be done on second intermediate page 176 by exerting force in direction of arrow 177. FIG. 12 depicts all six objects in inflated states. The objects remain in inflated condition until the operation of emptying the air from one or both sides is started.

Figure 13:
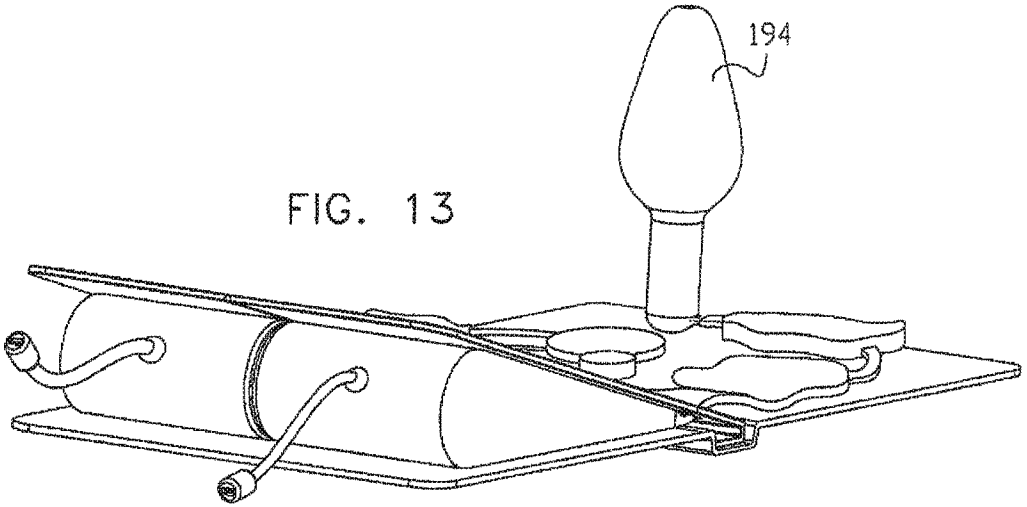
Figure 14:
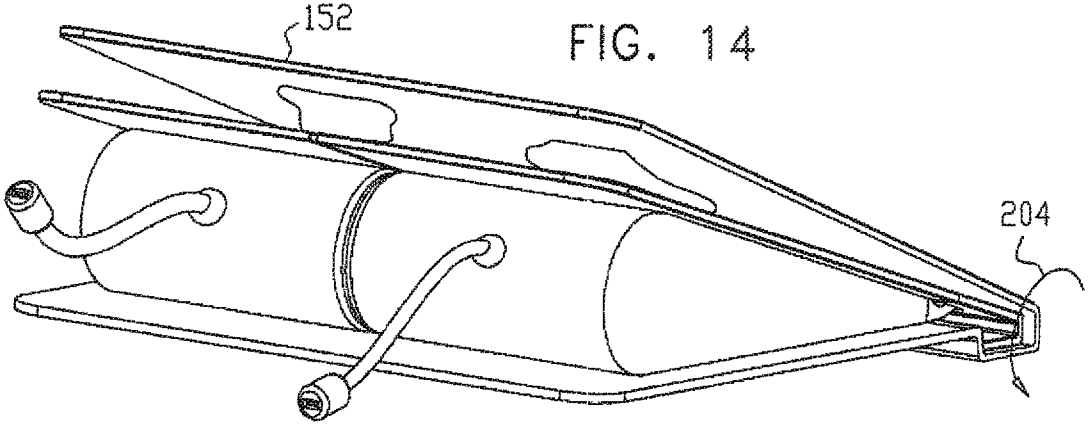
Figure 15:
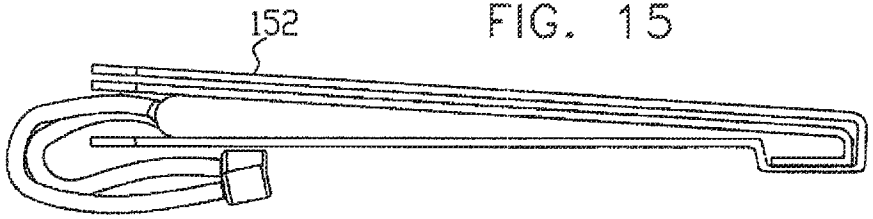

FIGS. 12, 13, 14 and 15 depict a sequence of stages executed taking the objects from the inflated condition (FIG. 12), down to the deflated condition (FIG. 15). Once deflated the cycle can be started anew. In FIG. 12, all the six objects (various images) are inflated objects—numbered 182, 188, 194, 197, 198 and 199. In order to empty all the objects of the air in them through the objects, valves one and two have to be opened (not in figures). In FIG. 13 it is demonstrated that from parts of the objects air was emptied, for example by pressing that the baby (or a mature person) pressed on the objects. In order to complete the emptying job. One turns the upper cover component 152 in the direction of the arrow 204 to tighten it on the lower cover until no air is left in the objects and in the two air reservoirs. From this stage, it is possible to start playing again, as has been explained above, or to store the book.

Figure 16:
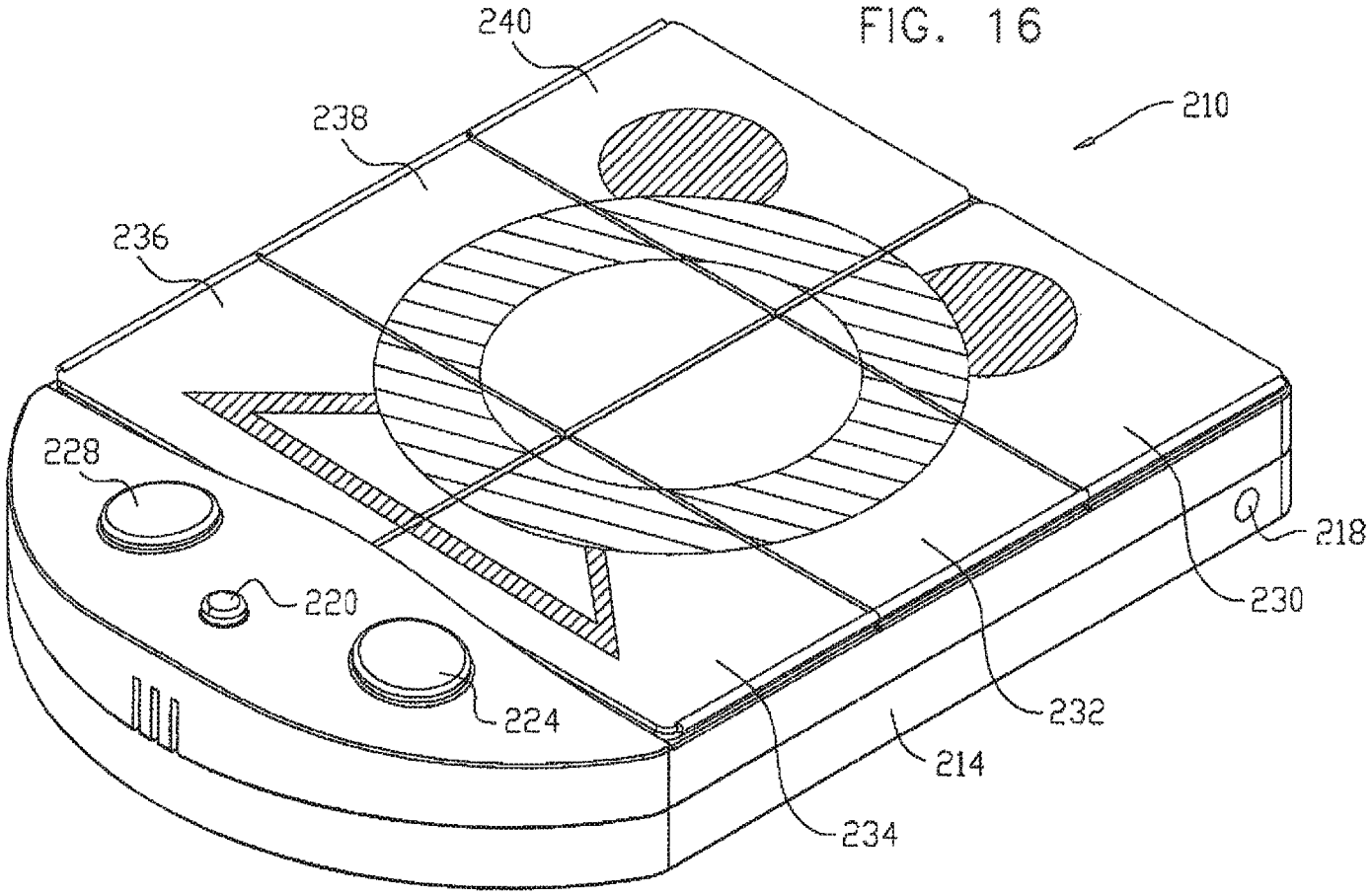
FIG. 16-17 are closed and open views of an electrical embodiment of the invention.
Figure 17:
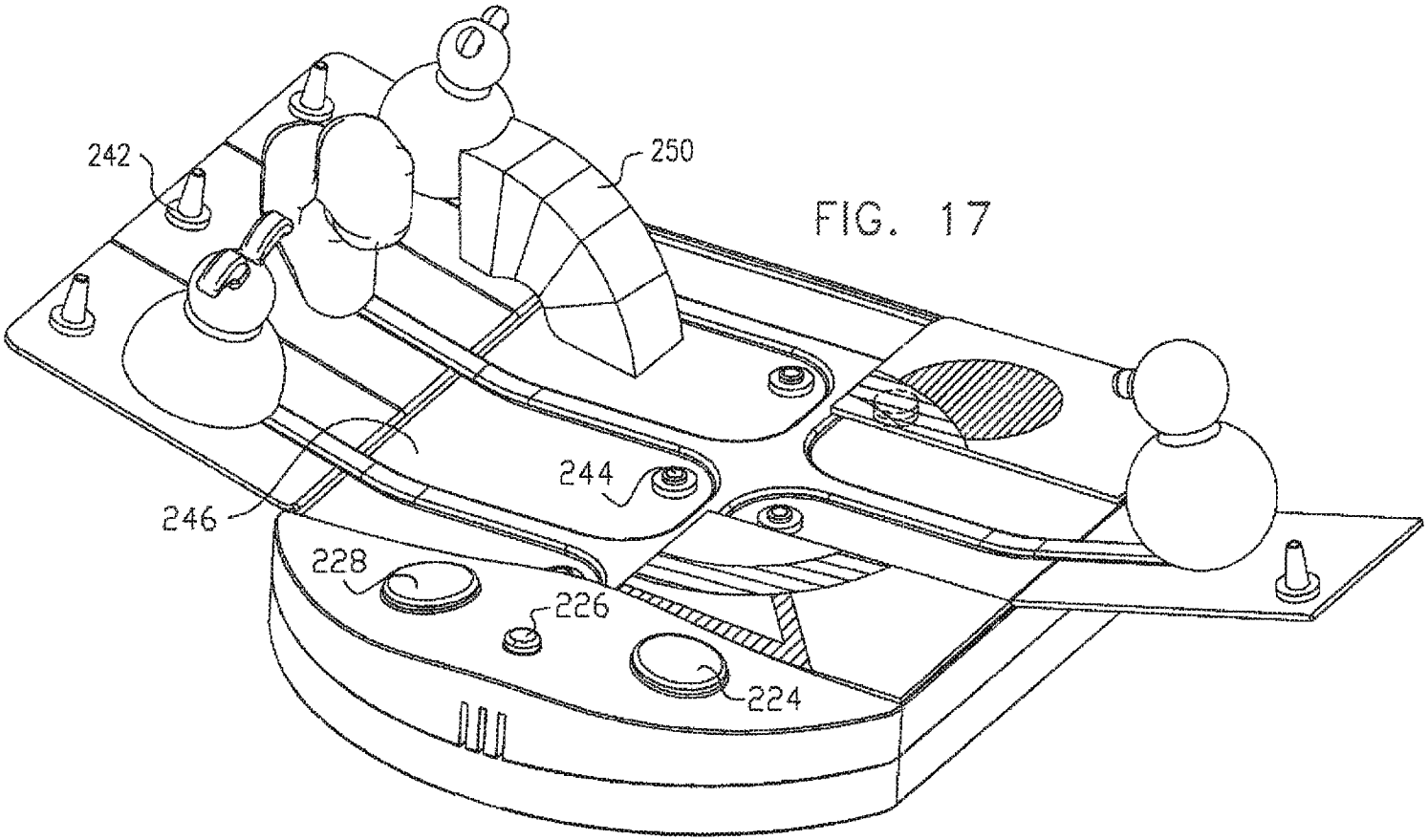

Referring now to FIGS. 16 and 17, a system 210 in depicted in a closed state in FIG. 16 and in a partially open state in FIG. 17, where some of the objects contained within the system are visible through the open covers. System 210 in a compartment 214 that contains, inter alia, an electrical system with a cell, an air compressor activated by an electric motor that is the source for air under pressure that fills air reservoir (not shown in the figure). All the units that are enumerated as contained in compartment 214 are standard items in the industry and are not illustrated in the figure. As a different option for electrical power it is possible to employ an external power supply connected via a power jack 218. A pushbutton 220 actuates and stops the compressor's operation that fills the air reservoir. A pushbutton 224 opens the air flow passage to the objects. A pushbutton 228 opens the air flow passage of the reservoir and the objects to be emptied from the system to the external environment. The depicted exemplary embodiment of the system includes six covers—230, 232, 234, 236, 238 and 240. An exemplary illustration is depicted on the covers. Any picture can be drawn on the covers or part of them.

FIG. 17 depicts system 210 where some of the covers are open and the relevant objects are visible. A closing/opening pushbutton on each cover is made up of two parts, a first pushbutton part 242 is on the cover and a second pushbutton part 244 is on a base 246. The pushbuttons are of a well-known type: pressing the cover for closing and a second time pressing the cover for opening. Part of them can be with a strong closing while others, as for example that of cover 240, has a weak dosing so that the object being inflated pushes the cover to open using to actuator 250. Also other objects can execute the opening. A common operating mode is an electrical operation case with a pushbutton 226 which also causes the filling of the air reservoir. Some of the covers are opened with the electrical opening while others are opened by pressing the covers. For terminating the game, pushbutton 228 is pressed for emptying the air from the system and for dosing the covers, arriving at state of the system presented in FIG. 16. It is also possible to resort to using standard opening springs integrated into the hinges of the covers. In some embodiments of the system a portion of the objects can be just bi-dimensional and not inflatable.

Figure 18:
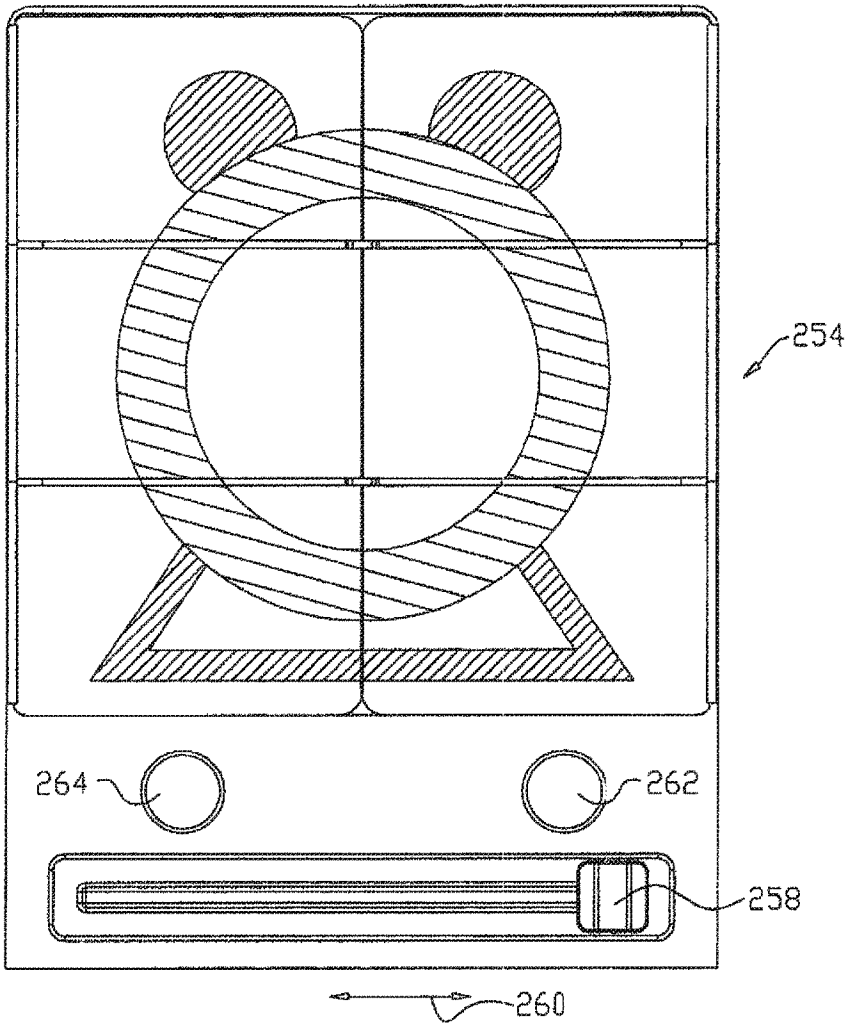
FIG. 18-19 are closed and open views of a mechanically actuated. embodiment of the invention.
Figure 19:
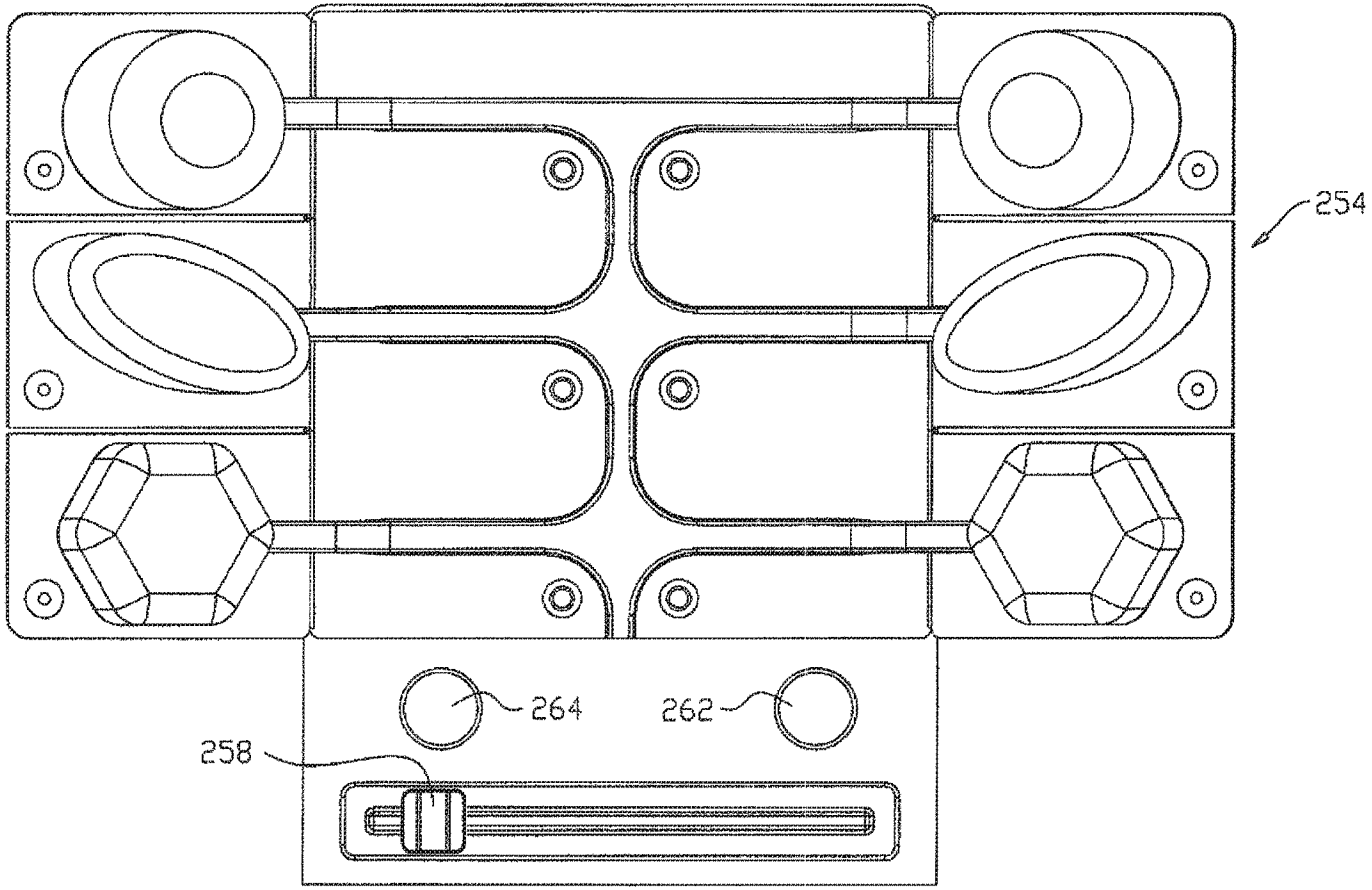

Referring now to FIGS. 18 and 19, a system 254 is depicted in which the air filling to the reservoir is obtained by using a manual pump that is actuated by operating a pushbutton 258 which is moved back and forth—according to the direction of an arrow 260.

Pressing a pushbutton 262 opens airflow to the objects. A portion of the covers can be opened as a result of this activation, while others are opened by pressing on the covers. To terminate play, a pushbutton 264 is pressed for emptying the air from. the system. All other explanations are similar to those presented in FIGS. 16 and 17.

Figure 20:
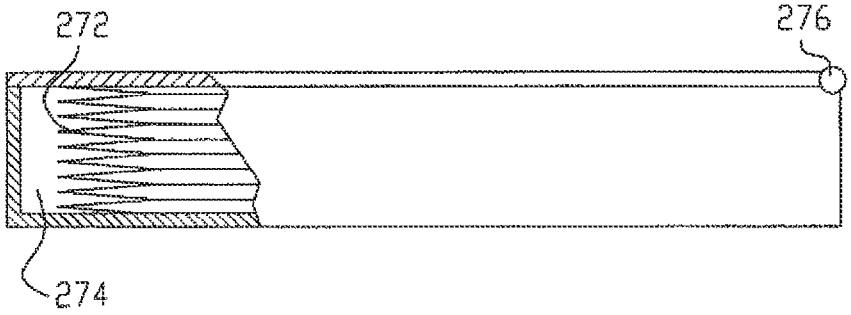
FIG. 20-21 are side views of with a partial cross section of an actuator in closed and opened (partial and maximal) states.
Figure 21:
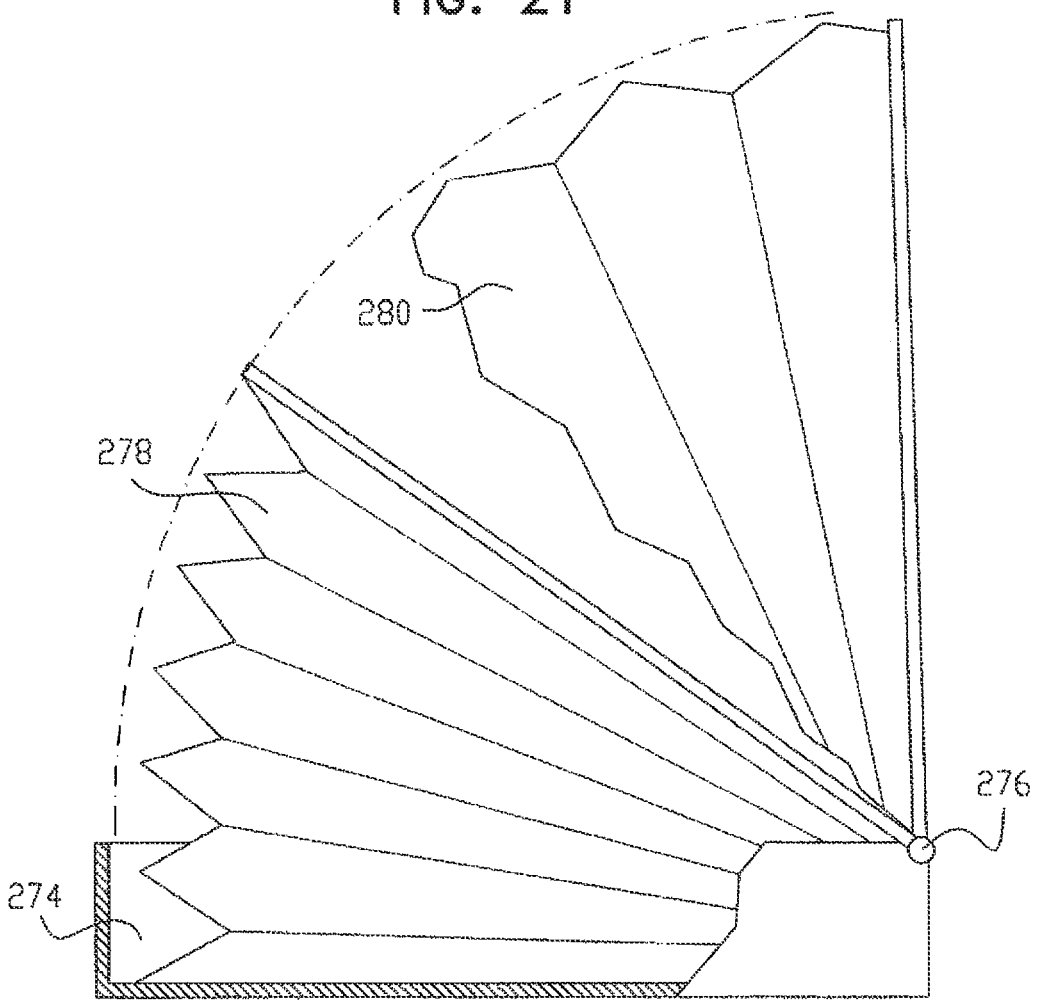
Figure 22:
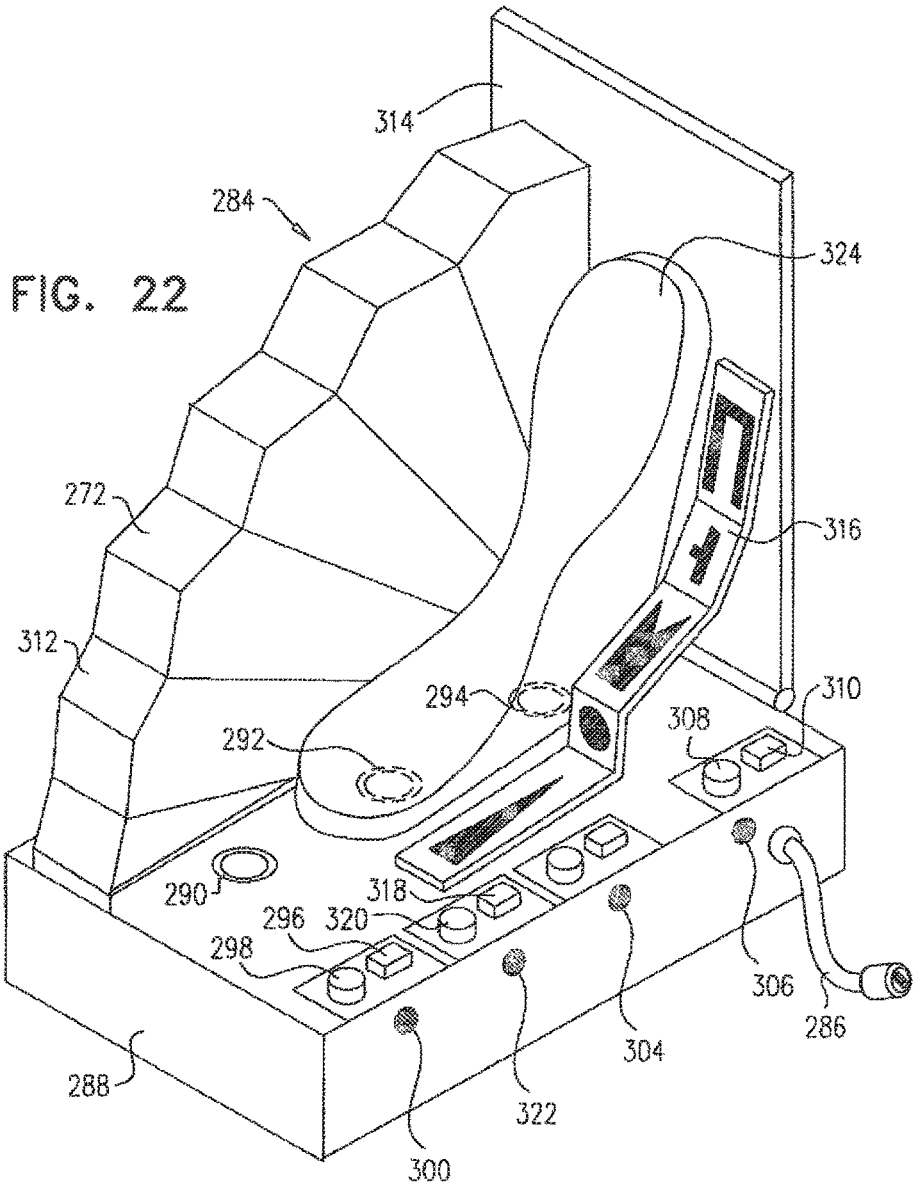
FIG. 22 is a view of an integrated system including various actuators and objects.

Reference is now made to FIGS. 20-22. FIGS. 20 and 21 illustrate a rotating actuator 272 that serves a system such as the system depicted in FIG. 22.

The folded rotating actuator 272 is located within a compartment 274 and rotates around an axis 276 at the time the cover is opened. This rotating actuator is known in technical applications as an actuator to activate moments in drive systems. This actuator is also known as a "beekeeper's bellows" that is used by beekeepers as an aid to spread smoke on the beehives.

FIG. 21 demonstrates the rotating actuator 272 in two states of openings. A partial opening state 278 and a maximal opening state 280. The structure of the system dictates the maximal opening state 280. In our case it is approximately 90 degrees. A characteristic of the rotating actuator is its capability to activate large moments at low pressures subject to the contact area with the body being propelled and the pressure. This property is exploited in various systems of the inflatable book and others.

FIG. 22 illustrates the system 284. Several units that are found in system 284 are known in technical applications will be mentioned without presenting them by figures (for the sake of simplicity of the presentation). Within the system there is mounted an air reservoir (that is not illustrated in the figure). Filling the air achieved through a tube 286. In series to tube 286 a one-way (no return) valve is connected. It enables selecting one flow direction from tube 286 to the air reservoir. Base 288 of the system fulfills several functions as would be explained below. The base has three openings—290, 292 and 294. These openings serve options for filling and to emptying air from objects that would be connected to them. When no object is connected to an opening, it will be closed with a regular stopper. What follows is a description of the activity that occurs due to filling pushbutton 296 and emptying pushbutton 298 whose functions are to fill and empty the air from the object that would be connected to opening 290.

A tube connects opening 290 to emptying with pushbutton 298. Pressing this pushbutton causes emptying the air from the object to the free outside air (that is connected to the same emptying opening 300). Filling air into an object that would be connected to opening 290 is executed by pressing filling pushbutton 296. One side of the filling pushbutton 296 is open to the air reservoir and its other end is connected to a non-return valve whose continuation is connected to opening 290. This non-return valve enables flow solely to opening 290. Pressing filling pushbutton 296 causes filling of the object (that is connected to the same opening). In accordance with this explanation, we have the explanation to the two systems that are on the right of emptying opening 300 and those are emptying opening 322 and 304. Emptying opening 306 and filling pushbutton 310—in accordance with the previous explanation—serves to activate the object that as it happens is the rotates actuator 272.

Rotating actuator 272 that is connected o cover 314 can open the cover 314 around axis 276 that would open the graduated (terraced) object 316. This graduated object represent in several of its possibilities all the books that are being opened with objects (and images) from any kind whatsoever that are opened from their folded state. In a demonstrative fashion it is possible to say that nearly any book from the past that is open with images (bi-dimensional) such as those or others, may have added on it at the time of production or later, an actuator and/or illustrative object that would open it and/or its various pages.

In accordance with the explanation above, figurative objective 324 can function as an actuator even though his basic shape is an image. Activating it in accordance with previous explanations is done through filling pushbutton 318. Emptying pushbutton 320 serves for emptying air through emptying opening 322. Button 296 serves for filling and actuating rotating actuator 272. Button 298 serves for emptying the actuator. Openings 285, 287 and 289 serve for driving air to flow to the objects. An opening that does not serve an object would be covered by a plug (stopper).

Figure 23:
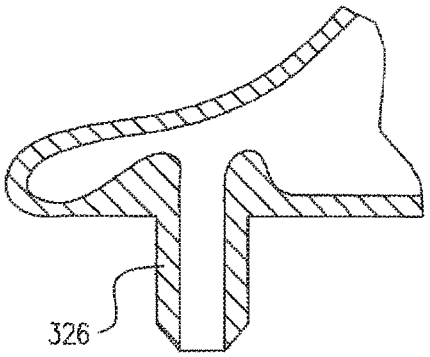
FIG. 23 is a quick connector for filling and emptying air in the object.

Reference is made to FIG. 23, that presents in an illustrative fashion a lower part of figurative object 324 with tube 326 that was entered into opening 292 and that would enable input and output of air from a figurative object 324. A connection of this type, is quick and well sealed.

Referring now to FIGS. 24 to 30 which present a foldable system like an "harmonica" and can be opened into six units that are interconnected between them in a flexible manner so that it can be laid open on a table for activating the system as a toy (performs as a game like in previous cases).

Figure 24:
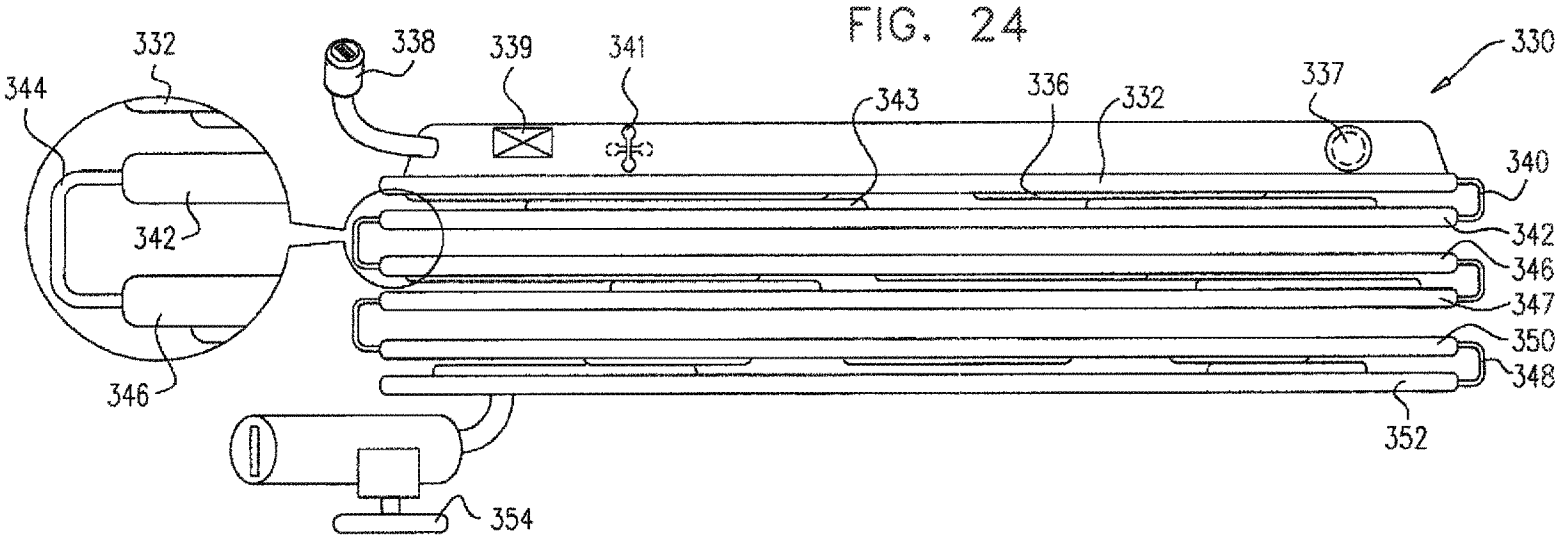
FIG. 24 is a side view of a system with six components in its closed state.

FIG. 24 presents a folded system 330 comprising upper cover page 332 ("the first page") unto which is connected—on its outer side, an air reservoir 334 and on its inner side a first figurative object 336 that is one or more item from the objects on the upper cover page. Filling tube 338 that is connected to the air reservoir serves for filling the air reservoir with a controlled air quantity at low pressure. Supplying external source pressure to the system or to a reservoir in whichever way selected would be at a controlled low pressure in accordance with the safety requirements provided by the manufacturer and in most cases even lower than 0.5 atmospheres. A tubular flexible connector 340 connects upper cover page 332 ("the first page") to the second page 342.

A tubular flexible connector 344 connects the second page 342 to the third page 346, and so on in the same manner up to a tubular flexible connector 348 that connects the fifth page 350 to bottom (lower) cover page 352 ("the sixth page"). Note a valve at the outlet 354 for emptying the air from the system when it is open. This valve can be external as demonstrated or integrated into bottom (lower) cover page 352 ("the sixth page"). Opening 337 enables to connect to a by-passing tube (that would be referred to and explain with FIGS. 27 and 30). When the tube does not connect to this opening, it is closed by a stopper (cork). A bi-state valve 341 enables transferring air from the reservoir to the first figurative object 336 or to block this transfer by its second state.

Figure 25:
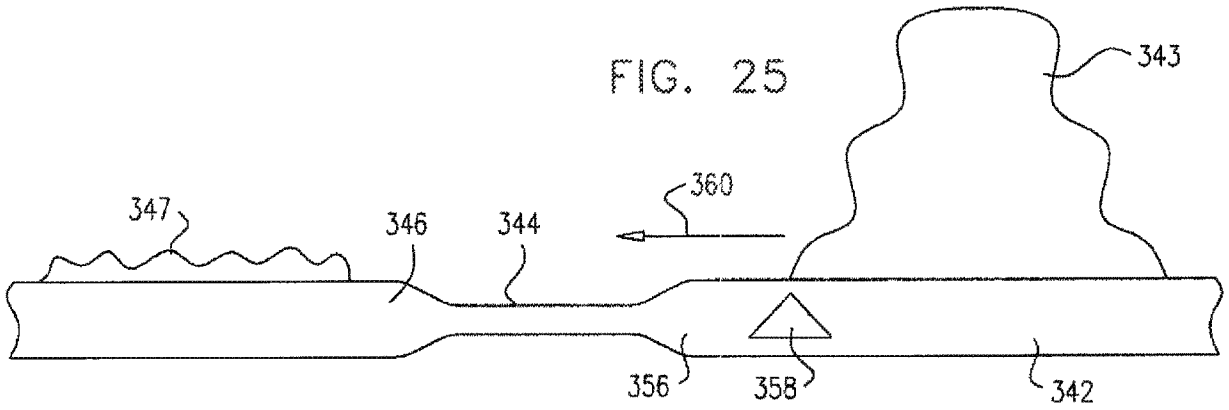
FIG. 25 is a detail of objects during transfer of fluid from one object to another.

FIG. 25 presents a section (part of) passage from the second page 342 to the third page 346 through a tubular flexible connector 344. At the end of opening 356 from the second page 342 a one way (no return) valve is mounted (marked schematically by a triangle) that enables air flow solely in the direction marked by arrow 360 to the third page 346. Flexible tubular connector 344 has a wide flexible structure nearly along the width of the entire page on its one dimension and large enough on its second dimension and this in order to enable quick air passage from one page to the other. All other connectors are built similarly to this connector.

Figure 26:
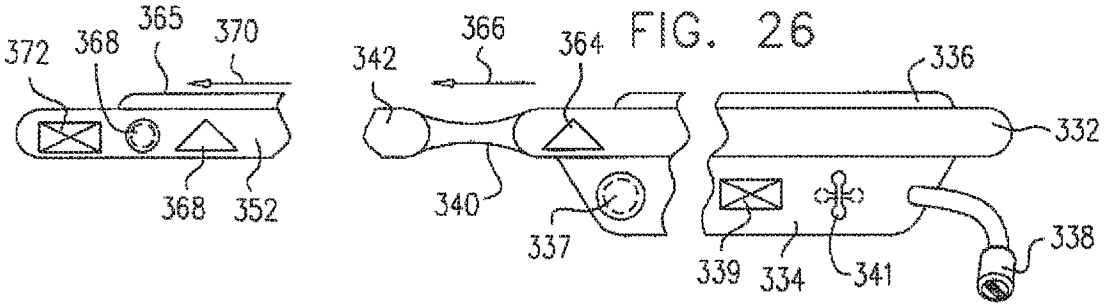
FIG. 26-27 are views of parts of first and last pages of an embodiment of the invention.
Figure 27:
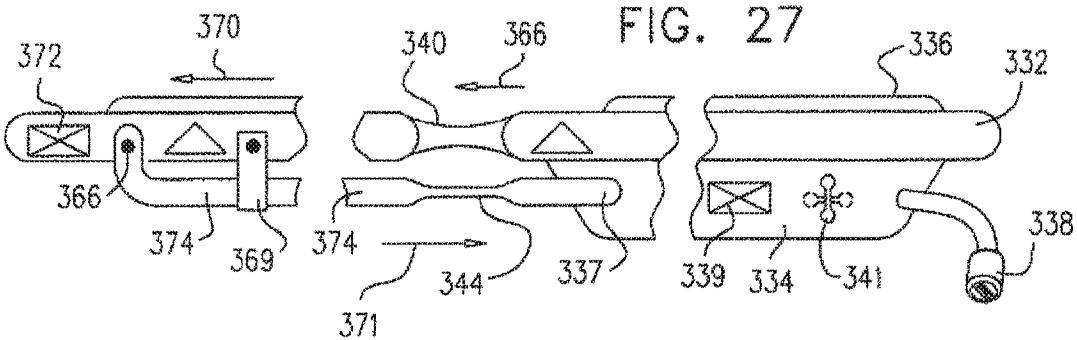

FIGS. 26 and 27 present two different possibilities for operating the system of FIGS. 24 and 25. In general, part of the units that were mentioned when describing system 330 (that is relevant to the present system and also to other systems in the current patent application can be integrated in the various pages or in parts of the covers (top and bottom) or outside of them, connected to the system with tubes or by any other method technically acceptable, whether the connection is semi rigid or flexible.

FIG. 26 is characterized by that that it runs a single game sequence and then it is necessary to refill the air reservoir for the next run. See FIGS. 29A through 29G for further details The two ends of system 330 are represented in FIG. 26, following its opening, the side of the air reservoir 334 (on the right) and the bottom cover page 352 on the left In the passage segment between upper cover page 332 ("the first page") and the second page 342 and still inside the upper cover page there is a non-return valve 364 (marked schematically as a triangle) that enables air flow only in the direction of arrow 366 to the second page 342. Exemplarily, the openings 337 and 368 are closed by plugs (stoppers).

In the state of emptying the system: bi-state valve 341 is open and the first figurative object 336 has the possibility to be emptied from it air, and the emptying valve 339 is open. Non-return valve 364 (marked schematically as a triangle) enables flow only in the direction of arrow 336 to an emptying Valve 372 that is open. Total emptying of the system would be achieved when system 330 is folded to the state shown in FIG. 24.

Figures 29A, 29B, 29C, 29D, 29E, 29F, 29G, 30:
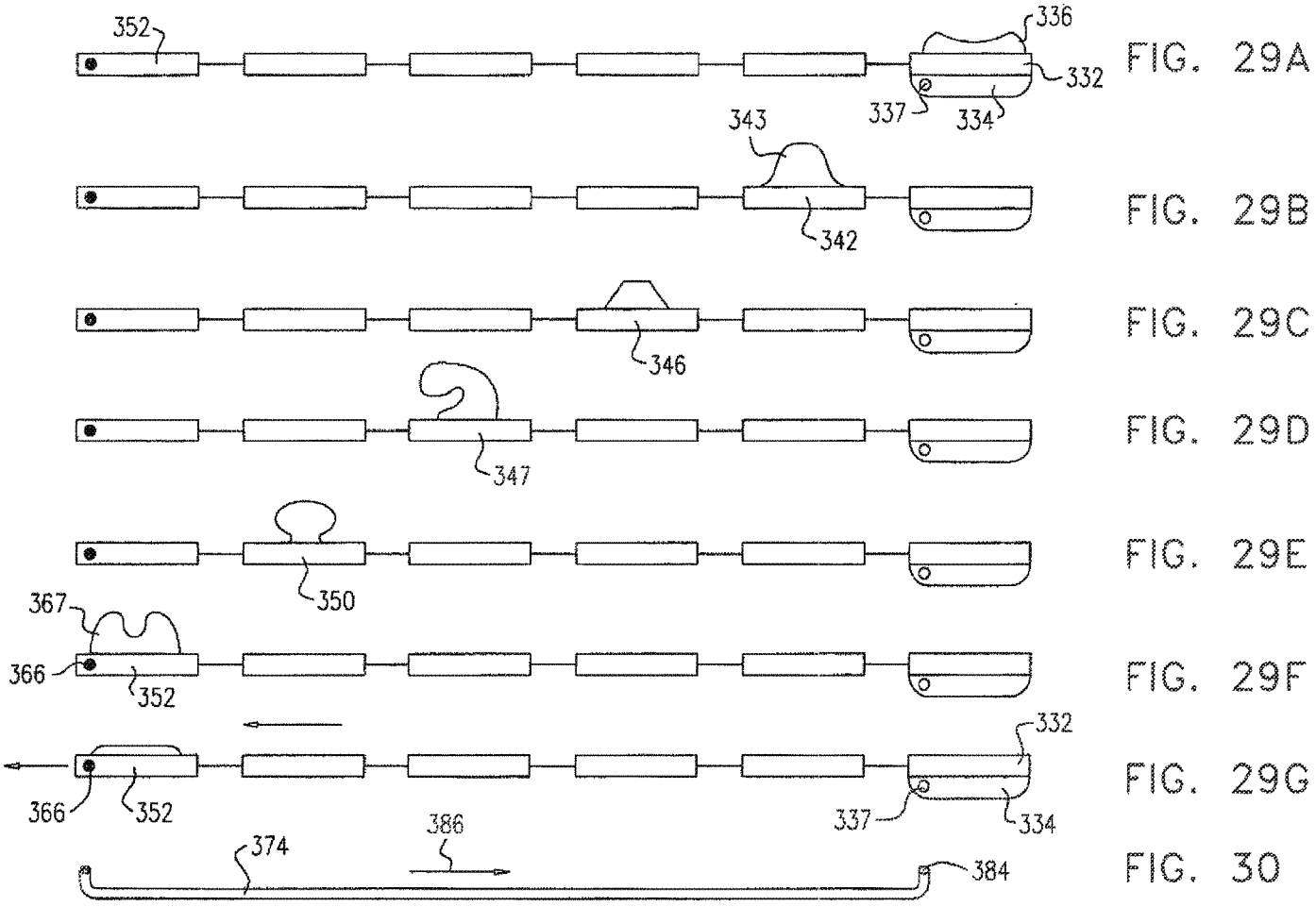
FIG. 29A to 29G are various views of a series of inflations of objects.
FIG. 30 is a view of a bypass tube.

In the state of filling the system: the system is spread as demonstrated in FIG. 29A. The bi-state valve 341 is opened until the first object 336 is completely filled with air and then the valve is closed. Emptying valve 339 is closed. Non-return valve 364 (marked schematically as a triangle) enables flow only in the direction of arrow 366. In this scenario, we produced (by the adult) willingness of the child, to activate the single cycle.

Reference is now made specifically to FIG. 27 that is characterized by that that it enables two consecutive cycles (and more) to be played by the child, nearly without requiring help from the adult and without repeated filling of the air reservoir after each cycle. Help from the adult, if needed, would only be for opening and closing valve 341. Actually the continuity of the playing is challenging and pleasant. In the first stage the system is spread as presented in FIG. 29A. In order to have this system in readiness, all the plugs are removed, and to the openings 368 and 365 tube 374 is connected and strengthened using strengtheners 369. In the tube there are flexible sectors 344 and more that are in proximity overlapping (congruence) to the flexible connectors between the various pages, that one of them is, for example, to the tubular flexible connectors that one of them is, for example, 340, a subterfuge that enables convenient folding of the system. Subject to the volumes of the objects that are to be selected there might arise a need to adjust or to choose such a non-return valve 364 whose breakthrough pressure is larger than that of all the other ones. The child presses on the protruding (figurative) objects and moves from object to object until play is stopped. A detailed explanation is given with reference to FIGS. 29A to 290 where tube 374 described, in FIG. 30 is connected.

Figure 28:
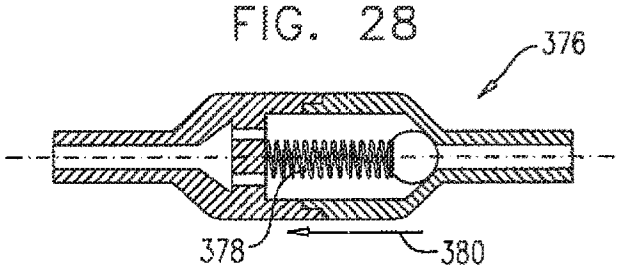
FIG. 28 is an exemplary non return valve.

FIG. 28 describes one of the possibilities of a unidirectional (non-return) valve 376. In the valve the structure and the power loaded in advance to spring 378 determine the breakthrough opening pressure of the valve, flowing in the direction of arrow 380. Non-return valves used in heart transplants, among other application.

FIGS. 29A to 29G present and demonstrate running a complete cycle of recommended play. At the spread state 29A—emptying valve 339 is closed. The air reservoir 334 has been inflated to the desirable pressure through tube 338. Using valve 341 the first illustrative object 336 is filled until it is completely full, and the valve 341 is then closed. System 330 is ready for the child to play. It is generally the nature of (male) children to ruin or to exert force on any tower, turret or any other object protruding in the area around other objects, and it is reasonable to surmise that a child act likewise with the immediate system. When the child presses on first object 336 on the upper cover page 332 ("the first pap") the air passes to the next figurative object that is located on the second page, and so on from page to page until an object found on the sixth page that is bottom cover page 352. At this final stage the emptying valve 372 is opened for evacuating the air from object 367 and from here a new playing cycle starts.

Method A for Building the System:

A feasible building of the game would be one wherein the volume of the first object 336 is larger than that of all the objects after it, and also the second object would be slightly larger than those after it and so on. This method ensures proper inflation of all subsequent objects.

The air in the reservoir 334 suffices for several playing cycles, as explained, based on two law of physics: the first law being kept if the volume of the air reservoir is substantially larger than that of the first object 336, and the second law being kept if the pressure when inflating the reservoir is relatively larger than the inflating pressure of the first object. In physics it is dubbed the law of ideal gases, p*V=Const. Assuming correctly that the temperature is substantially unchanged during the process.

Method B for Building the System:

The volume of the reservoir and its filling pressure are large enough to ensure one activation cycle of the system, and then an adult refills the reservoir to enable the next playing cycle, as the final stage requires opening emptying valve 372 to evacuate the air from object 367 and thereafter it is necessary to start a new cycle of the game.

Method C for Building the System:

Reference is made to FIGS. 29A to 30 that present the former system in accordance with FIG. 29A, the plugs are removed from openings 337 and 366 and a tube 374 is connected to openings 382 and 384 of the tube as demonstrated in FIG. 27. The flow in the tube would be according to the direction of arrow 386. All the process as explained relating to FIGS. 29A to 29G are valid in this case too, except that at the end of the process: pressing object 367 returns most of the air to reservoir 334 and hence a new play cycle can be started without to having to refill the reservoir.

Reference is made to FIGS. 31A to 33 that present a spatial system with two actuators and with inflated objects located in space in different directions.

All the central components in the immediate system have been explained in detail in the previously presented systems. Only new special features are discussed hereafter.

Figure 31A:
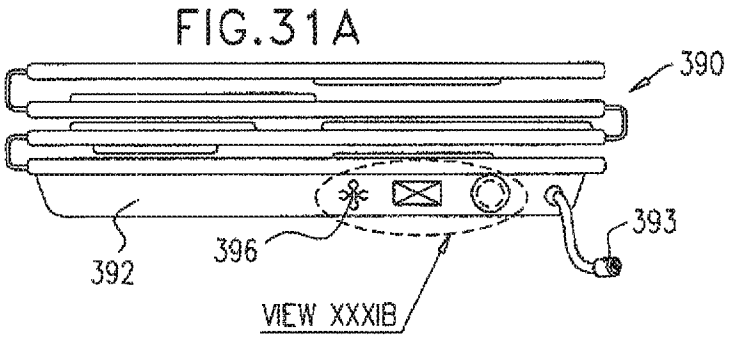
FIG. 31-33 are views of a system with two zones of objects in various states.
Figure 31B:
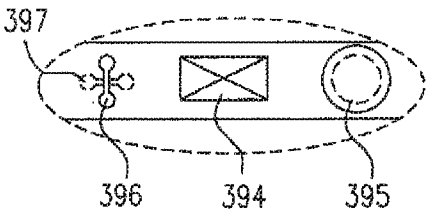

FIGS. 31A and 31B present a spatial system. 390 in a folded state. System 390 has reservoir 392 for tilling air to the system, filling tube, first air emptying valve 394 for emptying air from the system through emptying opening 395. Valve 396 is a bi-state valve that is blocked in its initial state 397, and in its second state 404 opens a passage of air towards all the inflatable objects. This opening is enabled because all the inflatable objects are connected in series for flow of air from the first one to the last one through all the inflatable objects.

Figure 32:
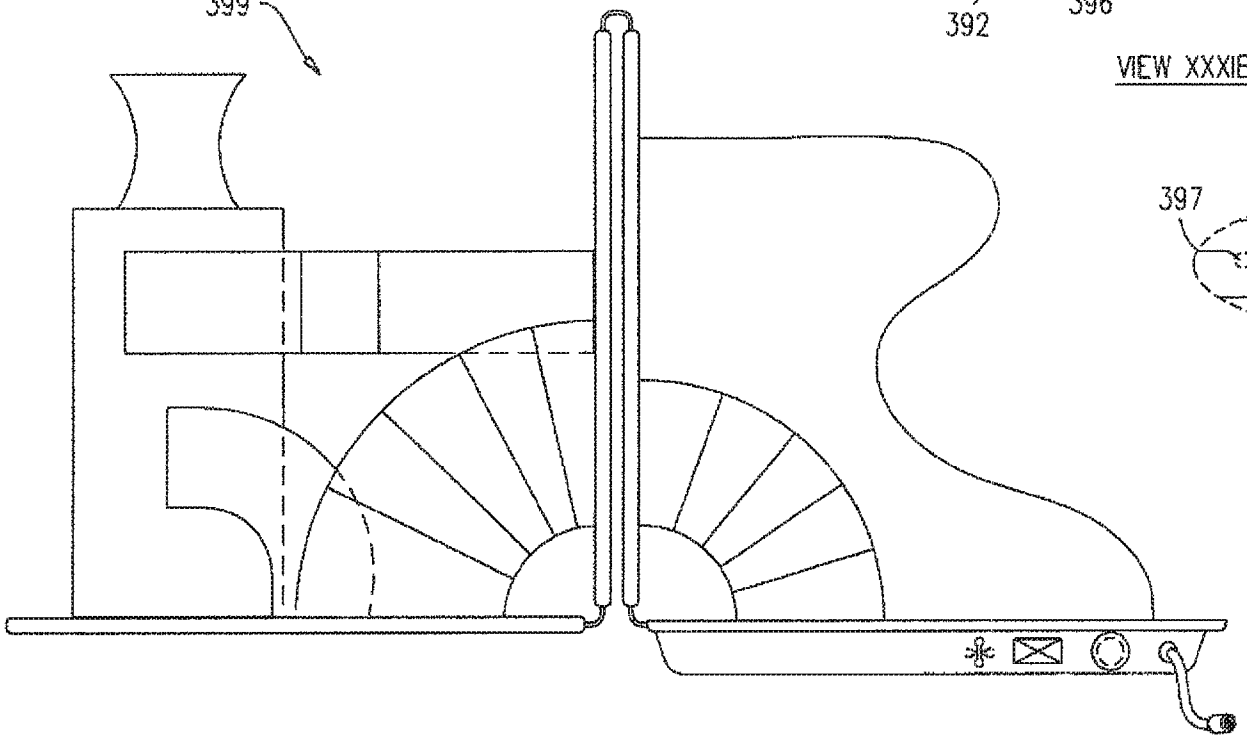

FIG. 32 depicts a front view of system 390 in its folded state. The stages of actuating the system from the folded state are as follows: emptying valve 394 for air from the reservoir is closed. Valve 396 is brought to its first state 397 that is the blocked state. Air is compressed into reservoir 392 through tube 374. The execution of the activation is performed by transferring valve 396 to its second state that causes flow of air to all the inflatable objects and by this to open the spatial system to a spatially open state.

Figure 33:
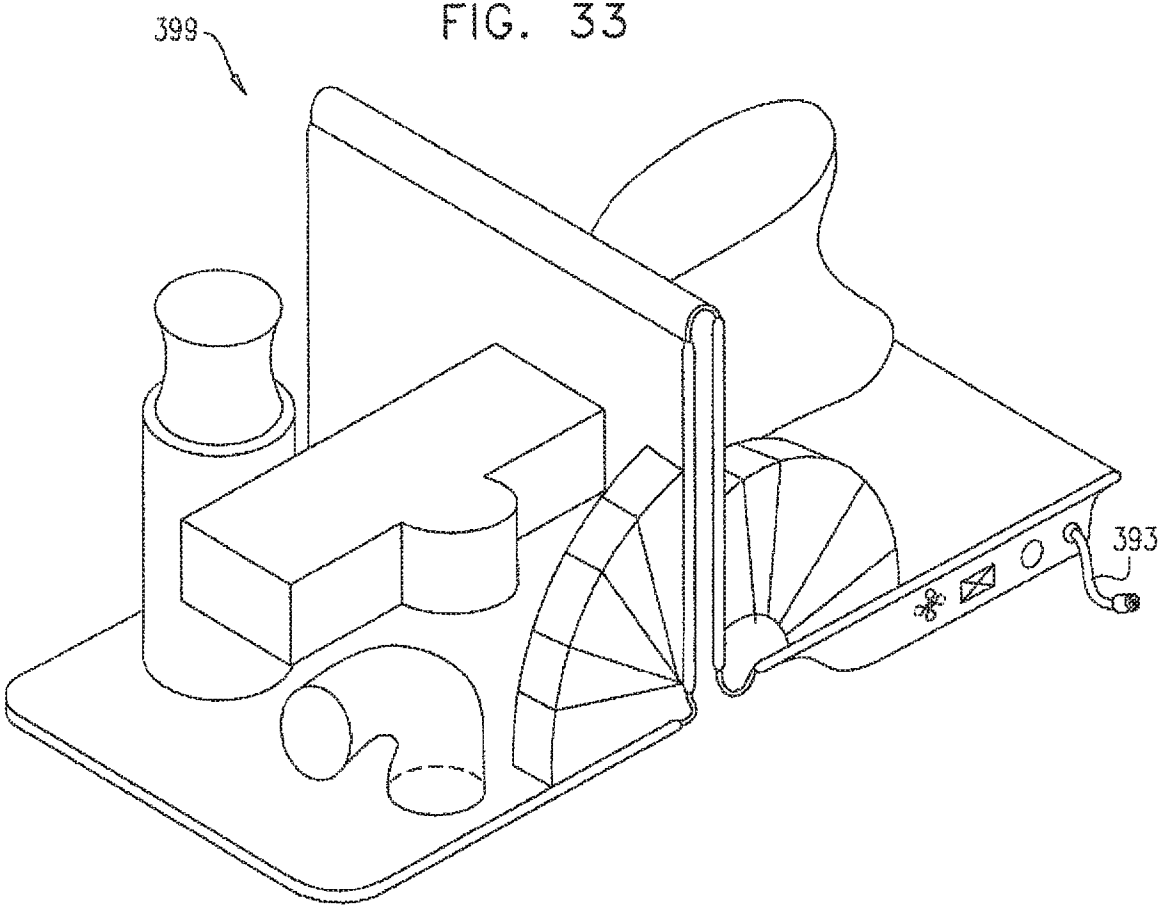

An additional activating possibility without refilling with air is as follows: The system is brought to the folded state in accordance with FIG. 31A. The air returns to reservoir 392. Valve 396 is closed and the system is ready for a next actuation that would start by opening valve 396. It is possible to actuate in this manner several repeated times, so that the child would enjoy experiencing this. In order to facilitate the opening act for the child it is possible to form valve 396 in a large and prominent structure so that it would be clear to the child that there the actuation is executed. For final folding for storing the system, valve 396 is brought to its opened second state. For Emptying air from the system valve 396 is opened. The system is then folded which drives the air out when it is folded. FIG. 33 depicts an isometric view of system 390 in its open state 399. This figure expresses the wide spatiality of the system in its open state 399.

Figure 34B:
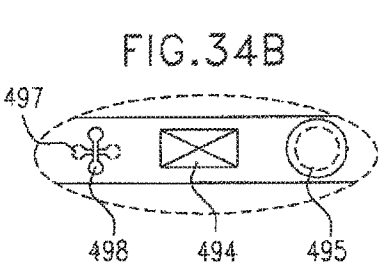
FIG. 34-36 are views of various embodiments of inflating systems with tri-dimensional objects on bi-dimensional pages in closed and opened states.
Figure 34A:
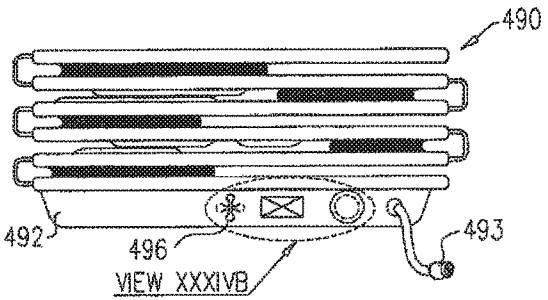
Figure 35:
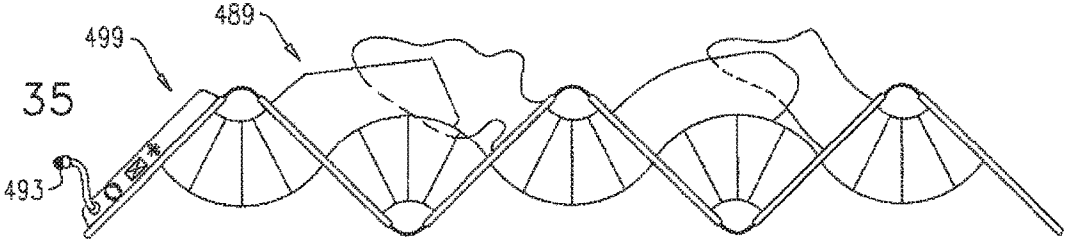

Reference is made to FIGS. 34A to 35 that present a spatial system with five actuators and inflated objects spatially located facing different directions.

The objects are located on one side of system 489. All the components constituting this system were explained in detail in previous systems, and especially with FIGS. 31A to 32. Only special items that are unique to the current system and operational mode are discussed hereafter.

FIGS. 34A and 34B present the spatial system 490 wherein it is in its folded state. System 490 has a reservoir 492 for filling air to the system, air filling tube 493, air emptying valve 494 from the reservoir through emptying opening 495. Valve 496 is a bi-state item, in its first state 497 it is blocked and in the second state 498 it opens the passage to all the inflatable objects. This opening is enabled because all the inflatable objects are connected in series to air flow from the first object to the last through all the inflatable objects.

FIG. 35 illustrates a front view of the system in its folded state. The stages of actuating the system from its folded state are: emptying valve 494 of the air from the reservoir is closed. Valve 496 is brought to its first state that is the blocked state. Air is compressed into reservoir 492 using tube 493. Execution of the actuation done by switching valve 496 to its second state 498 that causes air flow to all the inflatable objects causing the system to transform to the spatially open state.

An additional activating possibility without filling with air is in accordance with the following procedure: The system is closed to its folded state, in accordance with FIG. 34A, the air returns to the reservoir 492. Valve 496 is closed in its position 497. The system is ready for the next actuation that would start with opening valve 496 in its position 498. It is possible to actuate in this manner several repeated times, so that the child would enjoy experiencing this. In order to facilitate the opening act for the child it is possible to form valve 496 in a large and prominent structure so that it would be clear to the child that there the actuation is executed. For final folding for storing the system, valve 496 is brought to its opened second state 497 for emptying air from the system.

Figure 36:
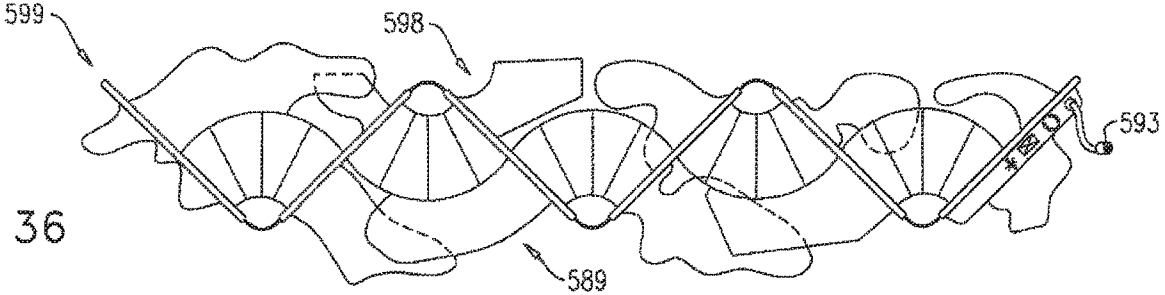

FIG. 36 presents a spatial system with five actuators and inflated objects spatially located, facing different directions. Some objects are located on one side of system 589 and other objects are located on the other side 598 of the system. All the components constituting this system have been discussed in detail with reference previous systems, and especially systems depicted in FIGS. 34A to 35. Special items that are unique to the current system are discussed hereafter whereas the operational mode is identical to that of the spatial system 490 depicted in FIG. 34A. The immediate system includes many objects, such that rotating the game system causes the child to view objects which appear to be constantly changing. Another game that can be played with this system that is flexible versus the actuators, and hence it is possible to "abuse" the system, fold it like a banana and other crooked objects.

Figure 38:
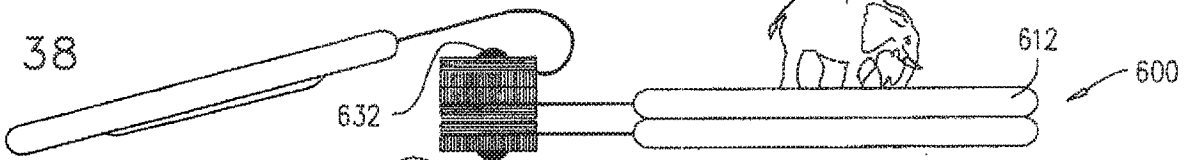
Figure 39:
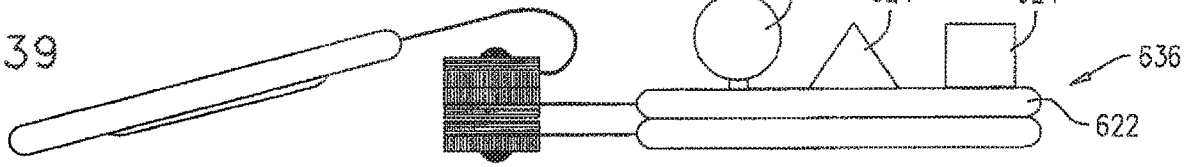

Reference is made to FIGS. 38 and 39 that present system 600 that is a modular system of an inflatable book that enables to exchange at least one page on which there is at least one inflatable object that would be fed by air from the system itself or from an external source.

Figure 37A:
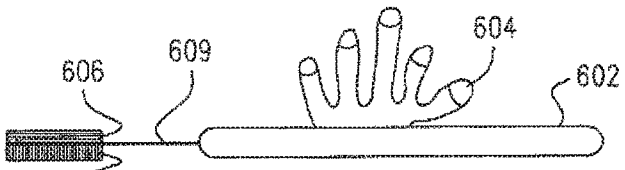
FIG. 37A-C are views of exemplary pages with quick connection capabilities.
Figure 37B:
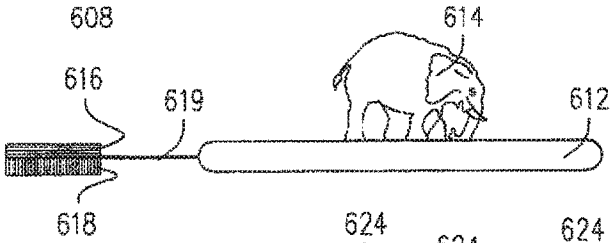

Reference is made to FIG. 37A-39. FIG. 37A presents a page 602 to which a figurative object 604 which resembles a human hand is depicted. Unto the page, on its one side, to an upper strip of Hook and loop fastener band 606 is attached at its upper part, and a bottom Hook and loop fastener strip 608 on its lower part. Additional details on this zone are presented in FIG. 40. A tubular flexible connector 609 connects the Hook and loop fastener's zone to the page 602. FIG. 37B presents a page that is explained as FIG. 37A depicting an elephant.

Figure 37C:
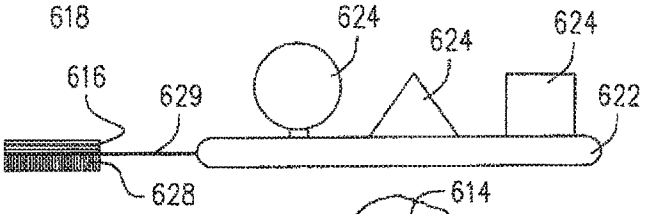

FIG. 37C presents a page 622 unto which inflatable objects 624 that are similar to geometric entities are attached. To this page on its one side an upper part Hook and loop fastener band 616 is attached and a bottom part Hook and loop fastener strip 628 is attached at its lower (bottom) part. Additional details on this zone can be seen in FIG. 40. A tubular flexible connector 609 connects the Hook and loop fastener's zone to the page 622. A tubular flexible connector 629 connects the Hook and loop fastener's zone to page 622.

FIG. 39 that presents a system 636 that is a modular system of an inflatable book in which page 612 was replaced by page 622. The subject of the page has been changed from fauna to geometric images. As a commercial possibility, it is feasible to sell a first book and later on sell kits with isolated with subjects that would be changed to match the age of the child and his interests.

Figure 40:
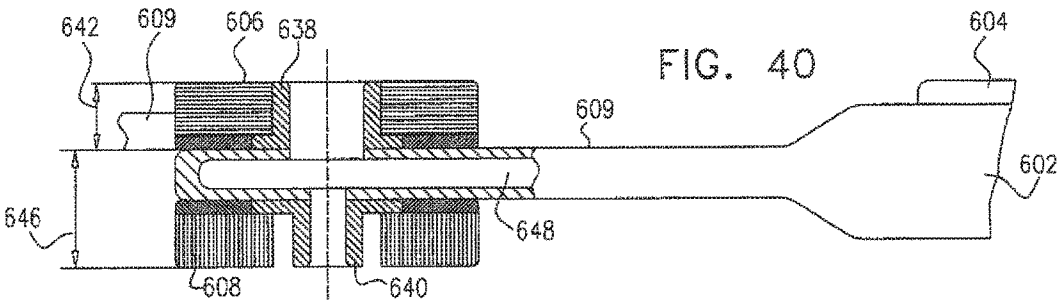
FIG. 40-41 are schematic diagrams of various quick connection embodiments of the invention.

Reference is made to FIG. 40 that presents part of page 602 to which an inflatable object 604 similar a palm is connected. The figure focuses on the left part of the page, which enable to connect and disconnect pages to/from the system. A "female" opening 638 is connected to a tubular flexible connector 609. A "male" 640 intermediate is also connected to a tubular flexible connector 609.

Inside the tubular flexible connector 609 with passage to air 648 that connects the Hook and loop fastener to the page 602 there is located the tubular part that transfer air from the "female" opening 638 and the intermediate "male" unit 640 (continuation of page 602) and from there to an inflatable object 604. The part 642 is presenting the part that is connected to the cover of the book 644 through a flexible tubular connector 609. The part 646 is a part of the page which is replaced.

Delivering air to the various openings can be done thorough an assortment of possibilities. Some of them, in principle, were presented in previous systems in this patent application. Below we present in detail one possibility that provides an easy solution to exchanging pages without having to deal with related piping and other hindrances. Simply, the "male" passage unit 640 is inserted into "female" opening 650. Plug 632 closes "female" of the end page (in this case—page 602). Plug 634 with a different structure would close the opening to lower end page (that are not illustrated). In order to obtain simple and convenient sealing, "inserting" and "extracting" the pages that are being exchanged, one possibility is to produce the "female" opening 638 from flexible rubber and the intermediate "male" passage unit 640 using rigid plastic material for good sealing.

Figure 41:
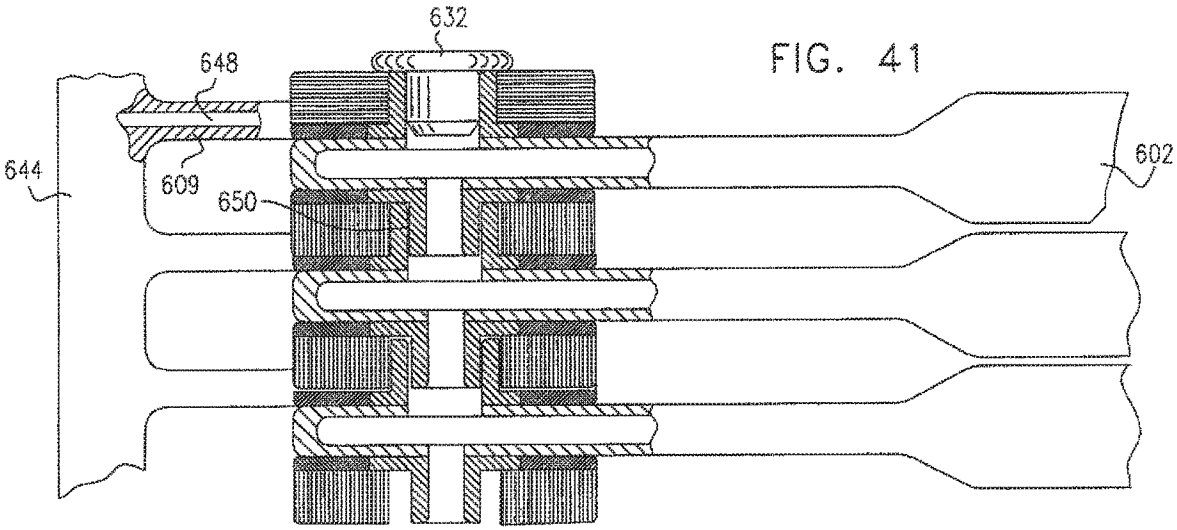

Reference is made to FIG. 41 that presents a zone of the book cover 644 that is a part of the modular system of the inflatable book 652 unto which three exchangeable pages are connected.

Figure 43:
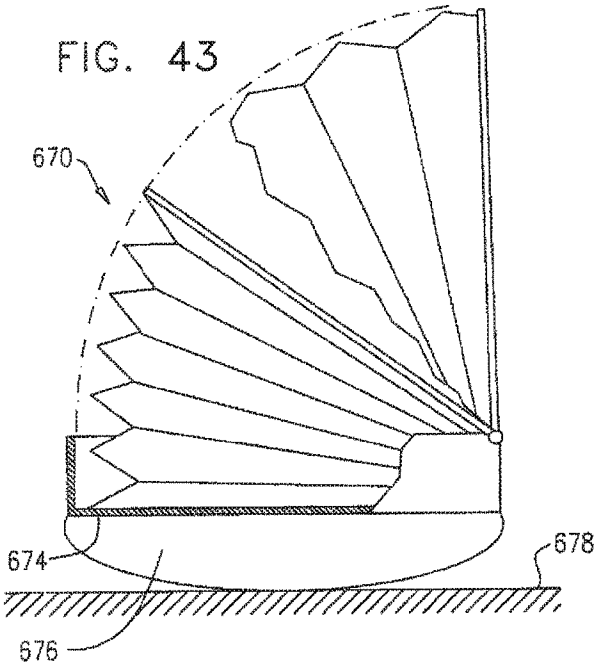
FIG. 42-43 are views of embodiments of the invention in various states.
Figure 42:
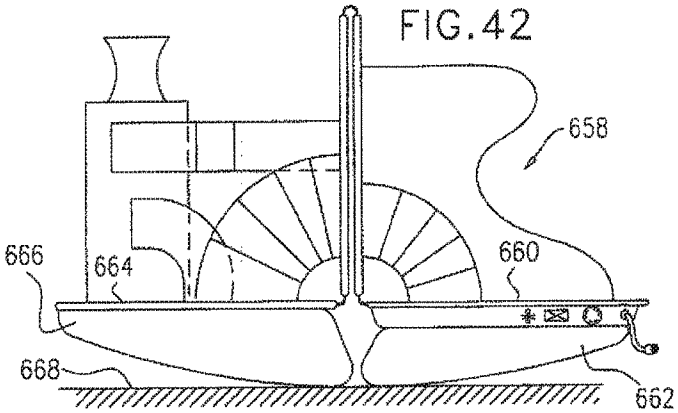

Reference is made to FIGS. 42 and 43 that relate to several different possibilities to systems wherein when exerting force on them (and removing it) they would swing while they are positioned on a flat plane. Some of the systems—when they are open and some of them also when they are folded. It is possible to convert the majority of the systems introduced in this patent application, to systems with this swinging property.

Reference is made to FIG. 42 that for the sake of demonstration adds the swinging property to the system defined in FIG. 32. This explanation refers essentially to system 658 wherein it is opened. A first inflatable element 662 is connected to the air reservoir 660. Unto upper cover page 664 a second inflatable element 666 is connected. The two elements together create a body whose contact area with the plane 668 is at its bottom and near to its center. A characteristic of the two combined inflatable elements when they are inflated is that they form a body that is essentially convex and has the capability to swing around its state of equilibrium. Actually we created a swinging book that adds dynamics and interest for the playing child.

Reference is made to FIG. 43, that for the sake of demonstration adds the swinging property to the system defined in FIGS. 21 and 22. This explanation refers essentially to system 670 wherein it is opened. Inflatable element 676 is connected to the bottom. of system 674. The inflatable element creates a body whose its contact zone with the plane 678 is at its bottom and near to its center. It is a characteristic of the inflatable element when it is inflated that it is essentially convex and has the capability to swing around its state of equilibrium. Amongst other possibilities of creating a convex contact surface it is feasible to form a surface that is rigid, that is made of, for example, metal, and a flexible one made of rubber, sponge and other such materials.

Figure 45:
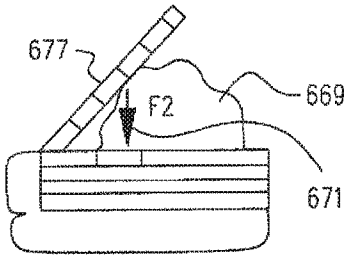
FIG. 44-45 are views of an embodiment of the invention with selectable pages.
Figure 44:
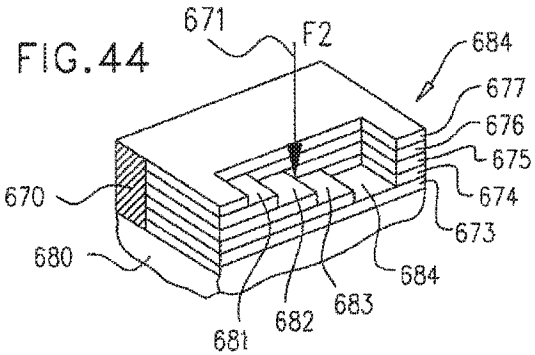

Reference is made to FIGS. 44 and 45, that present inflatable book 684. The prominent feature included in inflatable book 684 that in this book (in contradistinction to all previous variants of the presented books heretofore) in this case it is easily feasible to select at will the figurative object that would be inflated and presented just by pressing the finger on the respective figure number one of the four possibilities as written on the depressions 681, 682, 683 or 685 (same convenience as opening the selected letter in a dictionary with the A-to-Z letters offered on scalable niches. As it is demonstrated in the figure by openings 682 force F2 is exerted (marked by pointer 671) through niche 682 on which there is the figurative object 669 that is meant to be opened. Air reservoir 686 is connected to the lower cover through rear element 670. Air reservoir 686 is also connected to the first page 673 as one unit. Pages 674, 675, 676 and 677 are the pages that are opened in accordance with their mode of activation. Figurative object 669 that the player wants to open is shown in FIG. 45.

After opening, it is possible to close the pages that were turned around with the page that was opened an act that would return the air to the air reservoir and enable to actuate the system anew. The details that clarify the specific details of the system are to be found in the texts of the various options when explaining other and different systems in this current patent application.

Reference is made to FIG. 46 which shows a system 690, wherein the actuators that open the pages are electrical actuators. It is possible to manufacture such a system by integrating electrical actuators (at least one) and openers at least one actuator that is air operated, subject to the technological approach. In many systems discussed, above, it is feasible to replace actuators driven by flow of air by electrical actuators. In such a system, a battery, a cell or a line source will be added to the original system. Explanations covering these systems are similar to those presented and cited above, and it would be superfluous to repeat them here. Opening page 698 relative to page 696 is done by electrical actuator 692. Opening page 702 relative to page 700 is done by electrical actuator 694. As an option the actuators can be pneumatic, and/or electrical and/or hydraulic if water or the same is added to the system or a combination thereof. Adapting this kind of opening as one of the simple possibilities, is similar to the activating (opening and closing) of electrical "gates" located in parking areas (private or public). In another and different building possibility, it is feasible to add to the system all kinds of computerized control and performance.

Reference is made to FIGS. 47, 48 and 49. FIG. 47 shows the system 706 which is presented in its folded state in FIGS. 48 and 49. FIGS. 47, 48 and 49 present a system 706 which displays a Robot in spatial opening when actuated. Part or all of the components of the Robot are combined with inflatable objects or others that are not inflatable. There exists a lot of free space for figures and text that were exploited for it on the Robot and are not displayed in the figures. Part of the inflatable objects are displayed on the first side 708 as inflatable objects 722, 724 and front head 709 and on the second side 710, as for example completing the front part of "the front of head 709 " of the robot as a completing part 712 of the general shape.

In the book displayed in FIGS. 48 and 49, wherein in it the actuators 716, 718, 720 and 726 are actuators working with air that open respectively pages 717, 719, 721 and hands 727 as a first choice (the one presented in the figure). Hands 713 are shown in the folded position. A second possibility is to merge actuators where all of them are electrical actuators and a third possibility is an integration of both kinds. When actuating would be as such that part of the actuators would be electrical, then in this case there will be added a power source (battery, cell or line source with a transformer) in addition to existing systems.

In a building possibility wherein there is at least one electrical actuator, it is possible to add to the system computerization and control with operating that would enable additional operational functions, for example different speeds of opening and closing the hands of the robot (hands 713 folded to the body), possibility to time the movements of the hands to other conditions between the bands, possibility of swinging movements of the head of the robot. The actuators 716, 718 and 720 are air operated in the presented example. We shall add details to FIG. 47, that presents the folded state of system 706: Base reservoir 722 is the basis of the system and as a possibility—the air reservoir. Upper part of cover 725 close the system 706. A flexible transition passage between pages enables to drive air according to the specific requirements. A connection 730 between the upper cover to the Robot is a simple connection.

Any professional in this field would understand that use of filling inflatable objects with air or safe, light gases can be executed by other methods and materials, commensurate with those listed above, would be ruled by the same principles and provide the same functioning and processes with results as presented in this patent application.

Turning pages, moving air from page to page and so on, constitute a full pledged method and approach to produce the innovative systems with the offered games. The processes of turning the pages and having a selection of figurative objects, gives an interesting and satisfying set of games/Toys to toddlers.

Opening and or routing new pages, flow of air or gases described above solely in a way of presenting examples, and there is nothing in this to revoke equivalent alterations nor implement variants in design, that would not render the device to deviate from the method and systems embodied in the invention which is the subject matter of this application, and which is defined in the claims that follow. In other words, it is feasible to implement the invention as it was described above while referring to the accompanying figures, also with introducing changes and additions that would not depart from the constructional and operational steps, characteristics of the invention, characteristics that are claimed herein under in the claims chapter.

In all processes that were defined there might be objects from a variety of objects. Some might be actuators. Others might be objects of images that themselves can be actuators and in a single page, mixtures of various types of object can appear together. In many systems discussed above it is feasible to replace actuators driven by flow of air by electrical actuators. In such a system, a battery, a cell or a line source will be added to the original system. As an option the actuators can be pneumatic, and/or electrical and/or hydraulic if water or the same is added to the system or a combination thereof.

Figure 50A:
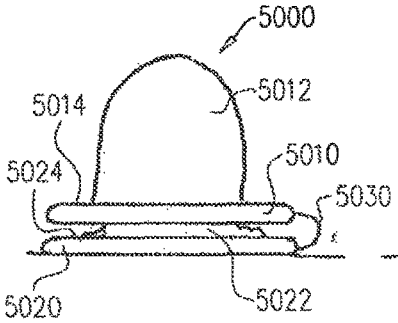
FIG. 50A-50F are states of fluid transfer book system of the immediate invention.
Figure 50B:
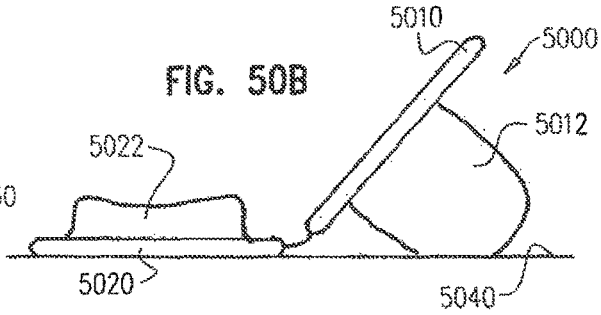

Another possible configuration is shown in FIGS. 50A-F. FIGS. 50A-F depict an exemplary embodiment of the immediate invention in the form of a play hook system 5000 for children, in various stages of use. Book 5000 is a book system which allows fluid to flow from one inflatable object to a second, adjacent, inflatable object. Play book 5000 includes a first page 5010 and a second page 5020. The pages are coupled together via a coupling 5030. First page 5010 includes an inflatable object 5012 mounted on a front face 5014 of first page 5010. Second page 5020 includes an inflatable object 5022 mounted on a front face 5024 of second page 5020. FIG. 50A depicts a stage wherein object 5012 is inflated and first page 5010 is resting on top of second page 5020, sandwiching object 5022 therebetween. FIG. 50B depicts a stage wherein first page 5010 is flipped off second page 5020 so that object 5012 comes into contact with a surface 5040, causing the object to partially deflate. As a result of object 5012 deflating, now uncovered object 5022 begins to be inflated with the fluid substance (e.g. air) that has exited object 5012.

Figure 50C:
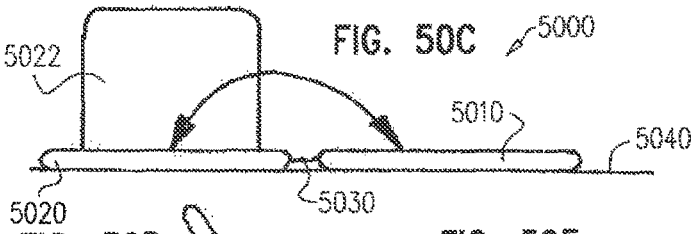

FIG. 50C depicts a stage wherein first page 5010 lies substantially flat on surface 5040 with object 5012 completely deflated and object 5022 completely inflated from the transferred fluid. FIGS. 50A to 50C depict the sequence of stages corresponding to the turning of a page so as to advance through the content of book 5000. The angle defined between the two pages is referred to as a completely open angle.

Figure 50D:
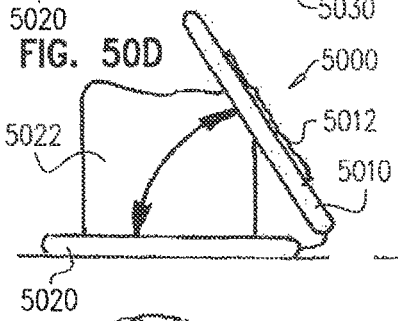
Figure 50E:
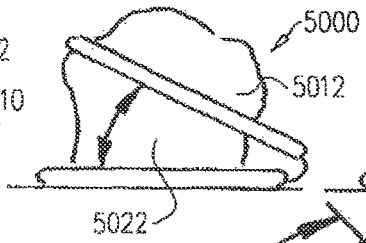
Figure 50F:
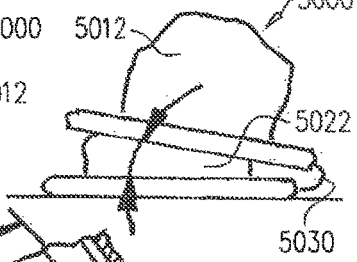

Conversely, FIGS. 50D to 50F depict a sequence of stages corresponding to the turning of a page in a direction opposite to the flow of the content of book 5000. FIG. 50D depicts a stage wherein first page 5010 and second page 5020 define an angle between 45° and 90° therebetween and where a back face 5016 comes into contact with object 5022, causing the object to deflate slightly. This angle is referred to as a large angle. As a result of object 5022 deflating, fluid is transferred to object 5012, inflating the object in a corresponding manner. FIG. 50E depicts a stage wherein the angle defined by first page 5010 and second page 5020 is 45° or less and wherein object 5012 is inflated in a manner which is proportionate to the deflation of object 5022. That is to say that the more first page 5010 causes object 5022 to deflate, the more object 5012 becomes inflated. This is a midrange angled opening. FIG. 50F depicts a further progression of the aforementioned sequence where the pages define a small angle between them. The given degrees are merely illustrative and only intended to approximate and exemplary. In no way are the given degrees intended to be limiting to the current or following embodiments discussed hereafter.

Coupling 5030 is a variable-state conduit, which is at least partially flexible, and which allows the flow of fluid when in an open state and disallows the flow of fluid in a closed, or occluded, state. The angle defined between the two adjacent pages defines the volume of fluid flow within the conduit.

Play book system 5000 includes an inflation valve (not shown) for initially inflating one of the inflatable objects of the book system. The inflation valve is open for inflation and closed during play/use. The system can be inflated with a fluid such as liquid or gas, but generally air, to a volume less than the combined potential volume of the two inflatable objects. When one object is inflated and the system is sealed from the outside atmosphere, the fluid can be transferred from one object to the other, via various transference means discussed below. In use, the volume of fluid inserted into the system is substantially equal to the smallest object in the system. Fluid transfer in the book system is bidirectional and dependent on the state of the transference means (i.e. conduit) which is defined by the angle of the opening between the two pages. The direction of transference of the fluid is based on external pressure, or the resistance to such pressure, effects on the book system, or parts thereof. Fluid is evacuated from the system via an evacuation valve (not shown) which may be the same valve as the inflation valve or a different one. To effect complete evacuation of the fluid, it may be necessary to turn the pages back and forth.

FIGS. 51A-51D depict a sequence of stages, parallel to the sequence of stages depicts in FIGS. 50C-50F. FIG. 50A displays a book 5100 having similar characteristics to book 5000, including a first page 5110 and a second page 5120. First page 5110 has a first inflatable object 5112 mounted there and second page 5120 has a second page 5122 mounted thereon. Book 5100 includes a coupling in the form of a tube 5130 which facilitates the transfer of fluid from one inflatable object to another, adjacent, object. In the Figure, the tube is completely open.

Figure 51A:
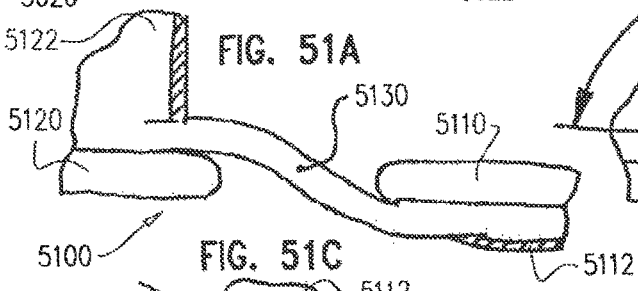
Figure 51B:
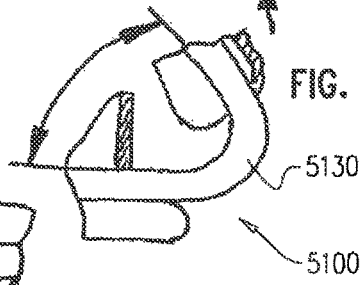
Figure 51C:
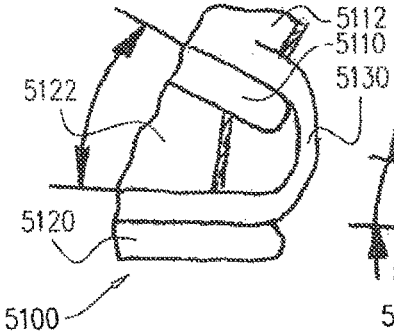
Figure 51D:
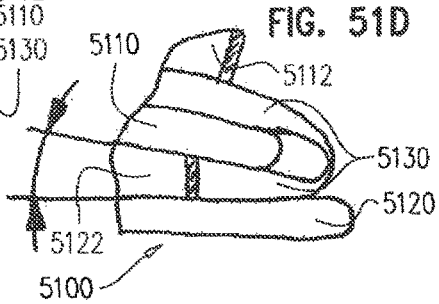

FIG. 51B depicts a stage wherein first page 5110 is rotated in the direction of second page 5120 defining a large angled opening between the pages and wherein tube 5130 is flexed but not compressed. FIG. 51C depicts a stage similar to that depicted in FIG. 50D (where the pages define a midrange angled opening) wherein first page 5110 comes into contact with object 5122, and begins compressing the object, forcing fluid from object 5122 through tube 5130 to object 5112. In the Figure, tube 5130 is slightly compressed, narrowing the internal diameter of the fluid tube and restricting the volume of fluid (e.g. air) flow therein. FIG. 51D depicts a stage wherein the pages define a small angle opening, where object 5122 is further compressed by first page 5110 and wherein tube 5130 is fully compressed, or kinked, completely restricting air flow within the tube. At this stage of the process, no more air can be compressed out of or transferred from, object 5122.

FIGS. 52A and 52B depicts a further embodiment of the current invention, a book system 5200 wherein a first object is coupled to a second object via two fluid conduits, not just one. In the immediate exemplary book system, the conduits are tubes. The current embodiment includes similar components to those describes with reference to FIGS. 50-51 and with similar functions, unless otherwise described. FIG. 52A is a schematic diagram of an exemplary flow control mechanism 5230 for controlling the flow of fluid between adjacent, inflatable objects 5212/5222. In the current embodiment, the inflatable objects 5212/5222 are mounted on pages 5210/5220 respectively, similar to pages of the embodiments depicted in FIGS. 50 and 51. Mechanism 5230 includes two-connectors 5232, one adjacent to each inflatable object 5212/5222. Mechanism 5230 farther includes a bi-directional, variable-state flow conduit 5234 and an open-state unidirectional flow conduit. Transition between the various states of variable-state conduit 5234 is effected by flexing and kinking the tube in a manner similar to that which is depicted in FIGS. 51A-51D. Open-state flow conduit 5236 includes a unidirectional valve 5238 defining conduit 5236 as a unidirectional flow conduit. Both conduits 5236/5234 are located in the area of the binding, which defines the axis about which the pages rotate when turned.

With (at least) two fluid conduits, as depicted in FIG. 52B, interposed between two adjacent pages, first conduit 5234 provides a bi-directional fluid conduit and second conduit 5236 provides a unidirectional fluid conduit. Open-state conduit 5236 is at least partially flexible between the two pages, and is constantly open, regardless of the angle of opening defined by the adjacent pages. Together, the two conduits provide a bi-directional flow of fluid between adjacent objects 5212/5222, allowing flow from second inflatable object 5222 to first inflatable object 5212, at any state of the page(s) being turned.

Fluid if transferred between the inflatable objects by the action of turning the pages which the book system is resting on, or proximal to, an external surface. The transfer action is effected in a first movement of the first page away from the second page, defining a completely open angle between the pages, where the first page comes to rest on a flat surface (book end or external surface). The transfer action is effected in a second movement of the first page towards the second page (defining a shrinking angle between the pages), where the second page is resting on a flat surface. In the first movement, fluid is transferred from first inflatable object 5212 to second inflatable object 5222. In the second movement, fluid is transferred from second object 5222 to first object 5212, by way of open-state, unidirectional conduit 5236

FIGS. 53A-53G depict a book system 5300 including four pages and three inflatable objects 5312, 5322, 5352. As with reference to FIGS. 52, the current embodiment includes similar components to those describes with reference to previous Figures, starting at FIGS. 50, and with similar functions, unless otherwise described. This rule holds true for all the embodiments discussed hereinafter.

A first inflatable object A 5312, is mounted on a first page 5310. Object A is depicted as inflated (via an inflation valve which is not shown) in FIG. 53A. FIG. 53B depicts object A 5312 partially deflated under pressure from first page 5310 pushing the object against a book end 5340 (book end 5340 can alternatively be replaced by a flat, external surface or similar member). As object A is deflated, an object B 5322, mounted on an adjacent. second page 5320, is inflated. FIG. 53C depicts object B fully inflated. A similar process is shown in FIGS. 53D-530, as taking place relative to object B and an object C 5352, mounted on a third page 5350. The latter process differs from the former process in that when third page 5350 causes object C 5352 to deflate, the fluid is not transferred to any new object but rather evacuated out of book system 5300. The evacuation valve, coupled to third page 5350, is not shown in the Figure. In order to begin a new cycle of play, object A must be re-inflated.

Although only one object is depicted as mounted on each page, it is made clear that the depiction is merely exemplary, as is the depicted number of pages, and that any number of objects may be mounted on any given page. Likewise, more or less than three pages may be employed in any given book system of this type. That being said, a ratio between the combined volumes of multiple objects mounted on a single page and the volume of an object or objects mounted on a second page (and a third and so on) must preferably be substantially a ratio of 1:1.

FIG. 53 is a schematic illustration of a fluid transfer mechanism 5330 employed in exemplary book system 5300 depicted in FIGS. 53A-53G. A first inflation/evacuation valve 5331 is used for either inflating or deflating object A 5312 of the immediate book system (see FIG. 53A). A conduit (e.g. tube) leads from valve 5331 to a T-connector 5332 having one outlet towards object A 5312 and the second outlet towards a first variable-state, bi-directional conduit 5334 defining an opened, closed or partially opened state based on the condition of the tube, dictated by the relative positions of pages between which the conduit is disposed.

In an initial condition, variable-state conduit 5334 is kinked closed between first page 5310 and second page 5320, when first page 5310 lies atop second page 5320, as depicted in FIG. 53A.

In a second condition, illustrated in FIGS. 53B-53C, variable-state conduit 5334 is opened in degrees when first page 5310 is turned away from second page 5320 towards book end 5340 in the open state, variable-state conduit 5334 allows fluid to flow between object A and object B. As first page 5310 exerts pressure on Object A, sandwiching the object between book end 5340 and first page 5310—fluid from object A is propelled through open conduit 5334 to object B. Object B becomes fully inflated as object A become fully deflated. Fluid remains in object B due to the weight on object A exerted by first page 5310 and due to the fact that a second variable-state conduit 5334', located between second page 5320 and third page 5350, is in a closed state.

In a third condition, illustrated in FIGS. 53D-53E, second variable-state conduit 5334' is moved to an open state, as second page 5320 moves towards first page 5310 (see FIG. 53D) and comes to lie substantially adjacent to third page 5350 (see FIG. 53E). The aforementioned open state of conduit 5334' is achieved when the tube is unkinked and eventually allowed to lie completely open (see FIG. 53E). During the aforementioned movement of second page 5320, object B is sandwiched between first page 5310 and second page 5320, pressing the fluid out of object B, through now-open second variable-state conduit 5334' to object C. As object B become fully deflated, object C becomes fully inflated. Although second variable-state conduit 5334' is open, fluid is trapped in object C due to the weight of second page 5320 resting on now-deflated object B. Furthermore, a second evacuation valve 5335 is positioned on the outside side of third page 5350. Valve 5335 is in a closed state which prevents the fluid from evacuating through the valve.

A fourth condition is illustrated in FIGS. 53F and 53G, whereby valve 5135 is placed in an open state. Preferably valve 5335 is a unidirectional valve (not shown). In the fourth condition, third page 5350 is moved toward second page 5320. Third page 5350 exerts pressure on object C, causing fluid to flow in through the path of least resistance, namely out of evacuation valve 5335. Once object C is completely deflated, then substantially all of the fluid has been evacuated from book system 5300 and the cycle of play is complete. Book system 5300 is now ready for storage. Book system 5300 is adapted to transfer fluid from one object to another, adjacent, object in series.

Figure 54:
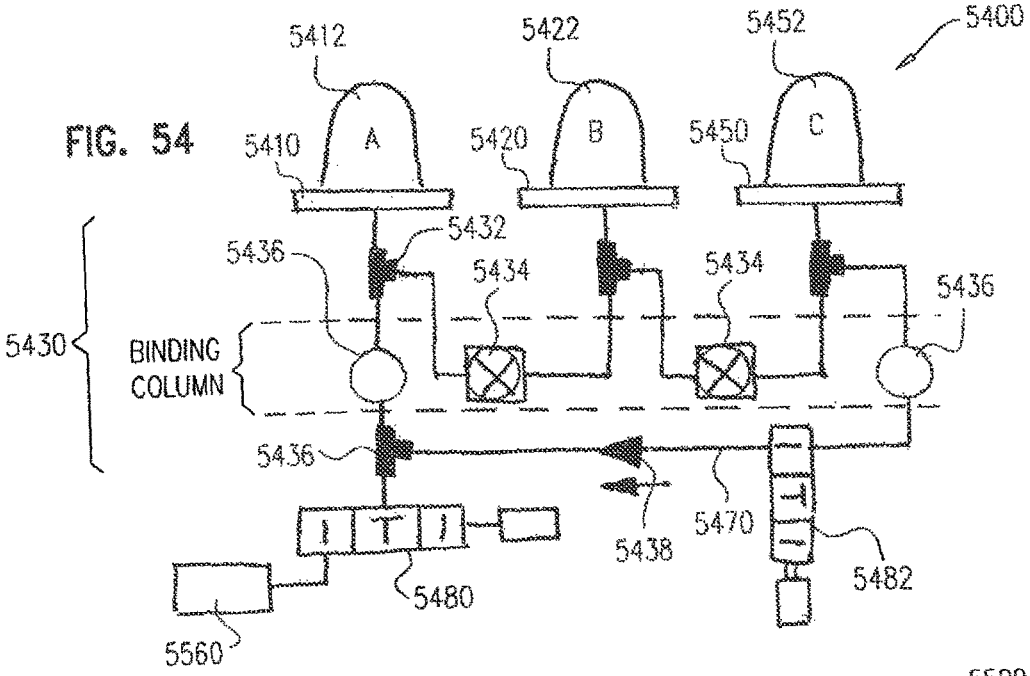

Referring now to FIG. 54, the Figure illustrates a schematic diagram of a fluid transfer mechanism 5430 in a book system 5400. Mechanism 5430 is similar to fluid transfer mechanism 5330 depicted in FIG. 53 but further including an at least partially flexible bypass conduit 5470. Bypass conduit 5470 couples the right-most T-connector to the left-most T-connector. In a practical unidirectional serial fluid transfer system (e.g. book system 5300), bypass conduit 5470 recycles fluid from a final object back to an initial object instead of evacuating the fluid. For example, if mechanism 5430 where implemented on book system 5300 then turning of third page 5350 depicted in FIGS. 53F and 53G would result in the fluid being recycled back into object A 5312 (instead of being evacuated into the atmosphere). A more likely use would be to turn first and second pages 5310/5320 (together) back onto object C 5352, thereby forcing fluid through bypass conduit 5470 and ultimately re-inflating object A 5312.

Referring back to FIG. 54, mechanism 5430 includes an external pump (possibly in the form of a bellows) 5460 for inflating object A 5412. Pump 5460 is coupled to a tri-state valve 5480. Tri-state valve 5480 has an open state for admitting pumped fluid (e.g. air) into object A 5412; a closed state for preventing any and all fluid transfer; and a second open state or an exit state, for evacuating existing fluid to the atmosphere, from the book system. Tri-state valve 5480 connects to a T-connector 5432 which in turn connects to an always-open conduit 5436 (located in the binding column) Which in turn connects to another T-connector 5432. The T-connector leads, via a first outlet, to a first page 5410 and object A 5412; and through the second outlet, to a conduit 5434 with open and dosed states.

When conduit 5434 is in a closed state (e.g. the tube is pinched closed or sandwiched closed between pages, as depicted in FIG. 53A) then air flows from the pump, to object A. When object A is inflated then tri-state valve 5480 is moved to the closed state. Once variable-state conduit 5434 gradually moves from the closed state to the partially open (see FIGS. 53B and 51C) and then fully open state (see 51A and 53C)—and at the same time pressure is applied to object A—then a gradual transference of fluid begins from object A, via variable-state conduit 5434, to object B. The aforementioned transfer process is actuated by turning of a first page 5410, upon which object A is mounted.

Fluid is now trapped in object B as object A can no longer be inflated and a second variable-state conduit 5434 is currently in a closed (pinched, kinked or sandwiched) state (see for example FIG. 53C—where object A is covered and the second variable-state conduit is sandwiched between the second page and book end; see also FIG. 51D).

In the next step, triggered by turning a second page 5420 (upon which object B is mounted) so as to lie on top of first page 5410. As second page 5420 is lifted from resting on a book end 5450, variable state conduit 5434 is partially opened allowing fluid to escape from object B. As second page 5420 is rotated about the axis formed by the binding column, and comes to bear weight (i.e. exert pressure) on object B, fluid escapes object B and is transferred via second variable-state conduit 5434 to object C (see FIGS. 53C-D).

Object C is coupled to second variable-state conduit 5434 as well as a second open-state conduit 5436 which in turn is coupled to a second tri-state valve 5482. Tri-state valve 5482 is initially in a closed state, confining the fluid in object C. Should the user wish to evacuate the fluid at this stage, then tri-state valve 5482 must be moved to the exit state, allowing the fluid to be evacuated from object C out of the book system. If a user wishes to restart the cycle instead, and recycle the fluid in object C back to object A, then tri-state valve 5482 must be moved to the open-state. When in the open-state, the fluid travels through bypass conduit 5470 in a unidirectional manner which is enforced by a unidirectional valve 5438. The fluid arrives at the first T-connector 5432 and reenters object A via open-state conduit 5436 and the cycle of play can now be repeated.

Figure 55:
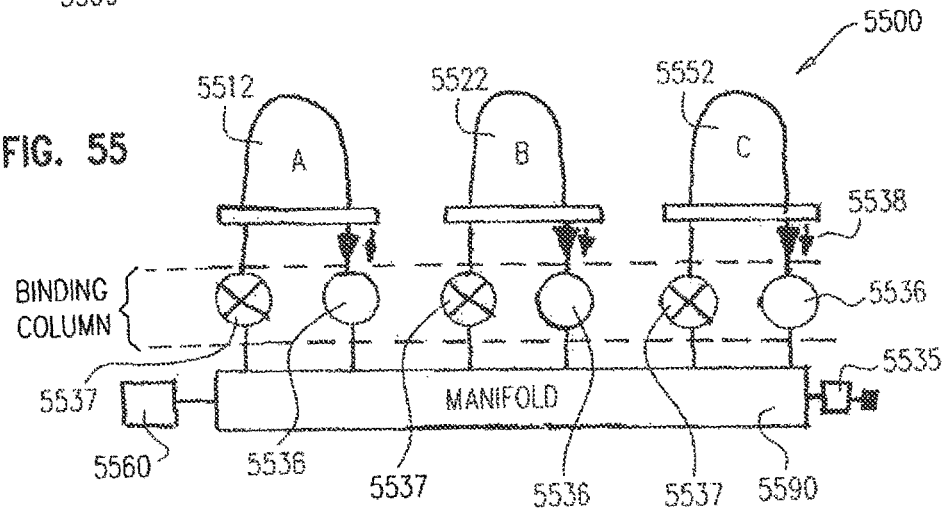

FIG. 55 depicts an exemplary book system 5500 including a manifold 5590. Three objects A, B, C 5512/5522/5552 are coupled to manifold 5490 via six conduits. Each object is in coupled to manifold 5590 via two conduits: an open-state conduit 5536 and a variable-state conduit 5537. A unidirectional valve 5538 is interposed between the object and the open-state conduit for each of the three depicted objects. In the immediate configuration, fluid can be transferred from one object to any other object of the system, not necessarily an adjacent object, nor necessarily in a specific order. For example, in a case where object C is inflated with fluid, all variable-state conduits 5537 are in closed states and book system 5500 is open on page 3. The user now flips to page 1, thereby opening the variable-state conduit of object A and forcing the fluid out of object C (under the weight of the turned pages) through the unidirectional valve, via the open-state conduit, into the manifold and exiting the manifold through the only open variable-state conduit into object A.

At an initial stage, a manifold pump 5560 is provided to inflate book system 5500, initially filling the manifold and then one of the inflatable objects. The fluid is transferred from any object to any other object in the system. At a final stage, fluid is evacuated from book system 5500 via an evacuation valve 5535.

Figure 56A:
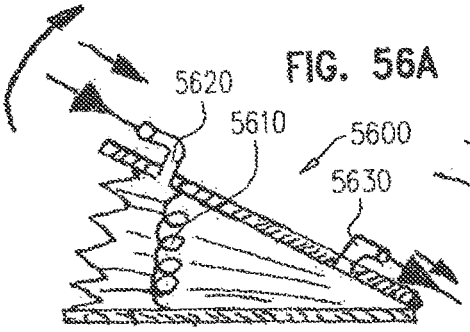
FIG. 56A-B are states of an actuator.
Figure 56B:
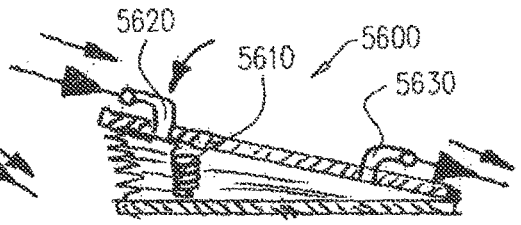

Referring now to FIGS. 56A and 56B, the Figures depict a fluid pump 5600 adapted to be an integral part of a fluid transfer book system. Exemplary pump 5600 is bellows-type pump including a return spring 5610 for expanding pump 5600. Pump 5600 sucks in fluid via a unidirectional intake valve 5620. Pump 5600 expels fluid from the pump via a unidirectional output valve 5630. In some embodiments, intake and output valves may be comprised of a port and unidirectional valve. Intake and output of fluid are effected in the well known manner, expansion causing intake and contraction resulting in output. It is made clear that any type of known pump mechanism can by used in place of the mechanism depicted in the Figures. Future references to pumps, whether integrated or external, all include the basic, known pump components and the intake and output valves previously described. FIG. 56A depicts pump 5600 in an intake state, having drawn fluid from an external source into the pump. FIG. 56B depicts pump 5600 in an output state, Whereby return spring 5610 is compressed (e.g. under external pressure) and fluid is expelled from the pump. When the external pressure is removed from the external face of the pump, return spring 5610 re-expands pump 5600, which is now ready to provide output additional fluid.

Figure 57:
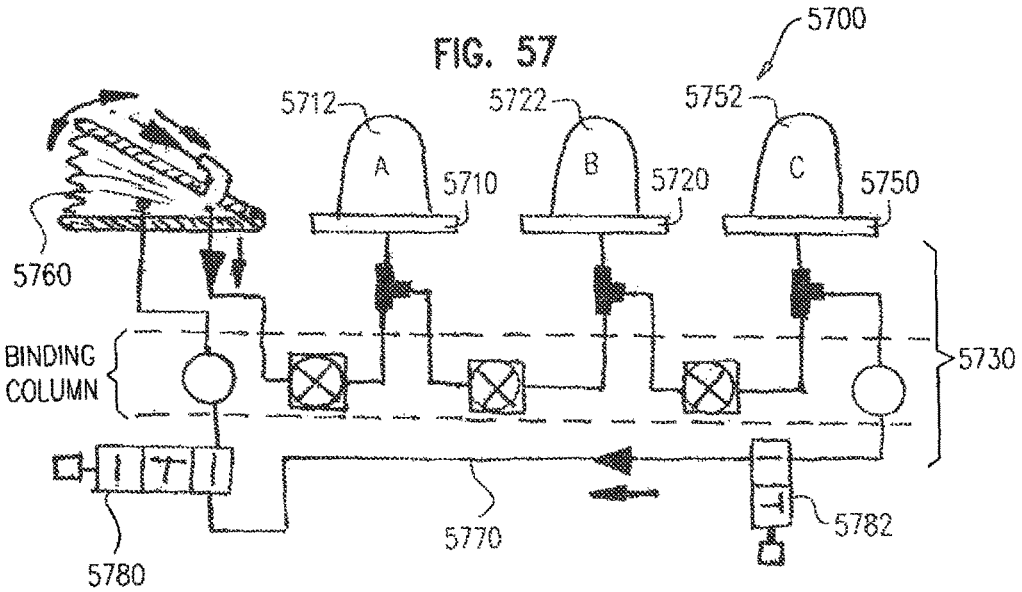

Reference is now made to FIG. 57 which illustrates a fluid control system 5700. System, 5700 is substantially similar to hook system 5400 depicted in FIG. 54, albeit with minor changes. As will book system 5400, system 5700 includes three inflatable objects A/B/C 5712, 5722, 5752 mounted on three pages 5710, 5720, 5750. The three objects are connected in series via variable-state conduits. Unlike book system 5400, system 5700 includes an integrated pump 5760 (similar to pump 5600) and a third variable-state conduit. A further distinction is that a bypass conduit 5770 leads from the last object to pump 5760, and not back to the first object. The bypass conduit includes a bi-state evacuation valve 5782 coupled to object C, for electively recycling or evacuating fluid coming from object C. Additionally, bypass conduit 5770 includes a one-way valve defining unidirectional flow along the conduit. An inflation valve 5780 has three states: closed, open to exit and open to object A.

System 5700 acts in a mariner sufficiently similar to book system 5400 so as not to require a detailed explanation of how the system works. A few point are nonetheless noted: Pump 5760 pumps fluid through third variable-state conduit into object A. After the fluid has passed through to object C, bi-state valve can either be opened to evacuate the fluid or opened to bypass conduit 5770. Fluid travelling through bypass conduit 5770 can enter pump 5760 through tri-state inflation valve 5780, when the valve is in the 'open to object' state. Tri-state valve 5780 is closed after fluid has been admitted to the pump. At this point the fluid can be recycled for another round of play, without introducing additional fluid from outside of the system. When evacuating the system of all fluid, both bi-state valve 5782 and tri-state valve 5780 are set to the opened to exit state, allowing the fluid to be evacuated.

Figure 57A:
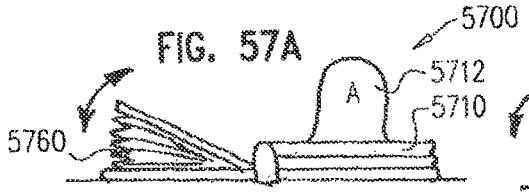
Figure 57B:
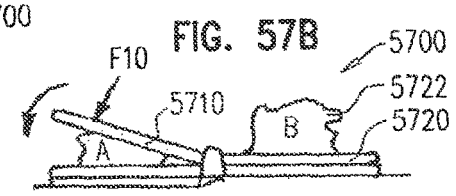
Figure 57C:
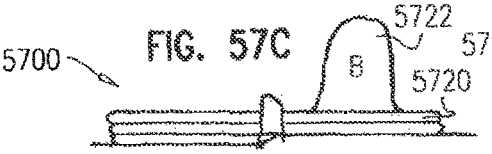

An exemplary embodiment of system 5700 is illustrated in FIGS. 57A-57G. FIG. 57A illustrates system 5700 whereby pump 5760 is integrated into the cover of the book system. When book system 5700 is opened, pump 5760 takes in fluid when expanding under an expansion coil (not shown). Pump 5760 is depressed to expel the fluid from the pump into object A 5712, which is shown in the Figure as fully inflated. Third variable-state conduit, between the pump and object A is in an open state, which allows transference of fluid from the pump to object A. In the next step depicted in FIG. 57B, first page 5710 is turned about the axis of the central binding column towards pump 5760. At angle between first page 5710 and second page 5720 grows, the variable-state conduit between the pages is opened. At the same time, under force F10, first page 5710 depresses object A causing the fluid in object A to be transferred, partially in FIG. 57B and fully in FIG. 57C to object B 5722.

Figure 57D:
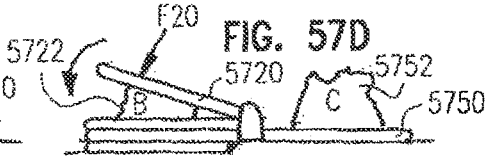
Figure 57E:
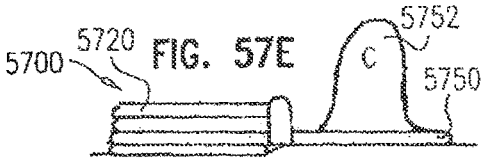
Figure 57F:
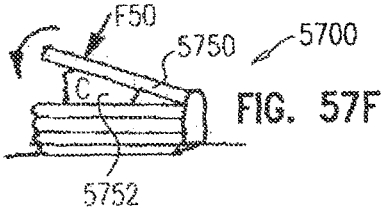
Figure 57G:
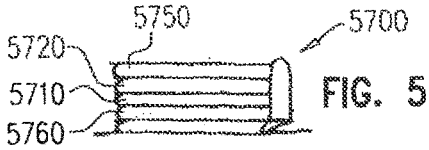

FIGS. 57D and 57E depict the turning of page 5720 towards page 5710 and exerting force F20 on object B 5722, causing object B 5722 to deflate and object C 5752 to inflate. FIGS. 57F and 57G depict turning third page 5750 towards second page 5720, and at the same time exerting force F50 on object C 5750. FIG. 57G depicts a closed book, where the fluid has been evacuated from the book system.

Figure 58:
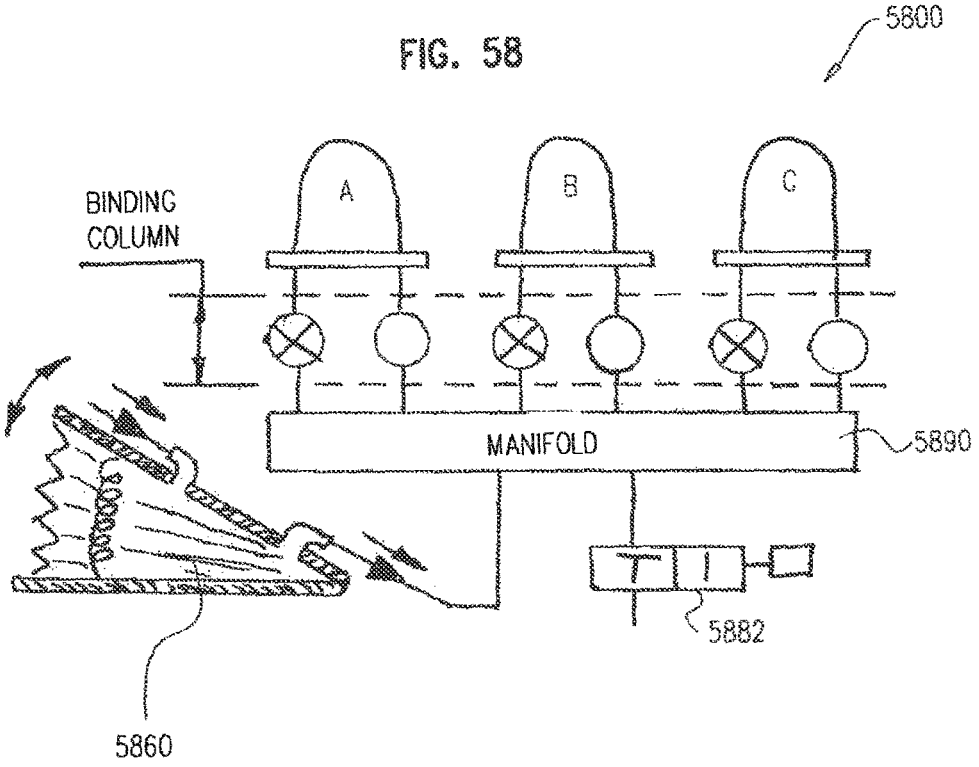

FIG. 58 depicts a schematic diagram of a book system 5800. Book system 5800 is similar to system 5500, except for the addition of an integrated pump 5860 Which is coupled to a manifold 5890. The rest of the components of the system are substantially similar to corresponding components depicted for system 5500. Integrated pump 5860 is substantially similar (at least) to pump 5600, described with reference to FIG. 56. Fluid is pumped into the system and inflates the object positioned between two open pages only. Once an object is inflated, is the fluid can be transferred from that object to any other object in the system, not necessarily an object on an abutting page, but even an object on a non-abutting page. Fluid transfer from one object to any other object in the system is accomplished by transferring fluid from one object to manifold 5890 and out to any other object that located between two open pages. Fluid is evacuated from the system by closing the book system (as one would close a book) and opening an evacuation valve 5882.

Referring now to FIGS. 59A and 59B, the Figures depict an exemplary system 5900 including two pages, one of which is coupled to a pump mechanism 5960. The illustration includes only two pages although it is clear that more than two pages of the same configuration can be used in the form of a complete book system. The same is true for all of the embodiments described herein.

The two depicted pages are situation adjacent to each other, with a hinged axis therebetween, about which the page(s) turns. The one page is actually an upper cover 5962 of a hook end 5940 into which is integrated pump 5960. The facing page is a first page 5910 having an inflatable object 5912 mounted thereon.

The definition of the area moment of the pump (inflator) is—the product of: the maximum effective area of the pump process and the distance of the focal point of the area from the shared axis. In practice the area moment of the pump is significantly greater than the area moment of each of the objects in the hook system. As such, when object 5912 is inflated with fluid and pump 5960 is not completely inflated with fluid, and a force F is brought to bear on object 5912 (as depicted in FIG. 59B)—fluid is transferred from object 5912 to pump 5960. The process of transferring fluid from an object to the pump allows a user to enjoy continuous play with the book system, without the need for reintroducing fluid into the system or evacuating fluid from the system. Fluid transferred from one object to the pump can then be transferred from the pump to another object and so on.

Fluid transfer from one inflatable object to pump 5960, operationally coupled to the system, allows an additional full or partial cycle of play with the system. In a case where more than one inflatable object is mounted on a page, then the page includes open conduits between the various objects on the same page. The aforementioned conduits allows all the objects on the page to be inflated at the same time or in a serial fashion (one after the other), depending on the configuration of the objects and the conduits running between the conduits.

Referring now to FIGS. 59C-59I, a process or cycle of play with an exemplary book system 5900 including three objects in series is illustratively depicted in the Figures. The exemplary book, system includes pump 5960 integrated into book end 5940. In FIG. 59C, pump 5960 is depicted as inflated with fluid. In FIG. 59D upper cover 5962 has been forced towards a lower cover 5963 of pump 5960, the action of which causes fluid in pump 5960 to be expelled/transferred to a first inflatable object X 5912. First page 5910 defines a wide angle vis-à-vis book end 5940 (and more specifically upper cover 5962) such that fluid conduit(s) between pump 5960 and inflatable object X 5912 is open allowing fluid to be transferred from pump 5960 to object X. No other conduit is open, disallowing fluid flow to any other object in the book system.

Between the state depicted in FIG. 59D and the state depicted in FIG. 59E, the intermediate states of play have been skipped. The skipped states include transferring fluid from object X to a second inflatable object Y (not shown) by turning first page 5910; transferring fluid from object Y to a third inflatable object Z 5952, by turning a second page 5920. FIG. 59D depicts third inflatable object Z 5952, mounted on a third page 5950, as inflated. FIG. 59 F depicts the beginning stage of taming third page 5950 towards second page 5920. As a result of applies force F on third page 5950, object Z is partially deflated, where fluid from the object is pressured back into pump 5960 which is depicted as partially inflated. As third page 5950 approached second page 5920, pump 5960 is increasingly inflated, causing upper cover 5962 to define an ever growing angle of opening with lower cover 5963. FIG. 59G depicts the state whereby pump 5960 is inflated and object Z is completely deflated. FIG. 59H depicts a first state in a new cycle of play, the state being substantially equivalent to the state depicted in FIG. 59C. FIG. 59I depicts the stage following the stage depicted in FIG. 59H, where object X 5912 is now re-inflated, the book system having a state substantially similar to the state depicted in FIG. 59D (same state but previous cycle of play). Serial play cycles can be renewed indefinitely. To end play, book system 5900 is closed and an evacuation valve (not shown) is opened, allowing fluid to escape from pump 5960 (or elsewhere) under external pressure. Once all fluid has been evacuated from the system, the book system can be stored for later use.

An alternative configuration of book system 5900 is illustrated in FIGS. 59J-59O. The book system 5900 illustrated in the Figures includes three parallel inflatable objects (as opposed to three objects in series depicted for the previous configuration). Fluid can be transferred from each of the three parallel objects to any other of the objects, via pump 5960 and a manifold (not shown). The function of transferring fluid from the pump to any object and from one object to any other object is the characterizing function of 'parallel objects'. Objects in series can only transfer fluid to an adjacent object, such as the next object in line (in series), but not to a non-adjacent object (the direction of flow may be unidirectional or bidirectional), The objects of the immediate configuration are in parallel in a manner similar to the objects of book system 5500 depicted in FIG. 55. The fluid transfer mechanism of the immediate configuration functions in a manner substantially similar to the flow transfer mechanism of book system 5800.

Referring now to FIG. 59J, pump 5960 is depicted in an inflated state, ready for play. In FIG. 59K, first page 5910 is depicted as resting on upper cover 5962 of pump 5960 which is completely compressed. Book system 5900 is open to second page 5920 and a second inflatable object Q, 5912' is depicted as fully inflated. Fluid has been transferred from pump 5960 to object Q 5912' via the manifold (not shown). FIG. 59L depicts a state whereby object Q is partially deflated wider force F and the fluid is partially transferred to pump 5960, as all conduits to other objects are closed. FIG. 59M depicts a completed inflation of pump 5960 and deflation of object Q (not visible in the Figure).

In FIG. 59N, third page 5950 is opened but no object is inflated. At this stage the fluid remains in pump 5960. FIG. 59O depicts the stage whereby pump 5960 is compressed (whether under external pressure similar to force F or the weight of the first and second pages or a combination of both) and fluid is transferred through the manifold to a third object R 5952' which is mounted on third page 5950. In some embodiments of the current configuration the opening of the conduit(s) between the manifold and object R allows fluid to exit pump 5960 and enter object R. In other embodiments, fluid transfer is not effected, or only partially effected, due to the opening of the conduit, while additional pressure on pump 5960 is still needed to effect a complete fluid transfer. Fluid can be evacuated from book system 5900 by opening an evacuation valve (not shown) and compressing the system in order to expel fluid in a sufficient manner.

Figure 60A:
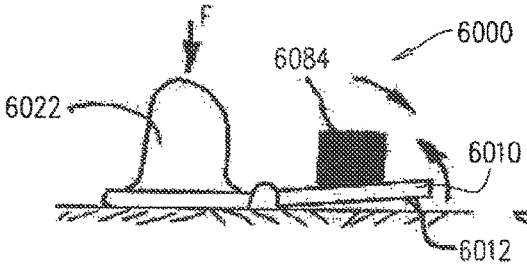
Figure 60B:
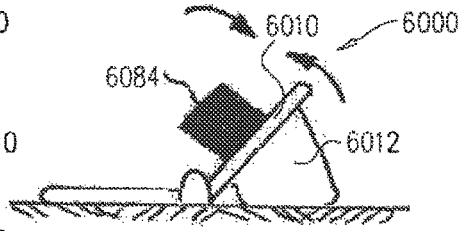

FIGS. 60A and 60B depict a partial book system 6000 including a weighted object 6084. Book system 6000 is substantially similar to book systems 5000, 5100, and 5200, but with an additional component, namely weight 6084. FIG. 60A depicts state whereby a second inflatable object 6022 is inflated, a first inflatable object 6012 substantially deflated and weight 6084 is mounted on a first page 6010, on a face of first page 6010 closest to second object 6022. Second object is deflated by exerting force F (e.g. a child pushing a palm down on the inflated object) which causes first object 6012 to be inflated, as discussed previously. FIG. 60B depicts the aforementioned state. Once Force F is no longer exerted on second object 6022, weight 6084 depresses first page 6010 causing first object 6012 to deflate and second object 6022 to re-inflate, a state once again depicted in FIG. 60A. Many cycles of play can be enjoyed in using this system.

Figure 61A:
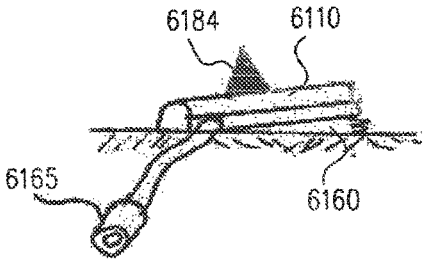
Figure 61B:
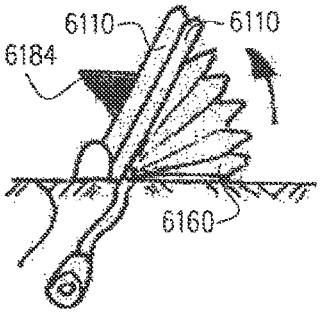

FIGS. 61A and 61B depict a system 6100 similar to system 6000 and including a single page 6110 which has a weight 6184 mounted on a first side of the page and is coupled to a pump/actuator 6160 which has an upper cover 6162 abutting the page. Pump 6160 is inflated via an inflation tube 6165. FIG. 61A depicts a state wherein pump/actuator 6160 is deflated. FIG. 61B depicts a state wherein pump 6160 is inflated.

Figure 62A:
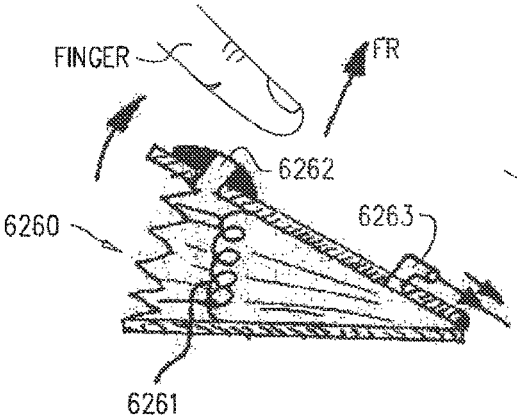
FIG. 62 are states of another actuator.
Figure 62B:
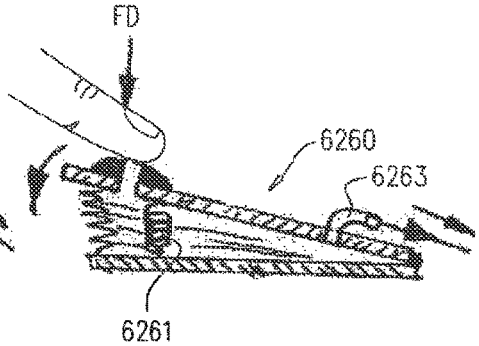

Referring now to FIGS. 62A and 62B, a pump 6260 is depicted therein, including a return spring 6261 (similar to return spring 5610 depicted in FIG. 56; expanded in FIG. 62A and compressed in FIG. 62B), a unidirectional output valve 6263 (similar to unidirectional output valve 5630) and an intake opening 6262. FIG. 62A depicts pump 6260 in an expanded state, where the pump is filled with fluid. FIG. 62B depicts a state whereby the finger presses down with force FD on pump 6260, covering opening 6262 and compressing the pump so as to expel the fluid held therein out through unidirectional output valve 6263. Raising the finger in the direction FR uncovers intake opening 6262 and allows spring 6261 to expand pump 6290 causing new fluid intake from the surrounding atmosphere, occurring in a known fashion. Pump 6290 is merely an exemplary embodiment, and it is clear that other components capable of performing substantially similar functions are included in the scope of the description. Pump 6290 or similar apparatus is useful in a system for which it is not necessary that the pump be sealed from the outside atmosphere when not in action.

FIG. 63 depicts an exemplary basic unit of a fluid transfer mechanism for use in fluid transfer system such as a toy system. FIG. 63A is an illustrative flow diagram of the basic unit. FIG. 63B is a cross-sectional view of line A-A of FIG. 63. FIG. 63C is a cross-sectional view of another embodiment of the basic unit of FIG. 63. FIG. 63D is an illustrative flow diagram of the second embodiment of the basic unit.

FIG. 63 depicts a base unit 6300 which has an entry port 6310 on a proximal side and exit port 6390 on a distal side of base unit 6300. Base unit 6300 further includes a first intermediate opening 6320 on a dorsal surface of base unit 6300. Exit port 6390 includes an O-ring gasket 6392 externally mounted on exit port 6390 for providing an airtight/hermetic seal between the exit port and additional components or other base units. Entry port 6310 is a 'female' opening configured to receive a corresponding male port. Exit port 6390 is a 'male' attaching port configured to be coupled, hermetically, to a corresponding female opening similar to entry port 6310.

Base unit 6300 includes at least a main fluid conduit 6312 running between entry port 6310 and exit port 6390. Main fluid conduit 6312 includes at least two unidirectional valves: a proximal valve 6314 and a first intermediate valve 6316. Both valves allow flow in the same direction, namely from entry port 6310 to exit port 6390, defining main conduit 6312 as a unidirectional conduit. Even thought conduit 6312 is unidirectional, it will be explained below that fluid actually flows in additional directions (e.g. perpendicular to the direction of main conduit 6312) depending on whether and where additional opening exist along the conduit pathway.

To wit, a first intermediate flow pathway/conduit 6322 is located between proximal valve 6314 and first intermediate valve 6316 there. Intermediate flow pathway conduit 6322 fluidly couples main conduit 6312 and first intermediate opening 6320. Flow through intermediate conduit 6322 is at least unidirectional and may be bidirectional.

In use, when fluid is pumped into base unit 6300 through intermediate opening 6320, fluid flows through first intermediate pathway 6322 into a section of main conduit 6312 defined by proximal valve 6314 and first intermediate valve 6316. The direction of fluid flow is dictated by the path of least resistance. On the one side, flow is block by unidirectional proximal valve 6314 as the flow is in a non-allowed direction. Fluid cannot return to first intermediate opening 6320 as pumping pressure forces the fluid away from the opening. The remaining direction of flow is towards first intermediate unidirectional valve 6316. The fluid pressure in the pathway is greater that the resistance of first intermediate unidirectional valve 6314 which causes the valve to open (at least a minimum degree of pressure is needed to open any unidirectional valve, as is well known in the art). Fluid flows out of exit port 6390. Potentially, exit port 6390 can be hermetically coupled to an additional base unit or other corresponding component. In such a case, fluid flowing out of exit port 6390 enters into the attached component.

In one configuration, base unit 6300 is a complete unit, as depicted in FIG. 63. In another configuration, the unit is a subdivided unit having at least two subdivisions. FIG. 63C depicts a cross-sectional view of a subdivided unit. The subdivided unit includes a first subdivision 6301 and a second subdivision 6302. FIG. 63D is an illustrative flow diagram of the subdivided unit, the cross-sectional view of which is depicted in FIG. 63C.

Figure 64A:
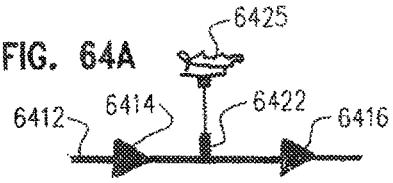
FIG. 64-67 are schematic diagrams of exemplary embodiments employing mechanism of FIG. 63.
Figure 64B:
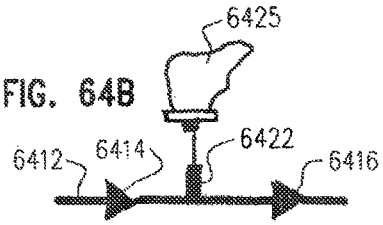

Referring now to FIGS. 64A and 64B, the Figures depict two stages of inflating an inflatable object according to the according to the mechanism of FIGS. 63. Where possible, all corresponding features have been identified with corresponding reference numbers/letters, where the first two numbers of the reference relate to the number of the Figure and the second two numbers uniquely identify a component. For example, a main conduit 6412, depicted in FIG. 64A corresponds to main conduit 6312 in FIGS. 63. The same reference method has been used regarding FIGS. 50-62.

FIG. 64A depicts a simplified flow diagram similar to that which is depicted in FIG. 63A, with the addition of an inflatable object 6425 which is depicted as deflated in the Figure. In FIGS. 64A-B, inflatable object 6425 is fluidly coupled (hermetically) to a first intermediate conduit 6422. First intermediate conduit 6422 intersects with main conduit 6412 between a proximal unidirectional valve 6414 and a first intermediate unidirectional valve 6416. The pressure force needed to inflate object 6425 is smaller than the pressure force need to open unidirectional valve 6416 (i.e. valve 6416 has a greater level of resistance that inflatable object 6425), therefore, fluid pressurized into main conduit 6412 travels in the direction dictated by proximal unidirectional valve 6414 and follows the path of least resistance, In the immediate case, the path of least resistance is through first intermediate conduit 6422 and into inflatable object 6425, which is caused to inflate under the aforementioned fluid pressure. Inflatable object 6425 is depicted in an inflated state in FIG. 64B.

Figure 65A:
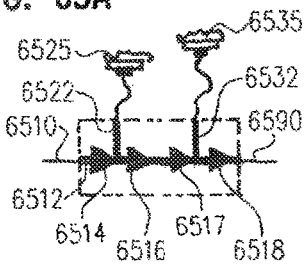
Figure 65B:
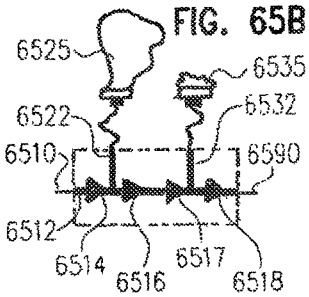
Figure 65C:
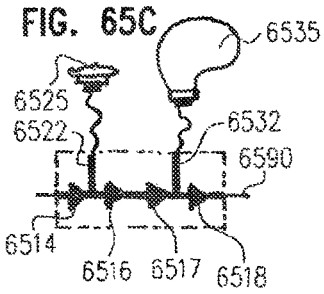

FIGS. 65A-C, depict simplified flow diagrams similar to that which is depicted in FIGS. 64A-B, although whereas FIGS. 64A-B depicted only one inflatable object, FIGS. 65 depict two inflatable objects. Alternatively, FIGS. 65 depict two basic units coupled together. In the Figures, a main conduit 6512 intersects with a first intermediate conduit 6522 and a second intermediate conduit 6532. A first inflatable object 6525 is coupled to first intermediate conduit 6522 and a second inflatable object 6535 coupled to a second intermediate opening 6530. First intermediate conduit 6522 intersects with main conduit 6512 between a proximal unidirectional valve 6514 and a first intermediate unidirectional valve 6516. Second intermediate conduit 6532 intersects with main conduit 6512 between a second intermediate unidirectional valve 6517 and a third intermediate unidirectional valve 6518.

FIG. 65A depicts an initial state where both inflatable objects 6525, 6535 are deflated. In use, fluid is compressed into main conduit 6512 via an entry port 6510 and conducted through conduit 6512 at a pressure great enough to open unidirectional valve 6514. First intermediate valve 6516 has greater pressure resistance than first inflatable object 6525, therefore, pressurized fluid inflates first object 6525, as depicted in FIG. 65B.

FIG. 65C depicts a third state whereby pressure has been applied to first object 6525 resulting in second object 6535 becoming inflated. When pressure is applied to first object 6525, fluid is forced out of the object back into first intermediate conduit 6522 and through the only available pathway, namely first intermediate valve 6516 which opens under the aforementioned, pressure. Pressure applied to first object 6525 is also sufficient to open second intermediate valve 6517, but when facing the option of opening third intermediate valve 6518 or inflating second object 6535, the fluid once again follows the path of least resistance and inflates second object 6535. Within the framework of a fluid transfer toy system, the mechanism described heretofore provides two inflatable objects which can be inflated in series (one after the other) in a predefined direction.

Figure 66A:
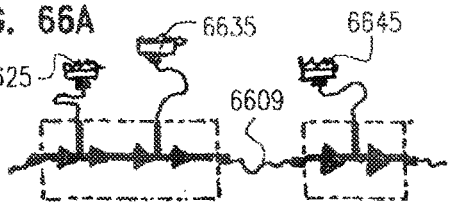
Figure 66B:
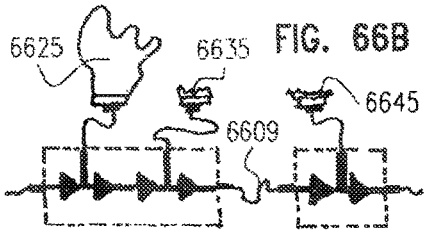
Figure 66C:
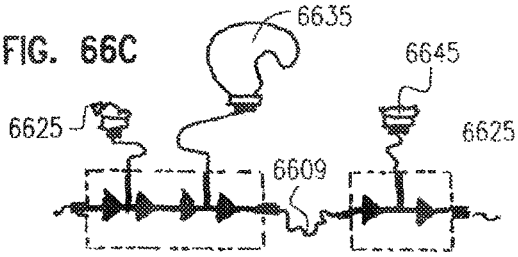
Figure 66D:
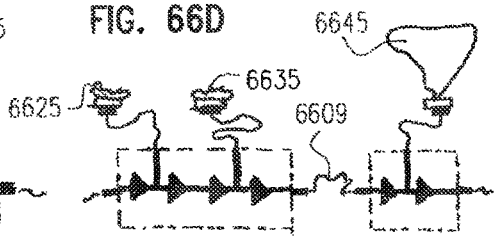

FIGS. 66A-66D depict various states and stages of an exemplary serial, fluid-transfer system including a first compound unit including two inflatable objects (substantially similar to the unit depicted in FIGS. 65A-C) and a second basic unit which includes one inflatable object. The two units are coupled together by a coupling means, such as a flexible tube. FIG. 66A depicts a first, initial state whereby all three objects 6625, 6635, 6645 are deflated. FIG. 66B depicts a second state which corresponds to a second stage of play, whereby fluid introduced into the system inflates first object 6625 in the manner described above. FIG. 66C depicts a third state, corresponding to a third stage of play, whereby pressure has been applied to first object 6625 resulting in a serial transfer of the fluid to second object 6635 in a manner described above. FIG. 66D describes a forth state, corresponding to a forth stage of play, whereby pressure has been applied to second object 6635, causing fluid to be transferred out of the compound unit to the second unit, via a fluid coupling 6609, to inflate third object 6645.

Figure 67:
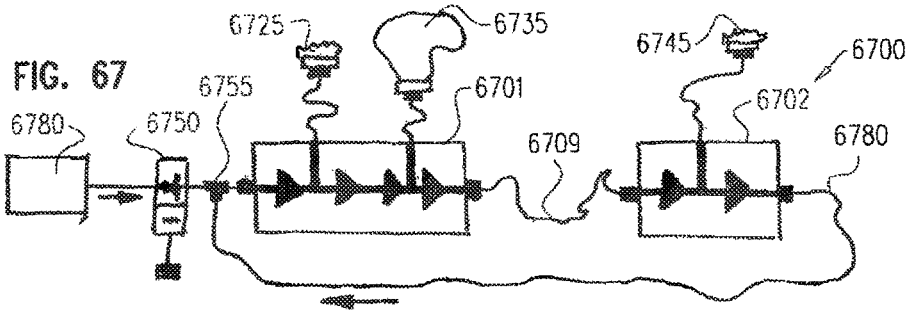

FIG. 67 depicts an exemplary multi-cycle, serial fluid-transfer system 6700 which is similar to the serial system depicted in FIGS. 66 but with the addition of a bypass conduit for recycling fluid for reuse in additional cycles of play. The system includes an inflator (e.g. a pump) 6760, a bi-state valve 6750, a T-connector 6755, a compound unit 6701, a basic unit 6702 and a bypass conduit 6780.

Bi-state valve 6750 has an open state for allowing fluid intake from pump 6760 and a closed state for facilitating recycling of fluid. Compound unit 6701 includes a first object 6725 and a second object 6735. Basic unit 6702 includes a third object 6745. Compound unit 6701 is coupled to Basic unit 6702 via a coupling 6709. In a first cycle of use/play pump 6750 introduces fluid into compound unit 6701 via bi-state valve 6750 which is in an open state. Play progresses as fluid is transferred in a serial, unidirectional manner, from one object to the next. When third object 6745 is deflated under external pressure (e.g. a child squeezes the inflatable object), fluid is transferred through bypass conduit 6780 to T-connector 6755 and from there back into compound unit 6701. The fluid does not escape the system because bi-state valve 6750 is now in the closed state. A new cycle of play now begins.

Figure 68:
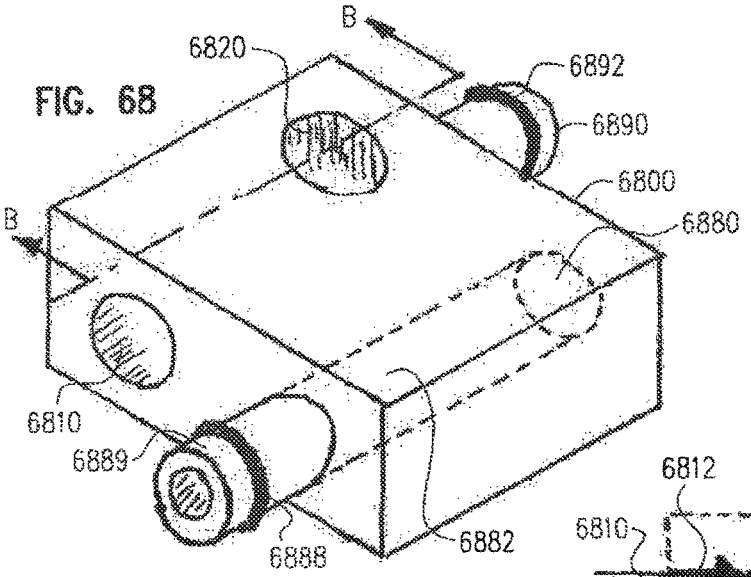
FIG. 68-71 are various modular fluid transfer mechanisms.
Figure 68A:
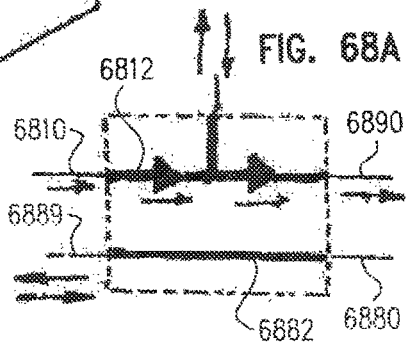
Figure 68B:
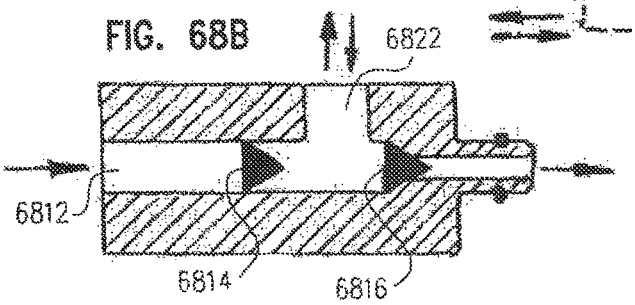
Figure 68C:
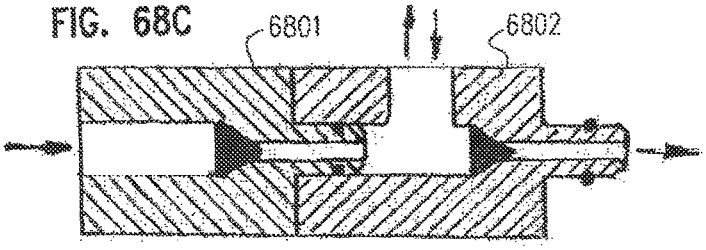
Figure 68D:
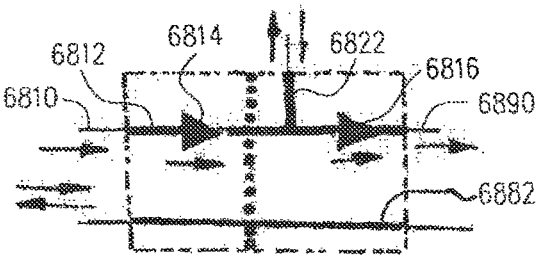

Yet another configuration is shown in FIG. 68. FIG. 68 depicts an exemplary bi-conduit, basic unit of a fluid transfer mechanism for use in fluid transfer system such as a toy. FIGS. 68A is an illustrative flow diagram of the basic bi-conduit unit. FIG. 68B is a cross-sectional view of line B-B of FIG. 68. FIG. 68C is a cross-sectional view of another embodiment of the basic bi-conduit unit of FIG. 68. FIG. 68D is an illustrative flow diagram of the second to embodiment of the basic bi-conduit unit.

FIG. 68 depicts a basic bi-conduit unit 6800 which includes a unidirectional conduit 6812 and a parallel bidirectional conduit 6882. Unidirectional conduit 6812 is substantially similar to main conduit 6312 and has corresponding components such as an entry port 6810, an exit port 6890, an intermediate opening 6820 and an O-ring 6892. Bidirectional conduit 6882 has a female connection port 6880 and a male port 6889. Male connection port includes an O-ring 6888. The O-rings facilitate hermetical sealing between two corresponding units which are coupled together.

FIG. 68B is substantially similar to FIG. 63B and includes corresponding components such as unidirectional conduit 6812 (corresponding to 'main conduit 6312), a proximal unidirectional valve 6814, a first intermediate unidirectional valve 6816 and an intermediate conduit 6822.

FIG. 68C depicts a subdivided unit, having a first subdivision 6801 and a second subdivision 6802 (corresponding to FIG. 63C). FIG. 68D is a diagrammatic flow chart of FIG. 68C.

Figure 69:
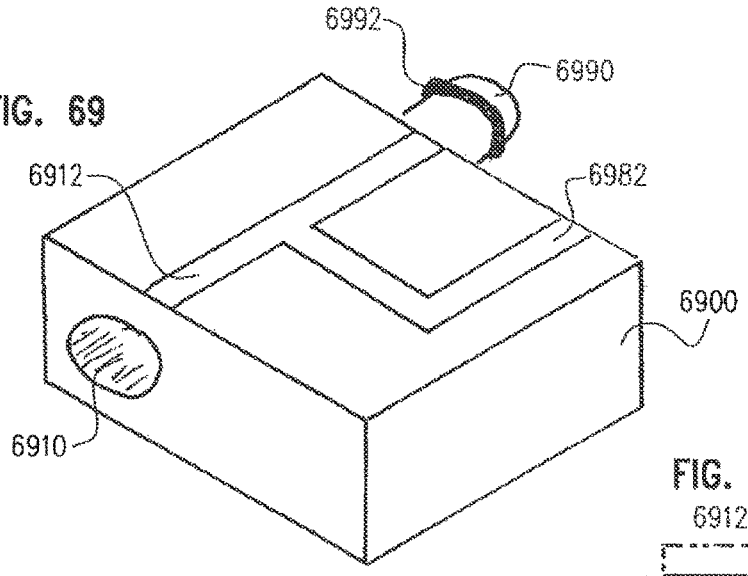
Figure 69A:
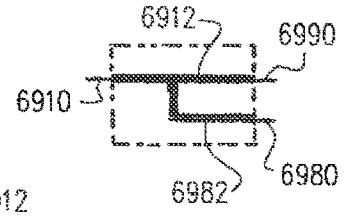

FIG. 69 is an isometric view of an exemplary modular T-connector configured for use in a fluid transfer system. FIG. 69A is a schematic view of the T-connector. FIG. 69 depicts a T-connector unit 6900 having a female entry port 6910, a male exit port 6990, a second port 6980 (not visible in FIG. 63) and an O-ring 6992 mounted on the exit port to facilitate hermetic sealing when coupling the unit to another unit in the system. A bi-direction fluid conduit 6912 runs from entry port 6910 to exit port 6990. A secondary conduit 6980 intersects with main conduit 6912 and on a first end and with second port 5980 on the other end. A T-connector unit 6900 functions in a similar manner to a standard T-connector known in the art and could, for example, be used as T-connector 6755 depicted in FIG. 67.

Figure 70:
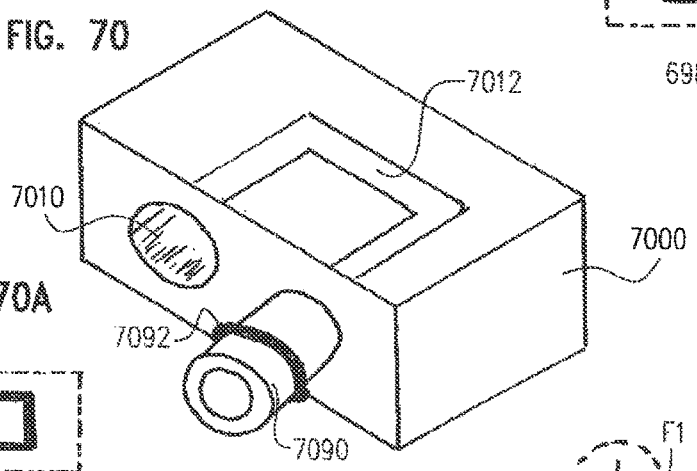
Figure 70A:
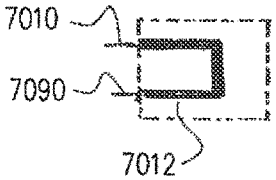

FIG. 70 is en isometric view of an exemplary modular U-connector configured for use in a fluid transfer system. FIG. 70A is a schematic view of the U-connector. FIG. 70 depicts a U-connector unit 7000 having a female entry port 7010, a male exit port 7090 and an O-ring 7092 mounted on the exit port to facilitate hermetic sealing when coupling the unit to another unit in the system. A main fluid conduit 7012 runs from entry port 7010 to exit port 7090.

Figure 71:
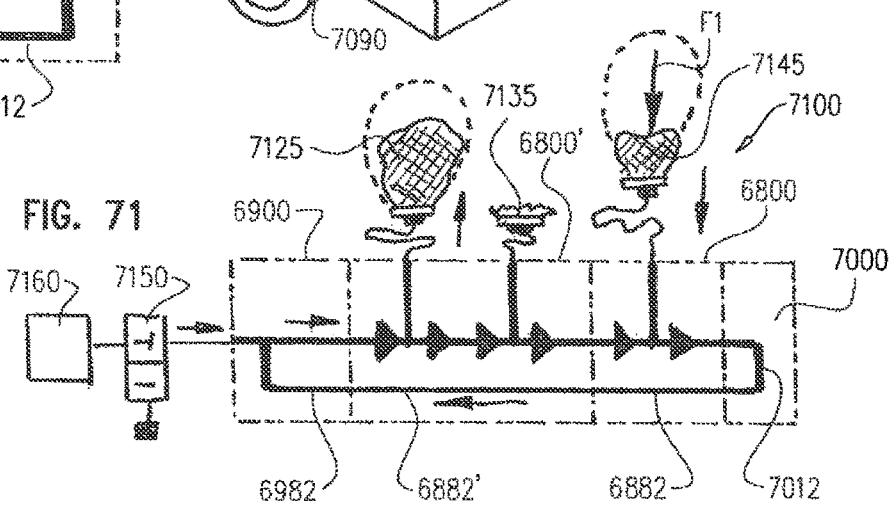

FIG. 71 depicts an exemplary serial fluid transfer system 7100 which facilitates multiple cycles of use/play without the need for introducing new fluid after each cycle. System 7100 is similar in function to system 6700 depicted in FIG. 67, although differences exist. System 7100 includes an inflator (e.g. a pump) 7160, a bi-state valve 7150, a T-connector module 6900, a compound bi-conduit unit 6800' (similar to unit 6800 but with two objects), a basic bi-conduit unit 6800 and a U-connector 7000. The T-connector, compound unit, basic unit, and U-connector to are each coupled to the adjacent component by coupling male exit port to female entry port. The couplings are hermetically sealed thanks to the accompanying O-ring gaskets.

In an initial step, pump 7160 injects fluid into system 7100 via bi-state valve 6750 which is set to an open state. (Bi-state valve is subsequently set to a closed state.) Fluid flows through conduit 6912 of T-connector 6900 into compound bi-conduit unit 6800'. Compound bi-conduit unit 6800' includes a first object 7125 and a second object 7135. Basic bi-conduit unit 6800 includes a third object 7145. Play progresses as fluid is transferred in a serial, unidirectional manner, from one object to the next in a manner described above. FIG. 71 depicts the stage of play and state of system 7100 wherein third object 7145 is partially deflated under external pressure F1 (e.g. a child squeezes the inflatable object), fluid is transferred out of the object and through U-connector 7000 to the parallel, bi-directional conduit 6882 of unit 6800. Fluid continues to flow into a bi-directional conduit 6882' of compound unit 6800', further to secondary conduit 6982 of T-connector module 6900 and from there back into compound bi-conduit unit 6800' (via conduit 6912). The fluid does not escape the system because bi-state valve 7150 is now in the closed state facilitating recycling of the fluid. A new cycle of play now begins whereby first object 7125 is partially inflated from the fluid transferring out of third object 7145.

Figure 72:
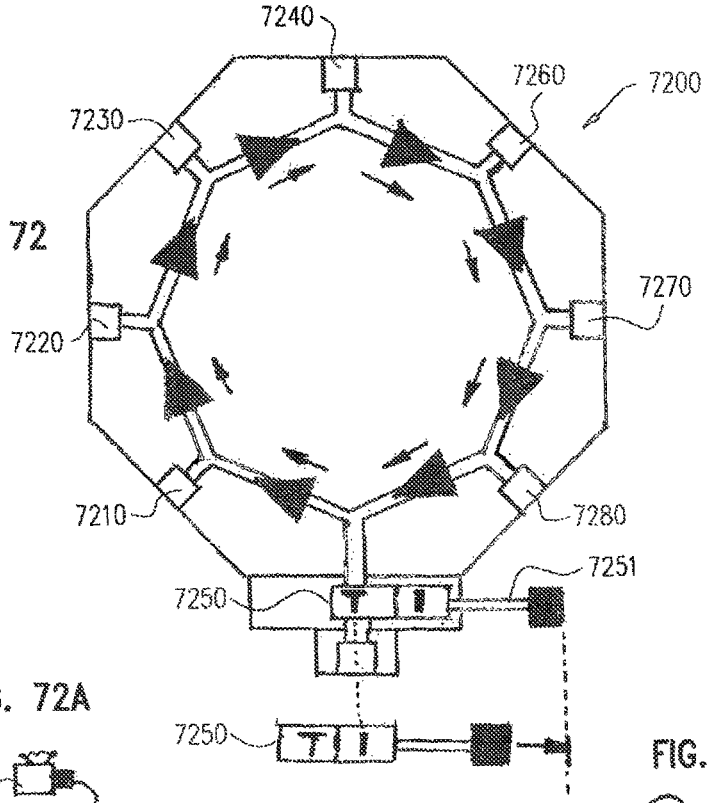

FIG. 72 depicts an octagonal fluid transfer system 7200. System 7200 is an exemplary multi-cycle, modular toy system which functions according to the principles of system 7100. The components of system 7200 and their functions are readily understood by comparison to the components of system 7100 and are therefore not elaborated on here. A bi-state inflation/evacuation valve 7250 is depicted in the Figure. A plunger 7251 controls the state of valve 7250. In the Figure, valve 7250 is in a closed state, preventing evacuation of fluid from the system. A depiction of valve 7250 in an open state is illustrated below the system. An opening 7220 is one of seven openings in the system which are prepared to receive an inflatable object, tubing or any other accessory which can be attached thereto. It is clear that the selected number of openings is merely exemplary and a toy system of the immediate embodiment can have more or less openings.

Figure 72A:
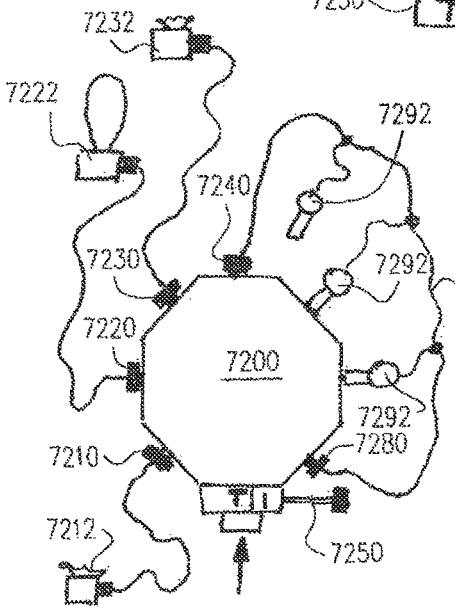
Figure 72B:
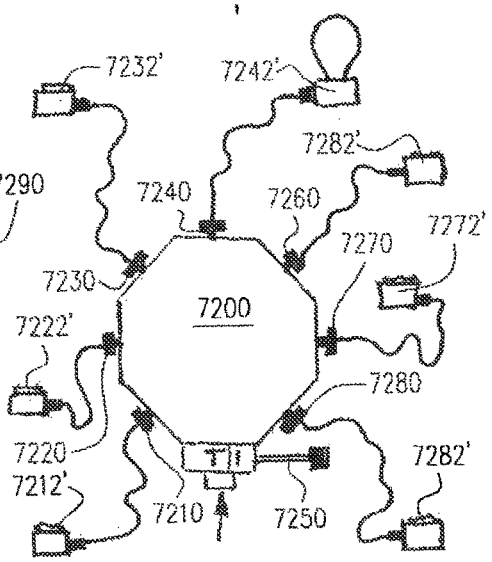

FIG. 72A illustrates system 7200 in an exemplary configuration of external appendages attached to the seven openings. Three active mini-systems 7212, 7222 and 7232 are coupled to three active openings 7210, 7220 and 7230 respectively of system 7200. Three stoppers 7292 are suspended from a stopper line 7290. Two of the stoppers are inserted into inactive openings. Line 7290 is connected on one end to a forth opening 7240 and on the other end to a seventh opening 7280, effectively bridging the two openings. In an exemplary case whereby line 7290 is a tube/conduit, then the tube serves as an external bridging conduit between the active openings.

FIG. 72A illustrates a second exemplary configuration for system 7200. In the depicted configuration, seven mini-systems 7212', 7222', 7232', 7242', 7262', 7272' and 7282' are coupled to active openings 7210, 7220, 7230, 7240, 7260, 7220 and 7280 respectively. The couplings may be a direct line or tubing or any other manner of coupling.

Figure 73A:
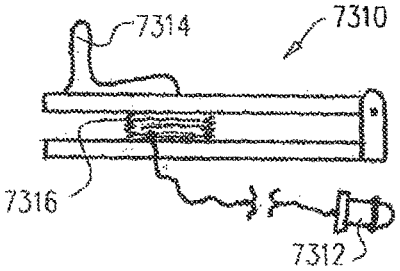
Figure 73B:
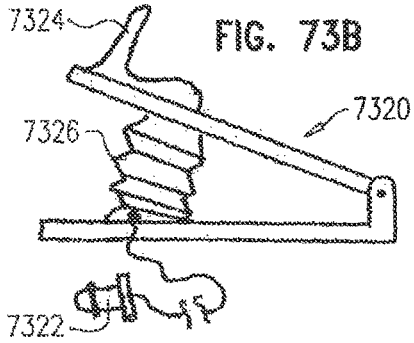
Figure 73C:
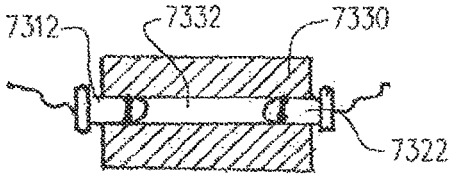

FIGS. 73A-C depict components of a modular seesaw system. FIG. 73A depicts a first Modular seesaw unit 7310 in a lowered state. FIG. 73B depicts a second modular seesaw unit 7320 in a raised state. First modular seesaw unit 7310 includes a seat 7314, a detachable (or non-detachable) connector 7312 coupled to an actuator 7316. Second modular unit 7320 likewise includes a seat 7214, a detachable (or non-detachable) connector 7322 coupled to an actuator 7326. FIG. 73C depicts a connector unit 7330 configured with two openings for receiving connectors 7316 and 7326. Connector unit 7330 includes a bidirectional conduit 7332 which allows bidirectional flow of fluid between the seesaw units when the connectors are coupled to the unit. The raised state of second unit 7320 is a result of pressure (e.g. from the weight of a child) effected on first unit 7310 which is depicted in a lowered state.

The modular system allows the units (and therefore children playing on the units) to be co-located or remotely located (e.g. such as in different rooms). Additional units can be added to a system such as system 6700 or system 7100 or even system 7200. Each of the aforementioned systems is scalable with the seesaw modules easily integrated into such systems. Three, seven, ten or more seesaw units can be integrated into a single play system where the seesaw play of one child effects the unit of an adjacent child and so on.

A more complex version of the system is envisioned whereby at least some of the actuators can act as intake pumps for adding addition fluid to the system. A pressure compensation mechanism is also needed to ensure that excess fluid is expelled from the system via at least one or some of the actuator-pumps. In this manner, a large number of children can simultaneously enjoy the seesaw experience without having to wait for their turn to come.

Figure 74A:
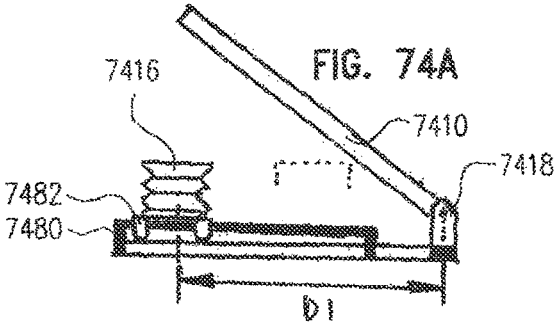
Figure 74B:
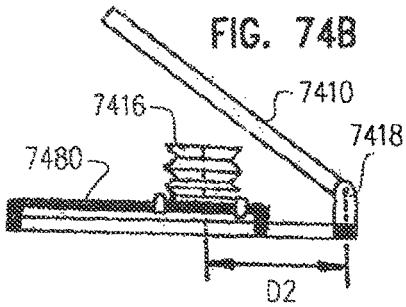

FIGS. 74A and 74B depict an exemplary seesaw fluid transfer system 7400 in two states. Seesaw system 7400 includes an actuator 7416 located beneath a seesaw arm 7410 which is attached to a mobile carriage 7482 mounted on a rail 7480. Arm 7410 is couple to a hinge 7418. Actuator 7416 can be moved to different positions beneath arm 7410, closer or further from hinge 7418. Actuator 7416, when inflated, exerts force on arm 7410. It is well-known that the smaller the distance between the actuator and the hinge, the greater the pressure on the arm. Therefore, when actuator 7416 is positioned at a distance of D1, as depicted. in FIG. 74A, an the actuator is inflated with fluid, the force exerted on arm 7410 is smaller than the force exerted by the same actuator positioned closer (e.g. distance D2) to hinge 7418, as depicted in FIG. 74B. A small child is thus able to seesaw with a much larger child by correctly positioning actuator 7416. For example, a small child positions the actuator with a distance of D1 between the actuator and the hinge while a larger child (or two children or an adult etc.) positions the actuator a distance of D2 from the hinge. The small child is able to lift the bigger child by inflating the actuator in the normal manner.

Figure 75:
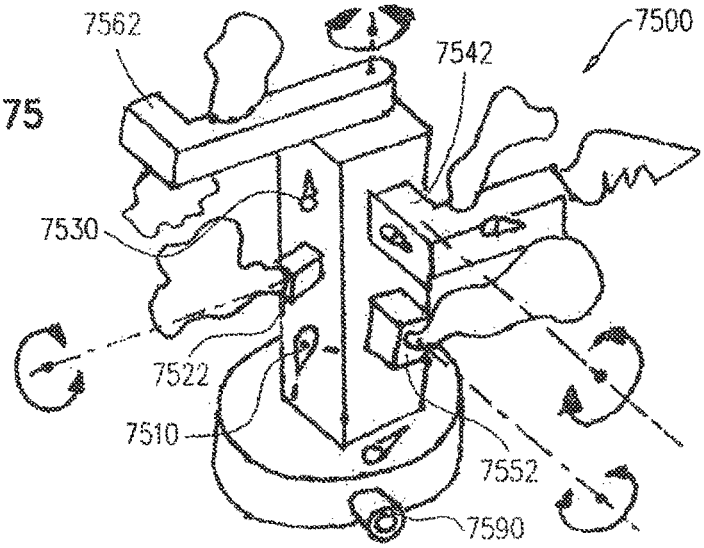

FIG. 75 depicts an exemplary three dimensional toy system 7500. Toy system 7500 includes an exit port 7590 complete with an O-ring, for hermetically coupling to other modular units or a pump. System 7500 includes a number of openings similar in function to the openings of system 7200 depicted in FIG. 72. A first opening 7510 is unused. A second opening (not visible) is in use, housing an object 7522. A third opening 7530 is not in use. A forth object 7542 is coupled to a forth opening (not visible). A fifth object 7552 is coupled to a fifth opening (not visible). A sixth object 7562 is rotatably attached to system 7500. The attached objects include inflatable portions. Fluid is transferred throughout the system via various fluid transfer mechanisms such as unit 6800, T-connector 6900, U-connector 7000 etc., all of which allow bidirectional fluid flow and multi-cycle use/play thanks to conduits such as parallel conduit 6882. Pressure applied to one inflated object leads to a second object to inflate and so on.

FIGS. 76A and 76B are exemplary embodiments of systems created by connecting modular units in a manner substantially similar to system 7100. FIG. 76A depicts a closed system 7600A which includes modular units (e.g. units 6800, 6800', T-connector unit 6900, U-connector unit 7000 etc.) coupled together in a closed circuit. FIG. 76B depicts an open system 7600B which includes modular units (e.g. units 6800, 6800', T-connector unit 6900, U-connector unit 7000 etc.) in a open-ended format.

FIGS. 77A and 77B depict an exemplary fluid transfer system 7700 configured for play. FIG. 77A depicts an isometric view of play system 7700. FIG. 77B is a side view of play system 7700. Play system 7700 includes a first page 7710 with an inflatable object 7712 and a second page 7720 with a second object 7722 mounted thereon. System 7700 functions in a manner substantially similar to system 5000, although the immediate system includes a bi-conduit unit 6800 (not shown) to facilitate fluid transfer between the objects. Fluid transfer is controlled by turning second page 7720. When second page 7720 is turned towards first page 7710, first object 7712 is compressed and second object 7722 is inflated in a process detailed above. When second page 7720 is turned towards a third page 7730 or other flat surface, second object 7722 is compressed and deflated causing first object to inflate. System 7700 is scalable and can include additional pages each with at least one inflatable objected mounted thereon with appropriate fluid transfer mechanisms positioned between the objects. Multiple play systems can be used to create a play environment for a young child.

FIG. 78 illustrates a riding horse vehicle 7800 adapted for play. Vehicle 7800 includes an accordion container 7860 which causes a user of the vehicle to experience a 'horse riding-like sensation' while riding the vehicle. A horse head component 7880, housing handlebars 7882 is adapted to turn about an axis A, influencing the direction of the vehicle, in a well known manner. FIG. 78A is a schematic diagram detailing the function of accordion container 7860 in vehicle 7800. In FIG. 78A, accordion container 7860 is shown having three fluid conduit openings: a control opening 7830, an entry opening 7820 and an exit opening 7810. Three unidirectional valves 7852, 7854 and 7856 are included in the system. Each valve has an open and close state and is of a unidirectional configuration. Valve 7852 opens at a low pressure, valve 7854 open at a medium pressure and valve 7856 opens at a high pressure. An actuator container 7870 facilitates fluid transfer from accordion container 7860 to the actuator when the user (e.g. a child) sits on the vehicle. A return spring (not shown) re-elevates the vehicle seat when the child reduces downward pressure from the seat. One of the valves is open in use, defining the pressure under which fluid is transferred from the accordion to the actuator. The valve is chosen according to the weight of the child using the vehicle. In FIG. 78A, the actuator is depicted as near full and an internal diaphragm 7872 is near the top of the container. FIG. 78B depicts internal diaphragm 7872 near the bottom of the container. A spring 7874 in container 7870 causes the fluid transfer to accordion container 7860 under the right conditions discussed below. A low pressure controller 7834, coupled to control opening 7830 activates a valve 7832 only when the pressure in the system is lower than pressure level at which the low pressure valve 7852 opens. When the lower pressure is achieved, unidirectional valve 7832 opens to convey fluid to the accordion container. In the afore described system, the user of the vehicle is treated to a riding experience which simulates, albeit in a small way, the horse-riding sensation of bumping up and down in the saddle.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A book, comprising:

(a) an inflation valve;

(b) an evacuation valve;

(c) at least two pages operationally coupled together in a binding, which defines an axis about which said at least two pages rotate when turned;

(d) at least two inflatable objects, each of said at least two pages having at least one of said at least two inflatable objects mounted thereon, said inflation valve operationally coupled to one of said inflatable objects and said evacuation valve operationally coupled to one of said inflatable objects;

(e) at least one fluid conduit, interposed between a first and a second of said at least two inflatable objects, said fluid conduit configured to allow a fluid to flow between said at least two inflatable objects.

2. The book of claim 1, wherein said at least one fluid conduit is a tube.

3. The book of claim 1, further comprising:

(f) a bypass conduit coupling a last inflatable object of said at least two inflatable objects with a first inflatable object of said at least two inflatable objects and configured to recycle said fluid from said last inflatable object to said first inflatable object.

4. The book of claim 1, further comprising:

(f) a pump, operationally coupled to said inflation valve and adapted to inflate said first inflatable object.

5. The book of claim 1, further comprising:

(f) a manifold operationally coupled to said at least two inflatable objects, said manifold adapted to transfer said fluid between said at least two inflatable objects.

6. The book of claim 5, wherein said manifold is operationally coupled to each of said at least two inflatable objects via (i) an open state conduit including a unidirectional valve; and (ii) a variable-state conduit, said variable state conduit configured to allow said fluid to flow there-through in an open state and to disallow said fluid to flow there-through in a closed state;

wherein said fluid is expelled from one of said at least two inflatable objects into said manifold through a respective said open state conduit thereof and subsequently expelled from said manifold into a second of said at least two inflatable objects through a respective said variable-state conduit thereof in said open state.

7. The book of claim 5, further comprising:

(g) a pump adapted to expel said fluid into said manifold.

8. The book of claim 1, further comprising:

(f) an inflation conduit operationally coupled to said inflation valve, said inflation conduit adapted to receive said fluid from a pressure source.

9. The book of claim 8, wherein said pressure source is a mouth of a person.

10. The book of claim 1, wherein said evacuation valve and said inflation valve is the same valve.

11. The book of claim 1, wherein said at least one fluid conduit is a variable-state conduit, said variable state conduit configured to allow fluid flow there-through in an open state and to disallow said fluid flow in a closed state.

12. The book of claim 11, wherein in said closed state said variable-state conduit is kinked.

13. The book of claim 11, further comprising (f) at least one additional conduit, said additional conduit being an open-state conduit.

14. The book of claim 13, wherein said at least one additional conduit includes a unidirectional valve.

15. The book of claim 11, wherein a predefined change in a relative orientation between said at least two inflatable objects converts said state of said at least one variable-state conduit between said closed state and said open state.

16. The book of claim 11, wherein turning of one of said pages determines said state of said at least one variable-state conduit and wherein each of said at least two pages has a weight and thickness sufficient to expel said fluid from one of said inflatable objects when pressure is exerted thereon, thereby transferring said fluid to another of said inflatable objects via said variable state conduit.

17. The book of claim 16, wherein said at least two pages are abutting.

18. The book of claim 1, wherein at least one of said at least two pages is adapted to be replaceably removed from said binding.

19. The book of claim 1, wherein at least one of said at least two pages is a cover of the book.

* * * * *